US010883305B2

(12) United States Patent
Jeong et al.

(10) Patent No.: US 10,883,305 B2
(45) Date of Patent: Jan. 5, 2021

(54) REFRIGERATOR

(71) Applicant: LG Electronics Inc., Seoul (KR)

(72) Inventors: Hyocheol Jeong, Seoul (KR); Minkyu Park, Seoul (KR); Chansung Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 121 days.

(21) Appl. No.: 16/196,568

(22) Filed: Nov. 20, 2018

(65) Prior Publication Data

US 2019/0249485 A1 Aug. 15, 2019

(30) Foreign Application Priority Data

Feb. 12, 2018 (KR) ..... 10-2018-0017299

(51) Int. Cl.

| | |
|---|---|
| ***E06B 3/67*** | (2006.01) |
| ***A47F 3/04*** | (2006.01) |
| ***F25D 23/02*** | (2006.01) |
| ***F25D 27/00*** | (2006.01) |
| ***F25D 29/00*** | (2006.01) |

(Continued)

(52) U.S. Cl.

CPC ..... *E06B 3/6722* (2013.01); *A47F 3/0434* (2013.01); *F21V 33/0044* (2013.01); *F25D 23/028* (2013.01); *F25D 27/005* (2013.01); *F25D 29/005* (2013.01); *F21W 2131/305* (2013.01); *F25D 23/025* (2013.01); *F25D 2323/021* (2013.01); *F25D 2323/023* (2013.01);

(Continued)

(58) Field of Classification Search

CPC ..... A47F 3/0434; F25D 27/00; F25D 27/005; F25D 29/005; F25D 2400/361; F25D 2700/04

See application file for complete search history.

(56) References Cited

U.S. PATENT DOCUMENTS

| | | | | |
|---|---|---|---|---|
| 6,059,420 | A | 5/2000 | Rogers | |
| 7,155,923 | B2 * | 1/2007 | Nam | F25D 29/005 165/80.3 |

(Continued)

FOREIGN PATENT DOCUMENTS

| | | |
|---|---|---|
| EP | 2886981 | 6/2015 |

OTHER PUBLICATIONS

Extended European Search Report in European Application 18203368.8, dated May 24, 2019, 10 pages.

*Primary Examiner* — William N Harris
(74) *Attorney, Agent, or Firm* — Fish & Richardson P.C.

(57) ABSTRACT

A refrigerator includes a cabinet, a door, a transparent panel assembly disposed at the door and defining a see-through part through which an interior of the refrigerator is visible, and a first light disposed closer to the interior than the transparent panel assembly to brighten an area viewed by the see-through part. The transparent panel assembly includes transparent panels spaced apart from each other to define an accommodation space, a display disposed in the accommodation space to output a screen, and a second light brightening the display. The display, the first light, and the second light are selectively turned off according to manipulation of a user to be converted into an opaque state in which the interior is not visible and a transparent state in which the interior is visible, and in the transparent state, a screen is outputted while an inner space of the refrigerator is seen.

20 Claims, 65 Drawing Sheets

(51) Int. Cl.
*F21V 33/00* (2006.01)
*F21W 131/305* (2006.01)

(52) U.S. Cl.
CPC .... *F25D 2400/361* (2013.01); *F25D 2700/04* (2013.01)

(56) References Cited

U.S. PATENT DOCUMENTS

| | | | | |
|---|---|---|---|---|
| 9,689,603 | B2 * | 6/2017 | Roh | G02F 1/133377 |
| 9,984,660 | B2 * | 5/2018 | Kim | G09G 5/14 |
| 9,990,820 | B2 * | 6/2018 | Goppion | G08B 13/14 |
| 10,295,248 | B2 * | 5/2019 | Miller | F25D 23/04 |
| 10,317,133 | B2 * | 6/2019 | Koo | F25D 29/005 |
| 2008/0186696 | A1 * | 8/2008 | Awai | F25D 27/005 362/92 |
| 2010/0313592 | A1 * | 12/2010 | Pae | F25D 23/02 62/264 |
| 2012/0105424 | A1 * | 5/2012 | Lee | G09F 27/00 345/212 |
| 2014/0144083 | A1 | 5/2014 | Artwohl et al. | |
| 2014/0232958 | A1 | 8/2014 | Venturas et al. | |
| 2015/0035936 | A1 * | 2/2015 | Robinson | H04N 5/2254 348/14.08 |
| 2015/0170608 | A1 * | 6/2015 | Kim | G09F 23/0058 345/592 |
| 2015/0267960 | A1 * | 9/2015 | Cheon | F25D 29/00 62/127 |

* cited by examiner

FIG. 22

| | First state | Second state | Third state | Fourth state | Fifth state |
|---|---|---|---|---|---|
| Display | ON | ON | ON | ON | OFF |
| Display light | OFF | ON | ON | OFF | OFF |
| Door light | ON | ON | OFF | OFF | OFF |
| Interior light | ON | OFF | OFF | ON | OFF |

REFRIGERATOR

CROSS-REFERENCE TO RELATED APPLICATIONS

The present application claims priority under 35 U.S.C. 119 and 35 U.S.C. 365 to Korean Patent Application No. 10-2018-0017299, filed on Feb. 12, 2018, which is hereby incorporated by reference in its entirety.

BACKGROUND

The present disclosure relates to a refrigerator.

In general, a refrigerator refers to a home appliance in which food may be stored in an internal storage space, which is shielded by a door, at a low temperature. To achieve this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Further, the refrigerator may be classified into various types according to arrangement of the storage space and a structure of the door configured to open/close the storage space.

In general, the refrigerator has a problem in that when the door is not opened, internal food cannot be identified. That is, the door should be opened to identify whether desired food is received in a space in the refrigerator or in a separate storage space provided in the door. Further, when a user does not exactly know where the food is stored, an opening time of the door may increase or the number of times the door is opened may increase. At this time, unnecessary outflow of cold air may occur.

In recent years, to solve the above-described problem, a refrigerator in which a portion of a door is transparent or an interior of the refrigerator may be viewed, has been developed as disclosed in U.S. Pat. No. 6,059,420.

However, such a refrigerator has a problem in that a variety of screen states for allowing a user to selectively see the interior of the refrigerator or to see the interior of the refrigerator are not provided, but it is just enough to see the interior of the refrigerator.

Furthermore, the refrigerator according to the related art shows food stored in the refrigerator and simultaneously displays information associated with the stored food but does not process the information and is merely confirmation of presence or absence of the food.

SUMMARY

Embodiments provide a refrigerator that is capable of providing a see-through screen of the refrigerator even though a door is closed to improve user's convenience.

Embodiments also provide a refrigerator that provides a see-through part having an adjustable transparency to visualize an inner space of the refrigerator according to user's preference and environment.

Embodiments also provide a refrigerator that is capable of transmitting see-through information of the refrigerator and image output information through a door at the same time.

Embodiments also provide a refrigerator that is capable of visualizing food stored therein through a door and also displaying, generating, and processing information associated with the visualized food.

Embodiments also provide a refrigerator that is capable of transmitting information associated with food stored in the refrigerator through a large panel assembly that is capable of visualizing an interior of the refrigerator.

Embodiments also provide a refrigerator that is capable of preventing a user from being glaring at an even time of opening and closing a door and also outputting information through a see-through part.

Embodiments also provide a refrigerator in which an output of a see-through part and a user's manipulation are enabled continuously before and after a door is opened and closed.

Embodiments also provide a refrigerator that is capable of outputting information by being associated with movement of food within the refrigerator, which is visualized by the see-through part.

Embodiments also provide a refrigerator that is capable of securing insulation performance and has a structure in which a display that is capable of displaying a screen is disposed.

In one embodiment, a refrigerator includes: a plurality of panels constituting a see-through part on a door; a transparent display disposed in a space between the panels; a display light; and a first light brightening a see-through space, wherein a turn-on/off of the first light and the display, a second light, and the display is controlled according to manipulation of a user to output a screen in a state in which the see-through part is opaque and transparent or transparent.

In another embodiment, a refrigerator includes: a plurality of panels constituting a see-through part on a door; a transparent OLED panel disposed in a space between the panels; and a first light brightening a see-through space, wherein a turn-on/off of the display and the first light is controlled according to manipulation of a user to output a screen in a state in which the see-through part is opaque and transparent or transparent.

As the turn-on/off of the first light, the display, and the second light is combined with each other, a degree of transparency of the see-through part and a degree of definition of the output screen may be adjustable.

The first light may include: a door light provided in the door; and an interior light provided in the refrigerator, wherein the lights may be selectively turned on/off according to the adjustment of brightness of the see-through part.

An output icon for outputting information may be displayed on an area of the see-through part through which food is seen by the display, and a transparent panel assembly may include a touch sensor so that the output icon is generated, processed, moved, and edited by the manipulation of the user.

The refrigerator may further include a camera for photographing a position of the food stored in the refrigerator, wherein the display may allow the output icon to move based on the position information acquired through the camera.

In another embodiment, a refrigerator includes: a cabinet defining a storage space; a door opening and closing the storage space; a transparent panel assembly which is disposed on at least one area of the door and on which a see-through part through which an interior of the refrigerator is seen is disposed; and a first light disposed closer to the interior of the refrigerator than the transparent panel assembly to brighten an area that is viewed by the see-through part, wherein the transparent panel assembly includes: a plurality of transparent panels spaced apart from each other to define an accommodation space; a transparent display disposed in the accommodation space to output a screen; and a second light brightening the display within the accommodation space, wherein the display, the first light, and the second light are selectively turned off according to manipulation of a user so as to be converted into an opaque state in which the interior of the refrigerator is not seen and a transparent state in which the interior of the refrigerator is seen, and in the transparent state, a screen is outputted while an inner space of the refrigerator is seen.

The opaque state may include: a fifth state in which all the display, the first light, the second light are turned off; and a third state in which the display and the second light are turned on, and the first light is turned off.

The transparent state may include: a first state in which the first light is turned on, and the second light is turned off; and a second state in which all the first light, the display, and the second light are turned on.

In the first state, the display may be turned on.

The first light may include: a door light provided in the door; and an interior light disposed closer to the interior of the refrigerator than the door light to brighten the interior of the refrigerator.

In the transparent state, only the door light of the first light may be turned on.

In the transparent state, when the door is opened, the door light may be turned off, and the interior light may be turned on.

When the door is opened, the second light may be also turned off so that the display is maintained in the turn-on state to output a screen the see-through part.

When the door is closed after being opened, the display may be maintained in the turn-on state to maintain the output of the screen, and the second light may be turned on again.

The refrigerator may further include a manipulation input unit manipulated to convert the state of the see-through part, wherein the refrigerator may include one or more of: a proximity detection sensor detecting an approach of the user; a motion detection sensor detecting a motion of the user; a microphone into which a voice of the user is inputted; a knock detection device detecting knock manipulation of the user; a vision sensor photographing an image of the user; and a manipulation part recognizing direct push manipulation of the user.

The transparent panel assembly may further include a touch sensor recognizing touch manipulation of the user, and the state of the see-through part may be adjusted by the touch manipulation of the transparent panel assembly.

In the see-through part, all the display, the first light, and the second light may be turned off to maintain the opaque state before a manipulation input of the user.

When the manipulation of the manipulation input unit is detected in the opaque state, the state of the see-through part may be converted into one corresponding to the manipulation of the manipulation input unit of: a first state in which the first light is turned on, and the second light is turned off so that the inside of the see-through part is seen; and a second state in which all the first light, the second light, and the display are turned on so that a screen is outputted while the inside of the see-through part is seen; and a third state in which the first light is turned off, and the second light and the display are turned on so that only the screen is outputted while the inside of the see-through part is not seen.

When the manipulation of the manipulation input unit is detected in the opaque state, the first light may be turned off, and the second light and the display may be turned on so that the see-through part becomes the third state, and when additional manipulation of the user is inputted, the state may be selectively converted into one of the first state and the second state.

In the opaque state, when the user closes the door after being opened, the see-through part may become a glance state, and in the glance state, the first light is turned off, and the second light and the display may be tuned on so that information is outputted while the interior of the refrigerator is not seen.

In the glance state, the see-through part may temporarily output a preset screen, and when an additional input of the user is not performed, the glance state may be converted again into the opaque state.

In a state in which the door is opened, and the see-through part may be opaque, when the manipulation of the user is inputted, the display and the second light may be turned on to output the screen.

When an alert for transmitting information or message to the user through the screen output of the see-through part is provided, if an approach of the user is detected by a proximity sensor, the display and the second light may be turned on to output an alert screen through the see-through part in the state in which the see-through part is opaque.

When the see-through part is the transparent state, the display and the second light may be turned on to output an output icon for displaying information on the see-through part, and the output icon may move to and be disposed at a position corresponding to that of food stored in the refrigerator, which is seen in the state in which the first light is turned on, by touch manipulation of the user.

A camera for photographing the food may be provided in the refrigerator, and when the accommodated position of the food is changed, the camera may detect the position change, and the output icon may move to the changed accommodated position of the food, or an alert is outputted.

A camera for photographing food may be provided in the refrigerator, and when the accommodated position of the food is changed, the camera may detect the position change, and an alert for informing the position change of the output icon may be outputted.

The space between the front panel and the rear panel may include a plurality of spaces that are continuously defined, and the display, the display light, and a light guide plate may be provided in a space that is mostly closes to the front panel.

The space between the front panel and the rear panel may include an external space and an internal space defined inside the external space, wherein the display, the display light, and the light guide plate may be disposed in the external space.

The space between the front panel and the rear panel may be partitioned by an insulation panel, an accommodation space in which the display, the display light, and the light guide plate are disposed may be defined between the front panel and the insulation panel, and an insulation space that is thermally insulated by injecting a vacuum or insulation gas may be defined between the rear panel and the insulation panel.

An outer spacer disposed along a circumference to define an accommodation space in which the display, the display light, and the light guide plate are accommodated may be disposed between the front panel and the rear panel, and a sealed insulation space for the thermal insulation may be further defined inside the accommodation space.

The insulation space and the accommodation space, which are partitioned with respect to each other, may be defined between the front panel and the rear panel, the insulation space may be disposed closer to the interior of the refrigerator than the accommodation space, and the display may be accommodated in the accommodation space.

The details of one or more embodiments are set forth in the accompanying drawings and the description below. Other features will be apparent from the description and drawings, and from the claims.

BRIEF DESCRIPTION OF THE DRAWINGS

FIG. 22 is a table showing an operation state of the transparent panel assembly according to a state of the see-through part.

FIG. 31 is a view sequentially illustrating a state change when the freezing compartment door is closed after being opened in the state in which the see-through part is turned on.

FIG. 32 is a view sequentially illustrating a state change according to whether a set time elapses in the see-through part is turned on.

FIG. 33 is a view sequentially illustrating a state change when one refrigerating compartment door is closed after being opened in the state in which the see-through part is turned on.

FIG. 34 is a view sequentially illustrating a state change when the other refrigerating compartment door is closed after being opened in the state in which the see-through part is turned on.

FIG. 35 is a view sequentially illustrating a state change when the main door of the refrigerating compartment door is closed after being opened in the state in which the see-through part is turned on.

FIG. 36 is a view sequentially illustrating a state change when the sub-door of the refrigerating compartment door is closed after being opened in the state in which the see-through part is turned on.

DETAILED DESCRIPTION OF THE EMBODIMENTS

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
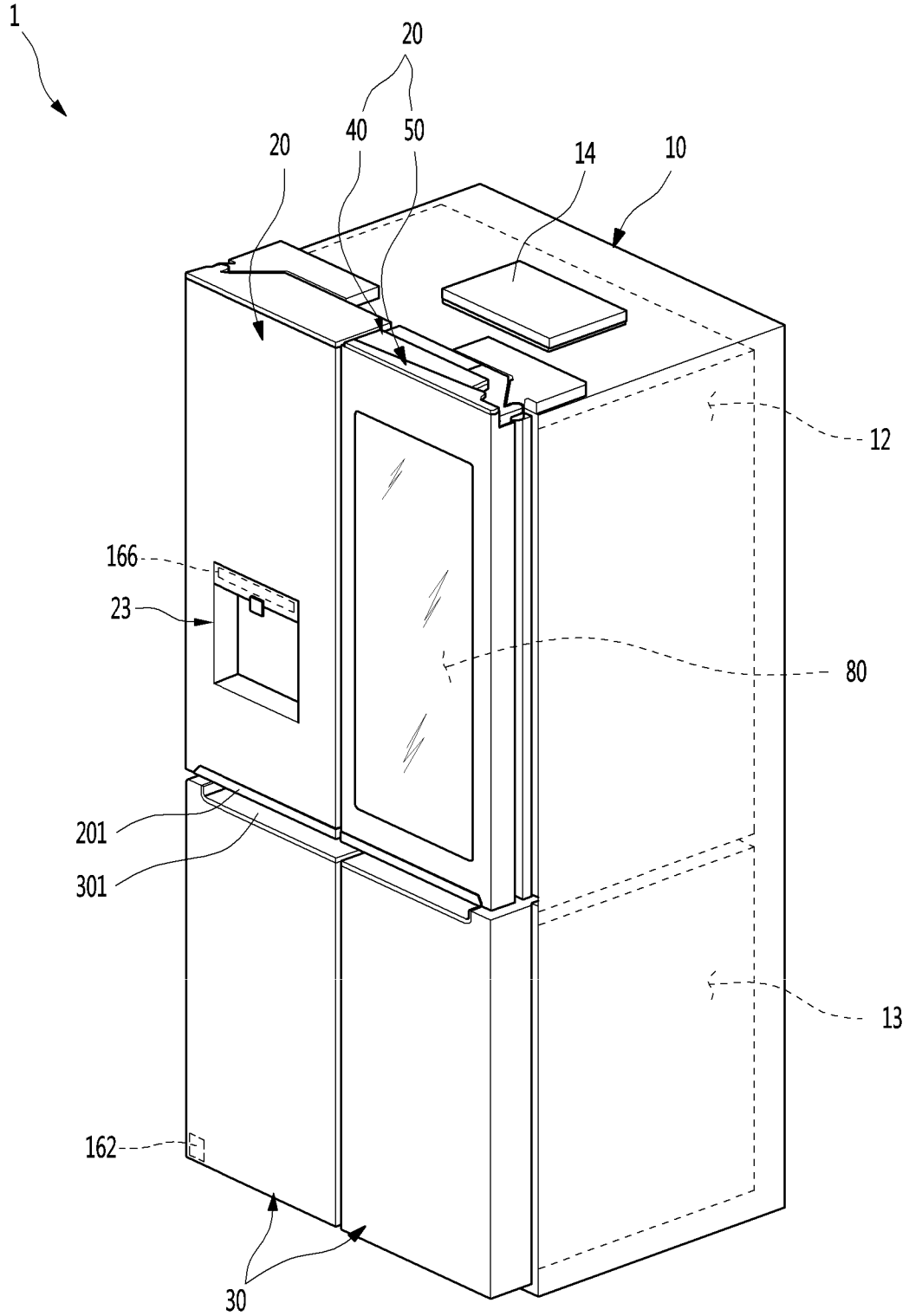
FIG. 1 is a perspective view of a refrigerator according to an embodiment.

FIG. 1 is a perspective view of a refrigerator according to an embodiment.

Referring to the drawing, a refrigerator 1 according to an embodiment includes a cabinet 10 defining a storage space and a door opening or closing the storage space. Here, an outer appearance of the refrigerator 1 may be defined by the cabinet 10 and the door.

The inside of the cabinet 10 is partitioned into upper and lower portions by a barrier 11. A refrigerating compartment 12 may be defined in the upper portion of the cabinet 10, and a freezing compartment 13 may be defined in the lower portion of the cabinet 10.

Also, a control unit 14 for controlling an overall operation of the refrigerator 1 may be disposed on a top surface of the cabinet 10. The control unit 14 may be configured to control a cooling operation of the refrigerator as well as electric components for selective viewing and screen output of a see-through part 80.

The door may include a refrigerating compartment door and a freezing compartment door 30. The refrigerating compartment door 20 may be opened and closed by rotating an opened front surface of the refrigerating compartment 12, and the freezing compartment door 30 may be switched by rotating an opened front surface of the freezing compartment 13.

A motion detection device 162 may be disposed on a lower end of a front surface of the freezing compartment door 30. The motion detection device 162 may allow a user to detect a specific motion at a specific position. An operation may be inputted through an operation such as putting a user's foot on the motion detection device 162. A manipulation for changing a state of the see-through part may be performed by a manipulation input through the motion detection device 162.

Also, the refrigerating compartment door 20 may be constituted by a pair of left door (see reference numeral 21 of FIG. 29) and right door (see reference numeral of FIG. 29) to open and close the refrigerating compartment door 20. Also, the freezing compartment door 30 may be provided in a pair of left and right doors. Thus, the freezing compartment 13 may be opened and closed by the pair of doors. Alternatively, the freezing compartment door 30 may be withdrawable in a draw type as necessary and provided as one or more doors.

Although a refrigerator in which, a French type door in which a pair of doors rotate to open and close one space is applied to a bottom freezer type refrigerator in which the freezing compartment 13 is provided at a lower portion, is described as an example in this embodiment, the present disclosure may be applied to all types of refrigerators including door without being limited to shapes of the refrigerators.

Also, recessed handle grooves 201 and 301 may be provided in a lower end of the refrigerating compartment door 20 and an upper end of the freezing compartment door 30. A user may insert a his/her hand into the handle groove 201 or 301 to open and close the refrigerating compartment door 20 or the freezing compartment door 30.

At least one door may be provided so that the interior of the refrigerator is seen through the door. A see-through part 80 that is an area, through which the storage space in the rear surface of the door and/or the interior of the refrigerator are seen, may be provided in the refrigerating compartment door 20. The see-through part 80 may be defined as an area through which the user sees the interior of the refrigerator, and a screen is outputted.

The see-through part 80 may constitute at least a portion of a front surface of the refrigerating compartment door 20. The see-through part 80 may be selectively transparent or opaque according to user's manipulation. Thus, foods accommodated in the refrigerator may be accurately identified through the see-through part 80.

In an embodiment, the transparent or opaque see-through part 80 may mean that the see-through part 80 in itself is not changed in transparent or opaque property, but brightness within the refrigerator is adjusted according to the operations of the display light 68 and the door light 57, and a state seen when the user confirms the interior of the refrigerator through the see-through part 80 is changed according to the operation of the display 62. That is, the transparent state of the see-through part 80 may mean a state in which food stored in the refrigerator is sufficiently identified through the see-through part 80, and the opaque state of the see-through part 80 may mean a state in which it is difficult to identify food stored in the refrigerator through the see-through part 80.

Also, the screen may be outputted through the see-through part 80. Thus, an area of the see-through part 80 may be called a screen. The see-through part 80 may be adjustable in transparency according to the manipulation state thereof. The inner space of the door 20, i.e., the door-side storage space (see reference numeral 41 of FIG. 2) may be seen, and also, the screen may be outputted through the see-through part 80. A screen configuration and a state change of the see-through part 80 will be described below in more detail.

Also, although the structure in which the see-through part 80 is provided in the refrigerating compartment door 20 is described as an example in this embodiment, the see-through part 80 may be provided in various different types of refrigerator doors such as the freezing compartment door 30 according to a structure and configuration of the refrigerator.

Also, a dispenser 23 may be provided in the left door 21, in which the see-through part 80 is not provided, of the pair of refrigerating compartment doors 20. The dispenser 23 may dispense purified water or ice from the outside of the refrigerating compartment door 20.

Also, a manipulation part 166 may be disposed on one side of the dispenser. The manipulation part 166 may include a touch sensor or a button to manipulate operations of the dispenser 23 and the refrigerator 1 and input the operations through user's touch or pushing operation.

The water or ice may be dispensed through the dispenser 23 by the manipulation of the manipulation part 166. Also, the manipulation for the specific functions of the refrigerator 1 may be inputted, or the interior of the refrigerator 1 may be adjusted in temperature through the manipulation part 166. Particularly, the activation of the see-through part 80 may be selectively manipulated, and the output of the screen may be manipulated through the transparent panel assembly 60 that will be described below.

Alternatively, the manipulation part 166 may be integrated with the dispenser 23 or may be separately provided on one side of the refrigerating compartment door 20.

Figure 2:
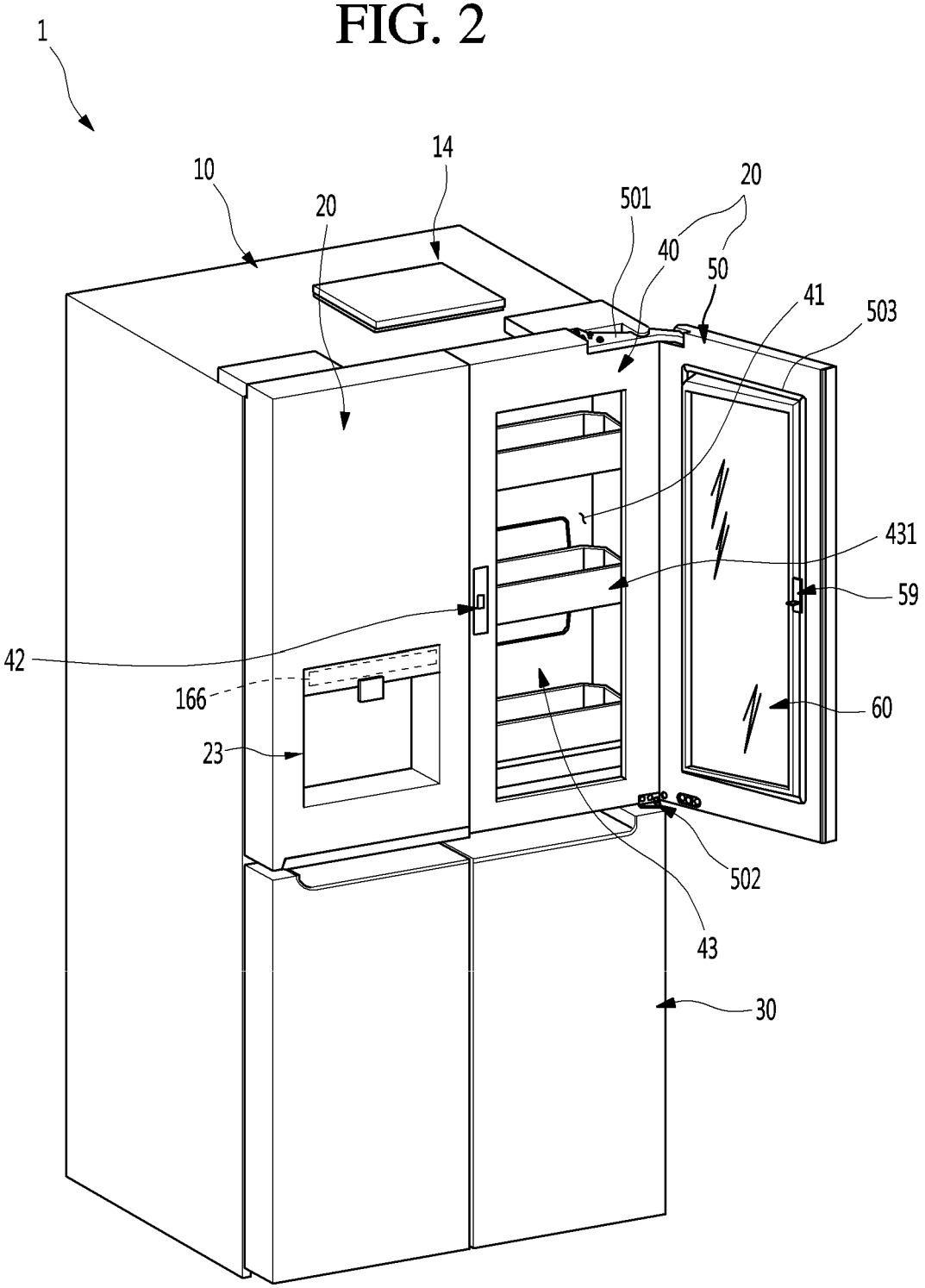
FIG. 2 is a perspective view of the refrigerator with a sub-door opened.
Figure 3:
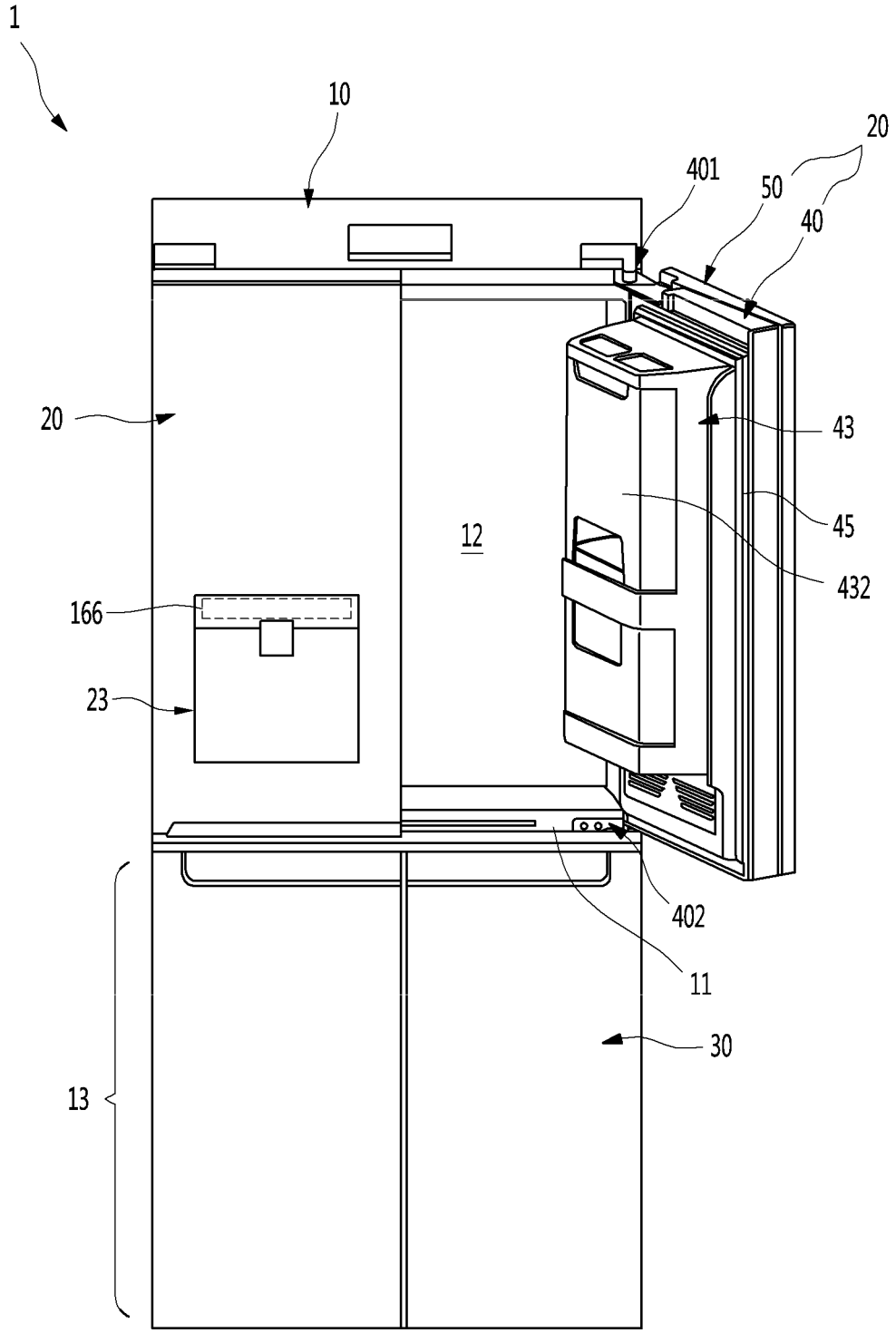
FIG. 3 is a perspective view of the refrigerator with a main door opened.

FIG. 2 is a perspective view of the refrigerator with a sub-door opened. Also, FIG. 3 is a perspective view of the refrigerator with the main door opened.

As illustrated in drawings, the refrigerating compartment door 20, which is disposed at the right side (see reference numeral 22 of FIG. 29), of the pair of refrigerating compartment doors 20 may be doubly opened and closed. In detail, the refrigerating compartment door 20, which is disposed at the right side, may include a main door 40 that opening and closing the refrigerating compartment 12 and a sub-door 50 rotatably disposed on the main door 40 to open and close an opening defined in the main door 40.

The main door 40 may have the same size as that of the refrigerating compartment door 20, which is disposed at the left side (see reference numeral 21 of FIG. 29), of the pair of refrigerating compartment doors 20. The main door 40 may be rotatably mounted on the cabinet 10 by an upper hinge 401 and a lower hinge 402 to open at least a portion of the refrigerating compartment door 20.

Also, an opening that is opened to a predetermined size is defined in the main door 40. A door basket 431 may be mounted on the rear surface of the main door 40 as well as the inside of the opening. The inner space of the opening and the door basket 431 may define the door-side storage space 41 that is seen from the outside through the see-through part 80. Also, the opening may have a size that occupies most of the front surface of the main door 40 except for a portion of a circumference of the main door 40.

Also, a main gasket 45 may be disposed on a circumference of the rear surface of the main door 40 to prevent cool air within an internal space of the cabinet 10 from leaking when the main door 40 is opened.

The sub-door 50 may be rotatably mounted on the front surface of the main door 40 to open and close the door-side storage space 41. Thus, the sub-door 50 may be opened to expose the door-side storage space 41.

The sub-door 50 may have the same size as the main door 40 to shield the entire front surface of the main door 40. Also, when the sub-door 50 is closed, the main door 40 and the sub-door 50 may be coupled to each other to provide the same size and configuration as those of the left refrigerating compartment door 20. Also, a sub gasket 503 may be disposed on the rear surface of the sub-door 50 to seal a gap between the main door 40 and the sub-door 50.

A transparent panel assembly 60 that selectively sees the inside and outputs a screen may be disposed at a center of the sub-door 50. Thus, even though the sub-door 50 is closed, the inside of the storage space 41 may be selectively seen, and also an image inside the storage space 41 may be outputted. The see-through part 80 may be defined as a portion of the sub-door 50, through which the interior of the refrigerator 1 is seen and be called a visible area or a screen. Also, the see-through part 80 may not necessarily match the entire transparent panel assembly 60.

The transparent panel assembly 60 may be configured to be selectively transparent or opaque according to user's manipulation. Thus, only when the user desires, the transparent display assembly 60 may be transparent so that the interior of the refrigerator 1 is visualized, otherwise, be maintained in the opaque state. Also, the transparent panel assembly 60 may output a screen in the transparent or opaque state.

In an embodiment, the transparent state is not completely transparent state but means a state in which the interior is capable of being identified. The transparent panel assembly 60 may realize various transparencies by combining the operations of the display 62, the display light 68, the door light 57, and the interior light 121. Also, in an embodiment, the opaque state includes a dark state in which the interior is not identified, and an inner silhouette may be seen when the user is in close proximity to the see-through part 80.

In the embodiment, the transparent panel assembly 60 is configured to shield an opened portion of the sub-door 50. However, according to types of the door, even when one door is configured as in the right door 20 of the refrigerating compartment 12, an opening may be formed in the door 20, and the transparent panel assembly may be mounted to shield the opening of the door 20. That is, it is noted that the transparent panel assembly 60 may be applied to all types of doors, through which an opening is formed, regardless of the shape of the refrigerator and the shape of the door.

A sub-upper hinge 501 and a sub lower hinge 502 may be respectively provided on upper and lower ends of the sub-door 50 so that the sub-door 50 is rotatably mounted on the front surface of the main door 40. Also, an opening device 59 may be provided on the sub-door 50. A locking unit 42 may be provided on the main door 40 to correspond to the opening device 59. Thus, the sub-door 50 may be maintained in the closed state by the coupling between the opening device 59 and the locking unit 42. When the coupling between the opening device 59 and the locking unit 42 is released by manipulation of the opening device 59, the sub-door 50 may be opened with respect to the main door 40.

Also, a damping device (see reference numeral 504 of FIG. 5) may be provided on a lower end of the sub-door 50. The damping device 504 may be disposed on edges of the lower end and lateral end of the sub-door 50, which are adjacent to the sub lower hinge 502, so that an impact is damped when the sub-door 50 having a relatively heavy weight by the transparent panel assembly 60 is closed.

An accommodation case 43 may be provided in the rear surface of the main door 40. A plurality of door baskets 431 may be disposed on the accommodation case 43, and a case door 432 may be provided on the accommodation case 43.

Figure 4:
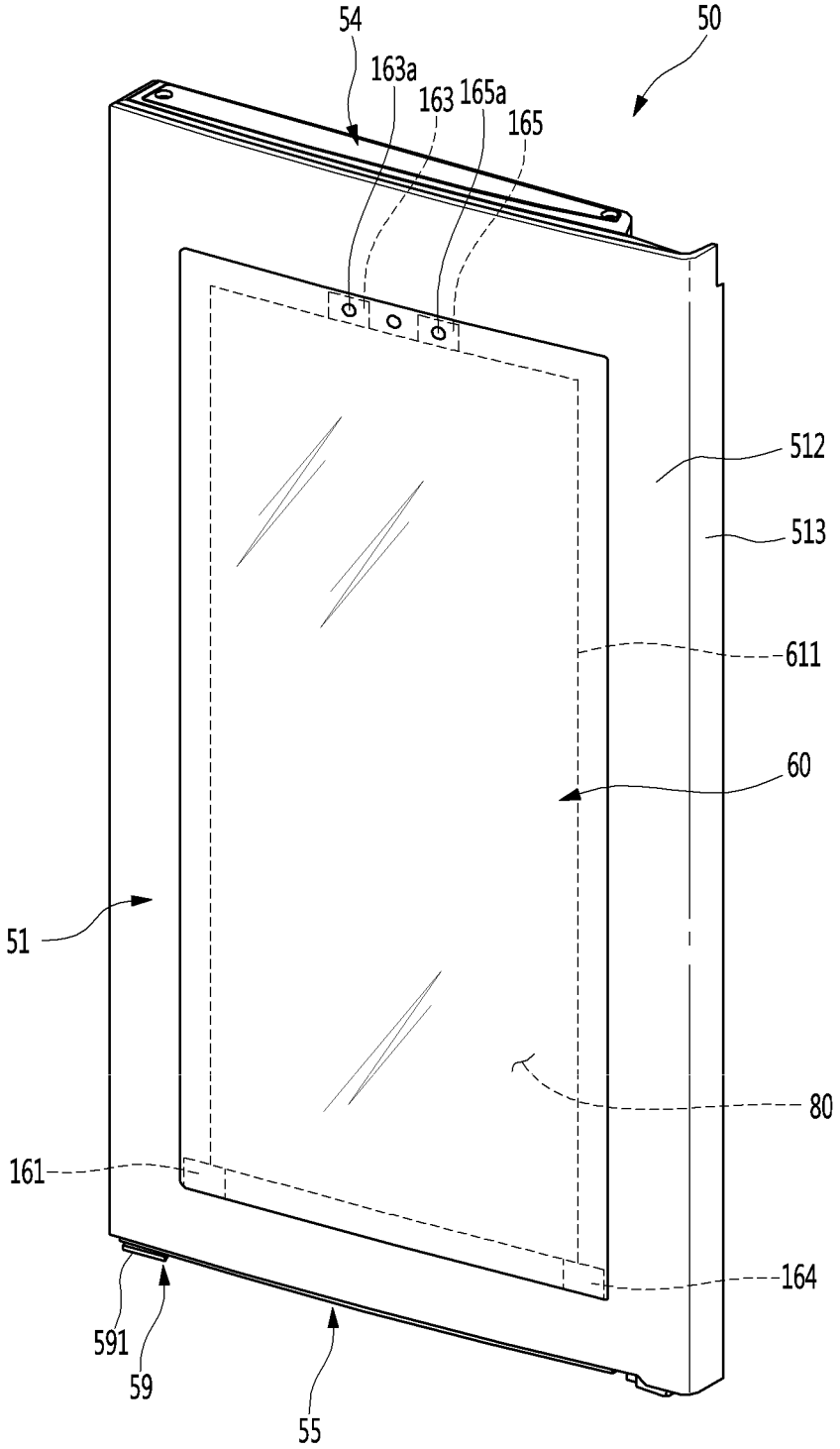
FIG. 4 is a perspective view of the sub-door when viewed from a front side.
Figure 5:
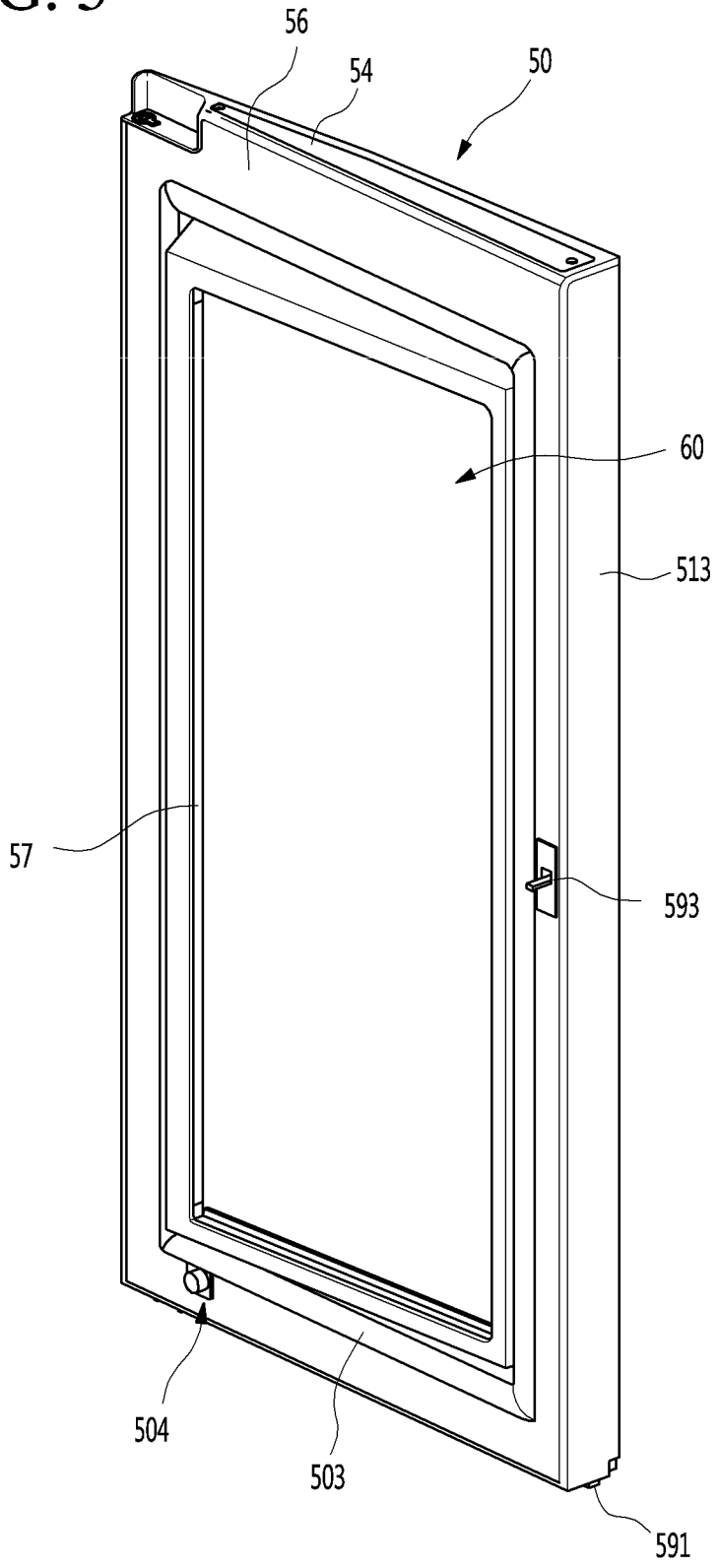
FIG. 5 is a perspective view of the sub-door when viewed from a rear side.
Figure 6:
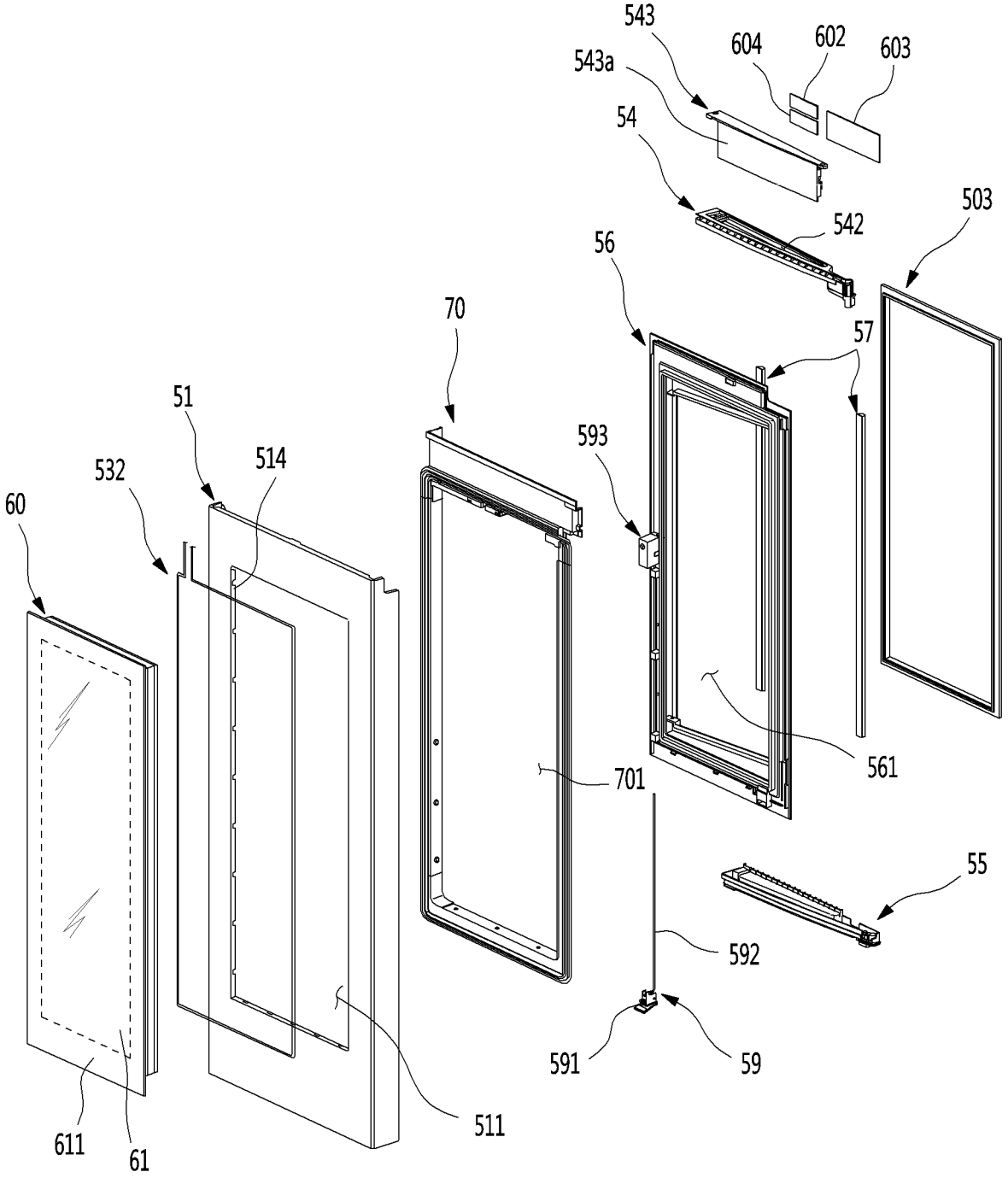
FIG. 6 is an exploded perspective view of the sub-door.

FIG. 4 is a perspective view of the sub-door when viewed from a front side. Also, FIG. 5 is a perspective view of the sub-door when viewed from a front side. Also, FIG. 6 is an exploded perspective view of the sub-door.

As illustrated in the drawings, the sub-door 50 may include an out plate 51 defining an outer appearance of the sub-door 50, a door liner 56 mounted to be spaced apart from the out plate 51, the transparent display assembly 60 mounted on an opening of the out plate 51 and the door liner 56, and upper and lower cap decos 54 and 55 defining the top and bottom surfaces of the sub-door 50. The above-described constituents may be coupled to define the whole outer appearance of the sub-door 50.

The outer plate 51 may constitute an outer appearance of the front surface of the sub-door 50 and a portion of a peripheral surface of the sub-door 50 and be made of a stainless steel material. The outer plate 51 may constitute a portion of the outer appearance of the sub-door 50 as well as the front surface of the sub-door 50. Also, the outer plate 51 may be made of the same material of the front surface of each of the refrigerating compartment door 20 and the freezing compartment door 30. Various surface treatments such as coating or film attachment so as to realize anti-fingerprint coating, hair lines, colors, or patterns may be performed on the front surface of the outer plate 51.

The outer plate 51 may include a front part 512 defining the outer appearance of the front surface and a side part 513 defining an outer appearance of the side surface that is exposed to the outside. Also, a plate opening 511 may be defined at a center of the front part 512. Here, the plate opening 511 may be shielded by the transparent panel assembly 60. Also, since the interior of the refrigerator 1 is seen through the transparent panel assembly 60 shielding the plate opening 511, the inside of the plate opening 511 is called the see-through part 80.

The transparent panel assembly 60 forms the area of the see-through part 80 in the state of shielding the plate opening 511. Also, the bezel 611 may be disposed around the front surface of the transparent panel assembly 60 to shield the mounted structure of the transparent panel assembly 60 and the components attached to the transparent panel assembly 60.

For example, at least one of a proximity detection sensor 161, a microphone 163, a knock detection device 164, and a vision sensor 165 may be mounted around a rear surface of the front panel 61 defining a rear side of the bezel 611, i.e., the front surface of the transparent panel assembly 60. Also, the bezel 611 may cover the proximity detection sensor 161, the microphone 163, the knock detection device 164, and the vision sensor 165, which are mounted thereon.

Particularly, the microphone 163 may be closely attached to the rear surface of the front panel 61 and have a microphone hole 163*a* at a position corresponding to the microphone 163. Thus, a voice of the user located at the front of the refrigerator 1 may be effectively recognized.

Also, the vision sensor 165 may include a camera to recognize the user located at the front of the refrigerator 1 and be closely attached to the rear surface of the front panel 61. Also, a sensor hole 165*a* may be defined in a position of the front panel 61 corresponding to the vision sensor 165 so that an image is photographed. The sensor hole 165*a* may be a hole passing through glass or an area that is transparent by removing a black color of the bezel 611.

The microphone hole 163*a* and the sensor hole 165*a* may be defined in the front panel 61 and disposed outside the see-through part 80 so that the holes do not affect the see-through part, the accommodation space 600*b*, and the insulation space 600*a*. Also, the microphone hole 163*a* or the sensor hole 165*a* may be defined in the area of the bezel 611 so that the microphone 163 and the vision sensor 165 are covered by the bezel 611.

Also, each of the microphone hole 163*a* and the sensor hole 165*a* may have a size that is not seen from the outside while a voice input and image photographing are enabled. For example, the microphone hole 163*a* may have a size of about 0.5 mm to about 3 mm.

The proximity detection sensor 161 may be disposed at a left lower end of the front panel 61 so that the user is easily and proximately detected. Thus, the proximity detection sensor 161 may be disposed closer to a central portion of the front of the refrigerator 1 to easily detect the user.

The proximity detection sensor 161 may be disposed on one side of the front surface of the refrigerating compartment door 20 outside the front panel 61. Here, the outer appearance of the refrigerator 1 may be deteriorated by the exposure of the proximity detection sensor 161. Also, when the proximity detection sensor 161 is installed outside the front panel 61, the proximity detection sensor 161 may be disposed on a region into which an insulation material is filled. In this case, a structure for mounting the proximity detection sensor 161 may be complicated, and the insulation performance may be deteriorated.

Also, the proximity detection sensor 161 may be disposed on a front end of the cabinet 10. When the proximity detection sensor 161 is disposed on the front end of the cabinet 10, detection failure may occur, or the detection area may be reduced by the portion that is covered by the refrigerating compartment door 20.

Also, the knock detection device 164 may be closely attached to the front panel 61 to recognize the user when the user knocks the front surface of the transparent panel assembly 60. The knock detection device 164 and the proximity detection sensor 161 may be disposed on the area of the bezel 611 so that the knock detection device 164 and the proximity detection sensor 161 are not exposed to the outside. The position of the knock detection device 164 is not limited to the above-described position. For example, the knock detection device 164 may be installed at any position as long as the knock detection device 164 is covered by the rear surface of the front panel and the bezel 611.

The front part 512 of the outer plate 51 may have a curvature that gradually decreases outward from a central side of the refrigerator 1 as a whole. The front part 512 may be rounded to correspond to the front surface of the refrigerating compartment door 20, which is adjacent to the front part 512. Thus, the outer appearance of the front surface of the refrigerator 1 may be three-dimensionally viewed as a whole.

Also, a bent plate part 514 that is bent backward may be disposed on a peripheral surface of the plate opening 511. The bent plate part 514 may be disposed along a circumference of the plate opening 511 and extend by a predetermined length so as to be inserted into and fixed to a support frame 70 that will be described below. Thus, the plate opening 511 may be defined by the bent plate part 514.

The door liner 56 defines the rear surface of the sub-door 50 and has a door liner opening 561 in the area on which the transparent panel assembly 60 is disposed. Also, a sub gasket 503 for sealing a gap between the sub-door 50 and the main door 40 may be mounted on the rear surface of the door liner 56.

Also, a door light 57 may be provided on each of both sides of the door liner opening 561. The door light 57 may illuminate the rear surface of the sub-door 50 and a rear side of the transparent panel assembly 60.

Thus, the door light 57 may illuminate an inner space of the accommodation case 43, i.e., the inside of the door-side storage space 41 by the door light 57, and simultaneously, serve as an auxiliary backlight function of the transparent panel assembly 60 to more clearly output a screen of the transparent panel assembly 60. When the door light 57 is turned on, the inside of the door-side storage space 41 may be brightened up, and thus, the interior of the refrigerator 1 may be more brightened up than the outside of the refrigerator 1 so that a rear space of the sub-door 50 may be visualized through the transparent panel assembly 60. Here, the interior light 121 within the refrigerating compartment 12 may be turned on together. In this case, the door-side storage space 41 may be more brightened up so that the inside of the door-side storage space 41 is more clearly seen through the see-through part 80.

The door light 57 may be disposed on both sides of the transparent panel assembly 60 in directions facing each other. The door light 57 may be disposed at various positions such as the upper end or the upper and lower ends of the main door 40 as well as the both left and right sides of the main door 40 as long as the door light 57 provides sufficient brightness to the rear side of the sub-door 50.

The door light 57 may be disposed on both left and right ends each of which has a length greater than that of the upper and lower ends of the transparent panel assembly 60. Thus, the number of LEDs constituting the door light 57 may increase to more brighten up the door storage space 41. Thus, the door light 57 may be disposed on each of both left and right ends.

The display light 68 may be disposed on each of the upper and lower ends of the transparent panel assembly 60. When the display light 68 is disposed on each of both the left and right ends of the transparent panel assembly 60, all the display light 68 and the door light 57 may be turned on to locally brighten up both the left and right ends, and the upper and lower ends may be relatively dark. Thus, it may be difficult to realize uniform brightness on the entire see-through part 80.

Thus, the display light 68 may be disposed along the upper and lower ends of the transparent panel assembly 60 to realize the uniform brightness on the entire see-through part 80. Also, when the see-through part 80 is viewed from the front, light may be emitted onto the left and light ends of the see-through part 80 by the door light 57, and light may be emitted onto the upper end lower ends of the see-through part 80 by the display light 68. Thus, the light may be emitted to the four sides of the see-through part 80 to realize the uniform brightness on the whole.

Alternatively, the door light 57 and the display light 68 may be variously combined with each other as long as the brightness that is enough to see the interior of the refrigerator 1 is secured, and the display 62 is seen to the outside.

All the door light 57 and the interior light 121 may be called lights. In some cases, only one of the door light 57 and the interior light 121 may be provided. Also, the door light 57 is not necessarily disposed on the door. The door light 57 may be provided inside the cabinet 10 to emit light to the refrigerating compartment door 20 to brighten the rear side of the see-through part 80.

The door light 57 may not be limited in position as long as the door light 157 is disposed further forward than the interior light 121. For example, the door light 57 may be disposed at various positions at which the rear space of the see-through part 80, i.e., the door storage space 41 is brightened up.

For example, the door light 57 is disposed on an inner end of the cabinet 10. When the refrigerating compartment door 20 is closed, the door light 57 may be disposed above the door storage space 41. Also, when the door light 57 operates, the light may pass through a top surface of the accommodation case 43 to brighten the door storage space. As described above, the door light 57 may not be disposed in the refrigerating compartment door 20 but be disposed inside the cabinet 10.

Thus, the display light 68 may be called a second light 68, and the lights 57 and 121 may be called first lights 57 and 121. Here, the first lights 57 and 121 may refer to one or two of the door light 57 and the interior light 121.

When the first lights 57 and 121 refer to all the door light 57 and the interior light 121, the door light 57 may be disposed relatively closer to the refrigerating compartment door 20 to brighten the rear side of the refrigerating compartment door 20. Also, the interior light 121 may be disposed further away from the refrigerating compartment door 20 to brighten the interior of the refrigerator 1 and thus called an interior-side light 121.

Also, the opening device 59 may be mounted on the door liner 56. The opening device 59 may include a manipulation member 591 exposed to the lower end of the sub-door 50, a load 592 extending from the manipulation member 591, and a locking member 593 protruding from the rear surface of the door liner 56. The user may manipulate the manipulation member 591 to allow the load 592 to move the locking member 593 so that the sub-door 50 is selectively restricted by the main door 40 and also to manipulate the opening and closing of the sub-door 50.

The upper cap decoration 54 may define a top surface of the sub-door 50 and be coupled to upper ends of the outer plate 51 and the door liner 56. The upper surface of the upper cap decoration 54 is opened so that a decoration opening 542 communicating with an upper space of the transparent panel assembly 60 is formed and is shielded by a decoration cover 543. Further, a printed circuit board (PCB) mounting part 543*a* is formed in the decoration cover 543, so that PCBs 602, 603, and 604 for operating electrical components inside the transparent panel assembly 60 and the sub-door 50 may be mounted on the PCB mounting part 543*a*. The PCBs 602, 603, and 604 may be configured in at least one module form and may be provided in a closed space on an upper side of the sub-door 50.

At this time, the space on the upper side of the sub-door 50 may be partitioned into front and rear spaces by an upper portion of the support frame 70, an insulator (see reference numeral 531*a* of FIG. 15) may be arranged in the front space, and the PCBs 602, 603, and 604 may be arranged in the rear space.

Figure 15:
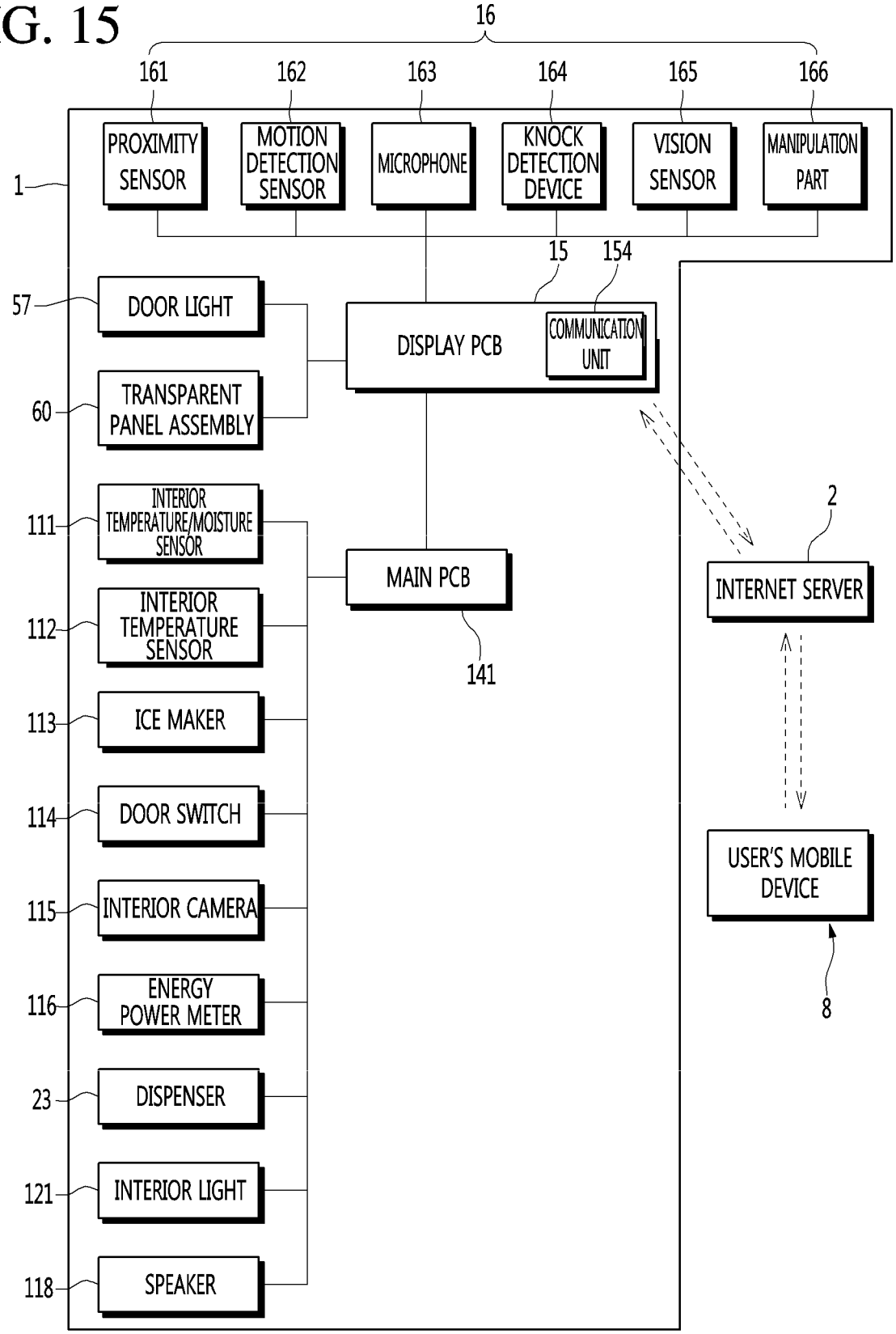
FIG. 15 is a block diagram illustrating a connection relationship between the main component of the refrigerator and a user's mobile device.

Referring to FIG. 15, the operation of the display 62 and the operations of the door lights 57 may be controlled by the PCBs 602, 603, and 604 such as the T-CON board 602 or the docking PCB 604 above the sub-door 50. Also, these PCBs 602, 603, and 604 may be arranged on the rear space of the sub-door 50, which is partitioned by the barrier 711 defining the upper end of the support frame 70. Also, the insulator 531*a* may be filled in a front space of the sub-door 50, which is partitioned by the barrier 711, and thus dew condensation may be prevented from being generated on an upper side of the front surface of the sub-door 50.

The lower cap deco 55 may define a bottom surface of the sub-door 50 and be coupled to lower ends of the outer plate 51 and the door liner 56.

The transparent panel assembly 60 may be disposed between the out plate 51 and the door liner 56. Also, the transparent panel assembly 60 may be configured to shield the plate opening 511 and the door liner opening 561. Further, the transparent panel assembly 60 may be selectively manipulated by the user in one of a transparent state, a translucent state, an opaque state, and a screen outputting state or in a state in which the transparent and opaque screens are outputted at the same time.

Thus, the user may selectively see the door-side storage space 41 through the transparent panel assembly 60 and also see the screen outputted through the transparent panel assembly 60. In addition, the screen outputted through the transparent panel assembly 60 may be seen, and the inside of the door-side storage space 41 may be seen, and the screen may be outputted.

The support frame 70 for supporting the transparent panel assembly 60 is mounted on a circumference of the plate opening 511 of the out plate 51. The transparent panel assembly 60 may be fixed and mounted on the outer plate 51 by the support frame 70. Particularly, a front surface of the outer plate 51 and the front surface of the transparent panel assembly 60 may be disposed on the same extension line so that the front surface of the sub-door 50 has a sense of unity.

A frame opening 701 is defined at a center of the support frame 70. The frame opening 701 has a size somewhat less than that of the plate opening 511 and has a structure in which the transparent panel assembly 60 is seated thereon. Also, the frame opening 701 may have a size less than that of the front panel 61 and greater than that of the rear panel 65. Thus, when the transparent panel assembly 60 is mounted, the rear panel 65 may successively pass through the plate opening 511 and the frame opening 701 and then be seated on the door liner 56.

Also, the support frame 70 may have a coupling structure with the outer plate 51. Here, the outer plate 51 and an end of the transparent display assembly 60 may be mounted to be closely attached to each other. Thus, when the sub-door 50 is viewed from the front side, an end of the outer plate 51 and a periphery of the transparent panel assembly 60 are in close contact with each other, so that a gap between the outer plate 51 and the transparent panel assembly 60 is rarely viewed or is viewed in a form of a line, and the outer appearance of the front surface may be viewed as having senses of continuity and unity.

Also, a heater 532 that heats a circumference of the transparent panel assembly 60 to prevent dew condensation from being generated on the front surface of the transparent panel assembly 60 may be disposed on a peripheral surface of the transparent panel assembly 60.

A bezel 611 shielding the coupled structure around the transparent panel assembly 60 so that predetermined light is not transmitted may be disposed around the transparent panel assembly 60. The bezel 611 may have a black color to completely shield the inside thereof and may have a predetermined width. Thus, an area inside the bezel 611 may be defined as the see-through part 80. Also, a portion of the support frame 70, which supports a circumference of the transparent panel assembly 60, may be disposed on the area of the bezel 611 and thus shielded so that the inside thereof is not seen from the outside.

Hereinafter, the structures of the transparent panel assembly and the support frame will be described in more detail.

Figure 7:
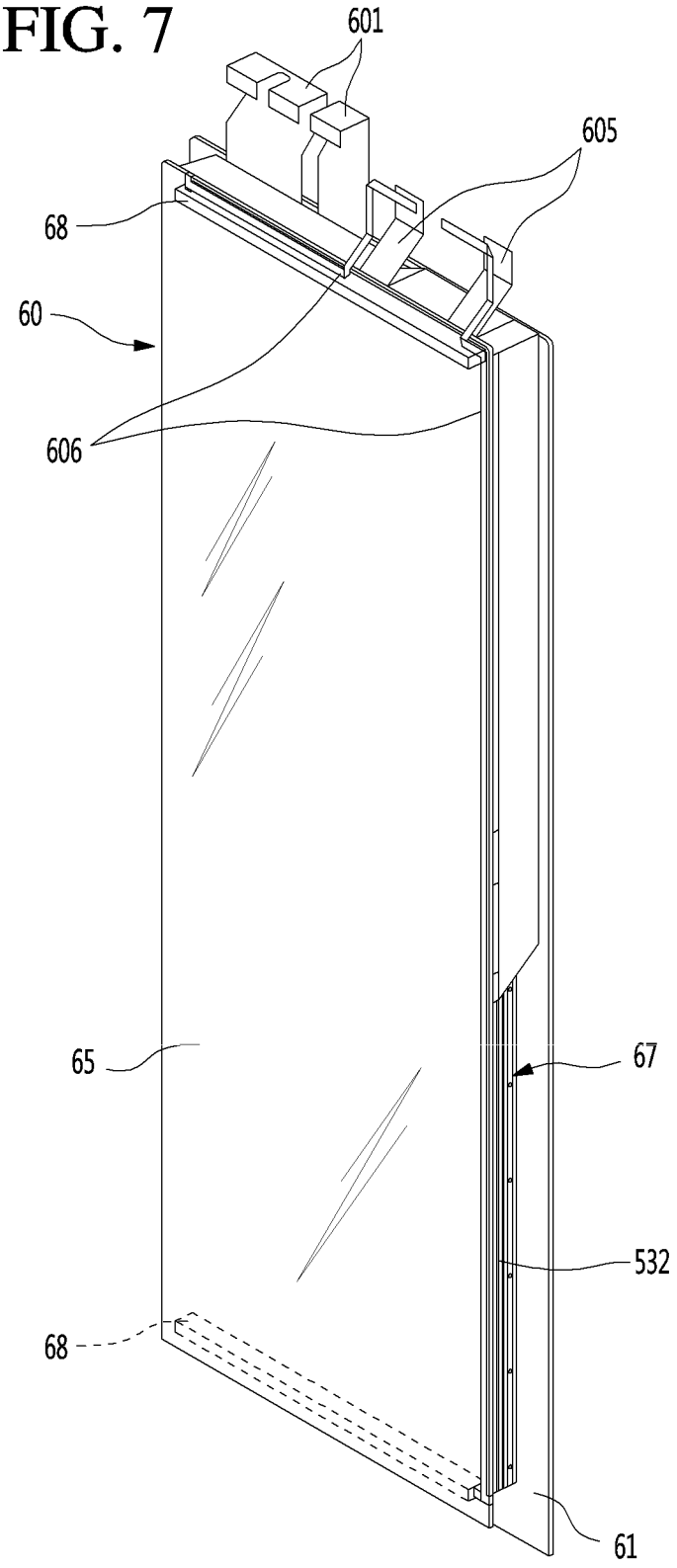
FIG. 7 is a perspective view of a transparent panel assembly according to an embodiment.
Figure 8:
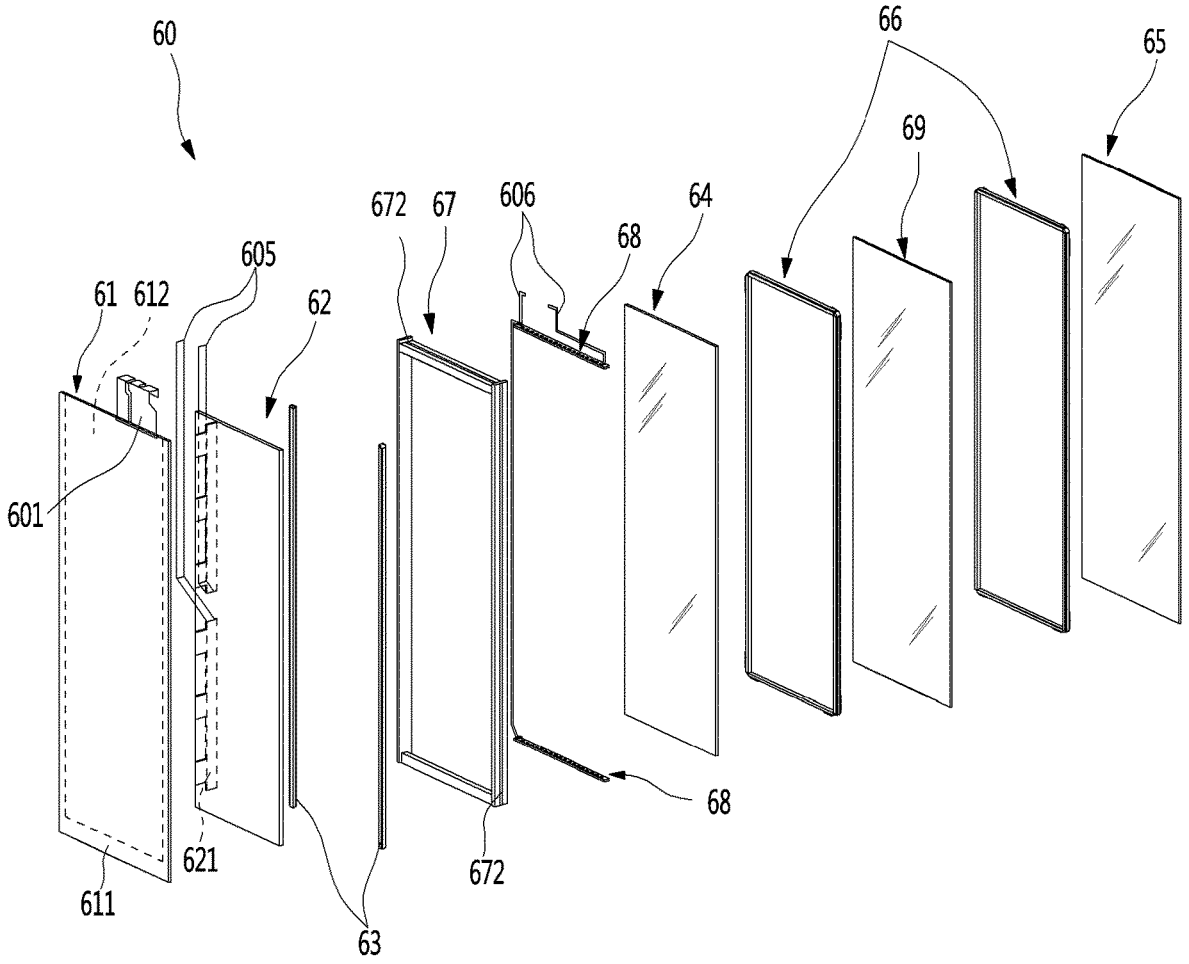
FIG. 8 is an exploded perspective view of the transparent panel assembly.
Figure 9:
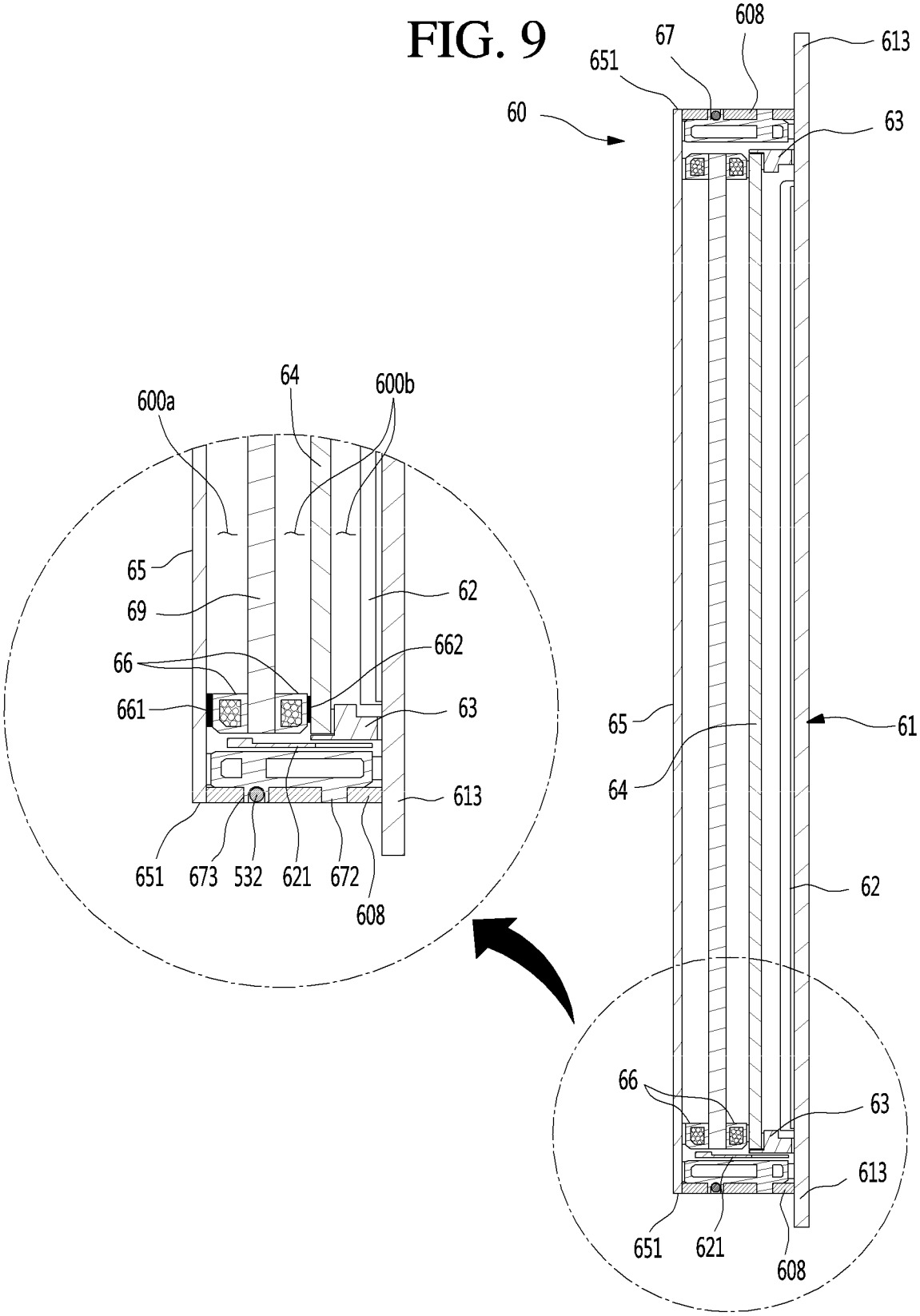
FIG. 9 is a cross-sectional view of the transparent panel assembly.

FIG. 7 is a perspective view of the transparent panel assembly according to an embodiment. Also, FIG. 8 is an exploded perspective view of the transparent panel assembly. Also, FIG. 9 is a cross-sectional view of the transparent panel assembly.

As illustrated in the drawings, the transparent panel assembly 60 may have a size that is enough to shield the plate opening 511 and the liner opening 561 inside the sub-door 50. Also, the see-through part 80 may be provided in the transparent display assembly 60 so that the inner space of the refrigerator is selectively seen, and a screen is outputted.

The transparent panel assembly 60 may have a plate shape and be constituted by a plurality of panels. The plurality of panels may be spaced apart from each other at predetermined intervals by at least one or more spacers. The transparent panel assembly 60 may be constituted by front and rear panels 61 and 65 defining at least front and rear surfaces and a spacer 67 connecting the front panel 61 to the rear panel 65. Also, an additional panel and a spacer may be further provided in an inner space defined by the spacer 67. Also, the inner space defined by the spacer 67 and the panels may be made to be in a vacuum state, or an adiabatic gas may be injected into the inner space to provide an insulation structure in the transparent panel assembly 60.

In more detail of the transparent panel assembly 60 with reference to the drawings, the transparent panel assembly 60 may have an outer appearance that is defined by the front panel 61 and the rear panel 65, which define the front and rear surfaces of the transparent panel assembly 60, and the outer spacer 67 connecting the front panel 61 to the rear panel 65.

Also, a display 62 and a light guide plate 64 may be disposed between the front panel 61 and the rear panel 65. In addition, a first spacer 63 for supporting the display 62 and the light guide plate 64 may be further provided, and a display light 68 for irradiating light to the light guide plate 64 may be provided.

The front panel 61 may be made of a transparent glass material (e.g., blue glass) that defines an outer appearance of the front surface of the transparent panel assembly 60. The front panel 61 may be made of a different material through which the inside of the front panel 61 is seen, and a touch input is enabled.

Also, a film or coating that is selectively transparent or opaque by allowing light to selectively pass therethrough according to the turn-off of the interior light or the door light 47 disposed on the sub-door 50 may be disposed on the rear surface of the front panel 61.

The front panel 61 may have a size corresponding to that of the plate opening 511 and may have a size greater than that of the frame opening 701. Thus, the periphery of the front panel 61 may be supported by the support frame 70. Also, in a state in which the transparent panel assembly 60 is mounted, an end of the front panel 61 may come in contact with an end of the plate opening 511, and a space may not be defined between the plate opening 511 and the front panel 61.

In detail, a front protrusion 613 that further protrudes outward than the rear panel 65 may be disposed on the front panel 61. Due to structural characteristics of the front protrusion 613 inserted into and mounted on the front side of the outer plate 51, the front protrusion 613 may further protrude from the rear panel 65 and the outer spacer 67 in upward/downward and left/right directions. Thus, the front panel 61 defining the front surface of the transparent panel assembly 60 may further extend to the outside of the frame opening 701 and thus may be stably supported by the support frame 70. The rear panel 65 as well as the outer spacer 67 may be inserted into the frame opening 701.

Also, the support frame 70 and the outer spacer 67 of the transparent panel assembly 60 may be fastened and coupled to each other through a separate coupling structure or coupling members 78 such as a screw. Thus, when the transparent panel assembly 60 is mounted, the front protrusion 613 may be supported by the support frame 70, and simultaneously, the support frame 70 may be coupled to the outer spacer 67 so that the heavy transparent panel assembly 60 is maintained in a stably fixed and mounted state even when the sub-door 50 is opened and closed.

A touch sensor 612 may be disposed on the rear surface of the front panel 61. The touch sensor 612 may be formed on the rear surface of the front panel 61 in a printing manner and be configured to detect user's touch manipulation of the front panel 61. Alternatively, the touch sensor 612 may be formed in various manners such as a film adhesion manner, rather than the printing manner, so that the user touches the front panel 61 to perform the touch input.

A touch cable 601 connected to the touch sensor 612 may be disposed on the upper end of the front panel 61. The touch cable 601 may be provided as a flexible film type cable such as a flexible flat cable (FFC) or a flexible print cable or flexible print circuit board (FPC). A printed circuit may be printed on the touch cable 601 to constitute at least a portion of a touch PCB 603. Also, the touch cable 601 may be connected to the touch PCB 603 provided above the sub-door 50.

The touch cable 601 may be connected to the touch sensor 612 to extend upward. Also, the touch cable 601 may be configured so that a wire is disposed on a base made of a resin material such as a film and may extend upward along the rear surface of the front panel 61. The touch cable 601 may be flexibly bent so that the touch cable 601 has a thin thickness and a wide width like a sheet.

Also, the touch cable 601 may be provided as a film type. Thus, when the touch cable 601 is connected to the touch PCB 603, an end of the touch cable 601 may be easily inserted into a connector of the touch PCB 603. For this, the touch cable 601 may be bent several times, and the end of the touch cable 601 may be directed to the connector of the touch PCB 603. Also, the touch cable 601 may be bent to be disposed along a well surface of an inner space of the sub-door 50 to provide an efficient arrangement in inner space of the sub-door 50.

Also, the display cable 605 and the display light cable 606 in addition to the touch cable 601 may have the same structure. As described above, the cables 601, 605, and 606, each of which has a flat cable shape, may extent to an upper end of the transparent panel assembly 60, and the cables 601, 605, and 606, each of which has the thin thickness and the wide width, may be efficiently disposed on the sub-door 50. In addition, a simple structure connected to the cables 601, 605, and 606 disposed in the upper portion of the sub-door 50 may be provided.

The display 62 may be disposed on the rear surface of the front panel 61. The display 62 may be provided as an LCD module for outputting a screen. Also, the display 62 may be transparent so that the user sees the inside through the display 62 when the screen is not outputted.

A source board 621 may be disposed on one end of both left and right sides of the display 62. The source board 621 may be configured to output a screen through the display 62 and connected to the display 62 and thus provided in an assembled state. Also, a portion of the source board 621 may also have a flexible film type cable structure.

Also, the source board 621 may have a width less than a thickness of the transparent panel assembly 60 and be bent while the transparent panel assembly 60 is assembled. Here, the source board 621 may be disposed between the outer spacer 67 and the first spacer 63 and may come in contact with an inner surface of the outer spacer 67 while being perpendicular to the front panel 61.

Also, the source board 621 may be connected to a display cable 605. The display cable 605 may be connected to a T-CON board 602 at an upper portion of the sub-door 50.

In detail, when the source board 621 is disposed on the rear surface of the display 62, the source board 621 may be exposed to the outside through the see-through part 80 due to the characteristics of the display 62 that is transparent. Also, when the source board 621 has a structure that protrudes laterally, the sub-door 50 may increase in size.

Thus, the source board 621 may be disposed on a peripheral end of the display 62 and may be provided between the outer spacer 67 and the first spacer 63. Also, the source board 621 may have a size corresponding to that of the outer spacer 67 without out of a region of the outer spacer 67 in a state of being closely attached to the outer spacer 67.

The source board 621 may be constituted by two upper and lower boards 621 and respectively connected to the pair of display cables 605. The display cable 605 may have a flexible and flat structure like the touch cable 601 and also have a structure that is freely bendable.

The display cable 605 may extend along the peripheral surface of the transparent panel assembly 60 and pass through a sealant 608 defining the peripheral surface of the transparent panel assembly 60 to extend to the outside of the transparent panel assembly 60.

Also, the display cable 605 may be bent to extend along the peripheral surface of the transparent panel assembly 60, i.e., be bent so that an end thereof extends upward from the transparent panel assembly 60. Thus, the display cable 605 may be coupled to the T-CON board 602 at the upper side of the sub-door 50.

Both ends of the display 62 may be supported by the first spacer 63. The first spacer 63 may have a rod shape extending from an upper end to a lower end of the display 62 and may be formed of aluminum.

The light guide plate 64 may be disposed at the rear of the display and disposed to be spaced a predetermined distance from the display 62 by the first spacer 63. Here, there may be a difference in depth feeling of the screen outputted from the display 62 according to the position of the light guide plate 64.

The light guide plate 64 may diffuse or scatter light emitted from the display light 68 and be made of various materials. For example, the light guide plate 64 may be made of a polymer material or formed by forming a pattern or attaching a film on a surface thereof. The light guide plate 64 may illuminate the display 62 from the rear side of the display 62 when the display light 68 is turned on. For this, the light guide plate 64 may have a plate shape having a size equal to or somewhat greater than that of the display 62. The display light 68 may be disposed at a position corresponding to each of upper and lower ends of the light guide plate 64.

Alternatively, the display 62 may be provided as a transparent panel that is capable of outputting other screens but provided as the LCD. For example, a display unit provided as an OLED panel instead of the display 62 may be provided. The display unit may have a more simplified structure because the light guide plate 64 and the display light 68 are not necessary.

In addition, the display 62 may have various structures that are capable of outputting the screen because the display 62 is transparent, unlike the LCD and OLED, to allow the user to see the interior of the refrigerator 1.

The rear panel 65 may be disposed at a rear side of the light guide plate 64. The rear panel 65 may define the rear surface of the transparent panel assembly 60 and have a size greater than that of the light guide plate and less than that of the front panel 61. Also, the rear panel 65 may have a size greater than that of the liner opening 561 to shield the liner opening 561.

A periphery of the rear panel 65 may further protrude outward from the outer spacer 67 to provide a rear panel protrusion 651. The rear panel protrusion 651 may have a protruding portion which is seated on the door liner 56 when the transparent panel assembly 60 is mounted and may define a space in which a sealant 608 applied to the periphery of the sub-door 50 is (608) filled.

The rear panel 65 may be made of low-ε glass to realize thermal insulation. As a result, the rear panel 65 may prevent heat of cool air within the refrigerator from being transferred to the outside through the transparent panel assembly 60.

A pair of second spacers 66 may be disposed between the rear panel 65 and the light guide plate 64. Each of the second spacers 66 may have a rectangular frame shape disposed along a periphery of the light guide plate 64 and come into contact with the light guide plate 64 and the rear panel 65 to maintain a predetermined distance between the light guide plate 64 and the rear panel 65. Also, a heat insulating glass 69 may be provided between the pair of second spacer 66. Multi-layered spaces 600*a* and 600*b* may be provided between the light guide plate 64 and the rear panel 65 by the heat insulating glass 69. Alternatively, a structure in which the light guide plate 64 and the rear panel 65 are fixed to each other by one second spacer 66 without the heat insulating glass 69 may be adopted as needed.

Although the spacers 63, 66, and 67 have structures different from each other in this embodiment, the spacers 63, 66, and 67 may maintain a distance between the adjacent panels 61 and 65 and the light guide plate 64 and have various shapes such as a rod shape or a shape in which the moisture absorbent is accommodated into a shape.

Also, the heat insulation panel 69 and the light guide plate 64 may be disposed between the front panel 61 and the rear panel 65. Here, the heat insulation panel 69 and the light guide plate 64 may be plate-shaped members disposed between the front panel 61 and the rear panel 65 and may be lonely provided or may be provided together and also may be called intermediate panels. The intermediate panel may be provided as only the light guide plate 64. In some cases, the intermediate panel may include one or more heat insulation panels 69.

The distance between the front panel 61 and the light guide plate 64 may be maintained in fixed distance so as to output the screen of the display 62. Also, the distance between the light guide plate 64 and the rear panel 65 may be determined according to a thickness of the sub-door 50 or the total thickness of the transparent panel assembly 60. That is, the second spacer 66 may be adjusted in thickness to determine the total thickness of the transparent panel assembly 60 so as to be mounted to match a specification of the sub-door 50.

In the state in which the rear panel 65 adheres to the second spacer 66, an outer end of the rear panel 65 may further extend outward from the second spacer 66. Also, the outer spacer 67 may be mounted on the outer end of the rear panel 65 so that the rear panel 65 and the front panel 61 are fixed to each other.

The outer spacer 67 may have a rectangular frame shape. The outer spacer 67 may connect the rear surface of the front panel 61 to the front surface of the rear panel 65 and also define the peripheral surface of the transparent panel assembly 60.

In detail, the outer spacer 67 may define a periphery of an outer portion of the transparent panel assembly 60 and also have a connection structure that is capable of allowing the front panel 61 to be maintained at a certain distance.

The space between the front panel 61 and the rear panel 65, i.e., the inner space of the outer spacer may be completely sealed by the coupling of the outer spacer 67. Also, the inside of the outer spacer 67 may be more sealed by the sealant 608 applied to the periphery of the outer spacer 67.

The display 62 and the light guide plate 64 may be spaced apart from each other in a front and rear direction within the inside of the space that is sealed by the outer spacer 67. The first and second spacers 63 and 66 for maintaining the distance of the light guide plate 64 may be also provided in the inner space of the outer spacer 67.

An additional insulation panel 69 may be further provided in the outer spacer 67, or a multilayered glass structure may be provided in the outer spacer 67. All of the above-described constituents may be provided in the space defined by the outer spacer 67.

That is, the overall outer appearance of the transparent panel assembly 60 may be defined by the front panel 61, the rear panel 65, and the outer spacer 67, and all of the remaining constituents may be provided in the outer spacer 67. Thus, the sealing may be performed only between the outer spacer 67, the front panel 61, and the rear panel 65 to completely seal the multilayered panel structure.

Particularly, even though a plate-shaped structure such as the light guide plate 64 is further provided in the outer spacer 67, when only the outer spacer 67 adheres to the front panel 61 and the rear panel 65, the sealed structure of the transparent panel assembly 60 may be achieved. The sealed structure may maintain a minimal sealing point even in the multilayered structure due to the plurality of panel including the light guide plate 64.

Thus, introduction of external air into the transparent panel assembly or the dew condensation in the transparent display assembly due to introduction of moisture may be minimized. Also, when the inside of the outer spacer 67 becomes in a vacuum state, or a gas for the thermal insulation is injected, the insulation layer may be provided in the whole multilayered structure within the transparent panel assembly 60 to more improve the thermal insulation performance.

The transparent panel assembly 60 may be disposed in the sub-door 50 so that the interior of the refrigerator is seen, and the screen is outputted, and also, the thermal insulation structure may be achieved in the multilayered panel structure at the minimum sealing point to secure the thermal insulation performance.

Also, a space in which the display light 68 is mounted may be provided in an inner surface of the outer spacer 67. The display light 68 may be mounted on each of the upper and lower ends of the outer spacer 67. The light guide plate 64 may be disposed between the display lights 68 disposed on the upper and lower ends of the outer spacer 67.

Thus, light emitted through the display light 68 may be directed to an end of the light guide plate 64 and then travel along the light guide plate 64 so that the entire surface of the light guide plate 64 emits light.

The display lights 68 disposed on the inner upper and lower ends of the transparent panel assembly 60 may be connected to a display light cable 606. The display light cable 606 may have a flexible and flat shape like the touch cable 601 and the display cable 605.

The display light cable 606 may be connected to the display light 68 that is mounted inside the outer spacer 67 to extend to the outside of the transparent panel assembly 60.

Also, the display light cable 606 may extend along the circumference of the transparent display 62 so that the display light cable 606 is not exposed through the transparent display 62. Also, the display light cable 606 may extend upward in a state of being closely attached to the rear surface of the rear panel 65. As occasion demands, the display light cable 606 may be bent in the state of adhering to the rear surface of the rear panel 65 and then may be connected to a docking PCB 604 disposed on the upper portion of the sub-door 50.

Here, since the display light cable 606 extends in the state of being closely attached to a peripheral surface of the rear panel protrusion 651 of the rear panel 65, when the sub-door 50 is viewed from the outside, the display light cable 606 may not be exposed through the transparent panel assembly 60.

The sealant 608 may be applied to the circumference of the outer spacer 67. The sealant 608 may be applied to form the peripheral surface of the transparent panel assembly 60. That is, the sealant 691 may form a peripheral surface between the front panel 61 and the rear panel 65.

The sealant 608 may seal the transparent panel assembly 60 to prevent air from being introduced into the transparent panel assembly 60 and be made of a polysulfide (that is called a thiokol) material. As occasion demands, the sealant 691 may be made of a different sealant material such as silicon or urethane so that the sealant 691 comes into direct contact with the foaming solution that is injected to mold the insulation material 531.

The sealant 608 may maintain the coupling of the outer spacer 67, the front panel 61, and the rear panel 65 and completely seal the connected portions of the components to prevent water or moisture from being introduced. Also, the sealant 608 may be a portion, which comes into directly contact with the foaming solution when the insulation material 531 is molded, and protects the periphery of the transparent panel assembly 60.

Also, the sealant 608 may allow cables 601, 605, and 606 connected to the touch sensor 612, the display panel 62, and the display light 68 within the transparent panel assembly 60 to be accessible therethrough. The sealant 608 may shield outer surfaces of the cables 601, 605, and 606 to prevent water or moisture from being introduced through spaces through which the cables 601 605, and 606 are accessible when the cables 601 605, and 606 extend through the peripheral surface of the transparent panel assembly 60.

Also, a spacer protrusion 672 defining a space into which the sealant 608 is filled and a heater mounting part 673 on which a heater 532 is mounted may protrude from the peripheral surface of the transparent panel assembly 60 coated with the sealant 608, and the sealant 608 may be filled into a space defined between the spacer protrusion 672 and the heater mounting part 673.

The inner space of the transparent panel assembly 60 may provide dual spaces in front and rear sides and in inside and outside. Particularly, the inner space of the transparent panel assembly 60 may include an insulation space 660*a* and an accommodation space 600*b*.

The insulation space 660*a* may be a closed space defined by coupling the rear panel 65, the heat insulation panel 69, and the second spacer 66 to each other and be defined by allowing the second spacer 66 to completely adhere to the rear panel 65 and the heat insulation panel 69 by using an adhesive 661. Also, a space between the rear panel 65 and the heat insulation panel 69 may provide the insulation space 660*a* or the insulation layer by injecting a vacuum or insulation gas. The insulation space 660*a* may be maintained in thermal insulation if the transparent panel assembly 60 is not broken. Also, the insulation space 660*a* may determine insulation performance of the transparent panel assembly 60.

The accommodation space 600*b* may be defined between the rear panel 65 and the light guide plate 64 and between the light guide plate 64 and the front panel 61. Also, the accommodation space 600*b* may be defined as a space between the inside of the outer spacer 67 and the outside of the insulation space 660*a*. The display 62 may be disposed in the accommodation space 600*b* and be disposed close to or to be closely attached to the front panel 61 within the accommodation space 600*b*.

The accommodation space 600*b* may be finally sealed by applying the sealant 608. However, it is difficult to completely seal the accommodation space 600*b* due to a plurality of cables 601, 605, and 606 that are accessible through the sealant 608. Thus, the accommodation space 600*b* may be relatively vulnerable to the insulation when compared with the insulation space 660*a*.

However, since the accommodation space 600*b* is defined in the front side that is previously insulated by the insulation space 660*a* provided in the refrigerator 1, and the sealed state of the accommodation space 600*b* is maintained, the insulation performance may be secured somewhat. Thus, the dual insulation space 660*a* may be provided.

The light guide plate 64 disposed in the accommodation space 600*b* may have a structure that is deformable by heat and a temperature, and a contact member 662 may be disposed between the second spacer 66 and the light guide plate 64. The contact member 662 has a predetermined thickness and elasticity, and the light guide plate 64 is seated and supported on the contact member 662 in the state in which the contact member 662 does not adhere to be fixed.

Thus, the light guide plate 64 may be contracted or expanded by the operation for a long time of the display light 68 or a temperature difference in the refrigerator 1. Here, a space in which the light guide plate 64 is contracted or expanded may be provided by the contact member 662.

As described above, the vacuum or the sealed structure may not be provided between the light guide plate 64 and the insulation panel 69 due to the contact member 662. Thus, the accommodation space 600*b* may be defined in the space in which the light guide plate 64 is disposed.

To complete the insulation space 660*a* and the accommodation space 600*b*, the transparent panel assembly 60 may have a structure having the dual spaces in which the outer spacer 67 is disposed outside, and the second spacer 66 is disposed in the space defined by the outer spacer 67.

Figure 10:
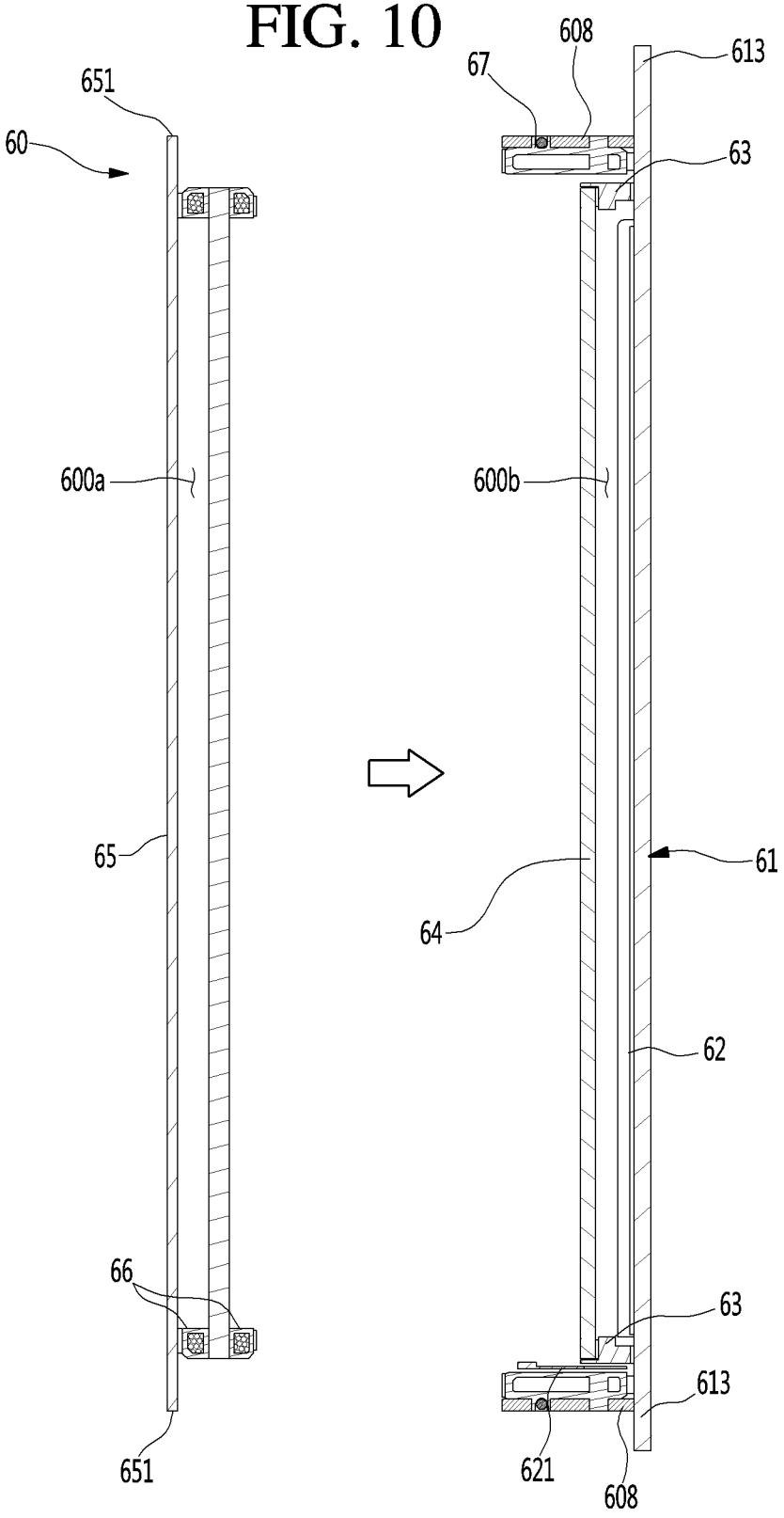
FIG. 10 is an exploded view illustrating an assembly structure of the transparent display assembly.

FIG. 10 is an exploded view illustrating an assembly structure of the transparent display assembly.

Referring to FIG. 10, to assembly the transparent panel assembly 60, the rear panel 65 and the insulation panel 69 may be closely attached to each other by using the second spacer 66 to provide the insulation space 660*a*. Here, the insulation space 660*a* may be filled with the vacuum or insulation gas. Also, an additional second spacer 66 may adhere to the other surface of the insulation panel 69 to support the light guide plate 64.

Also, the second spacer 66, the outer spacer 67, and the display 62 may be sequentially fixed and mounted on the front panel 61 to seat the light guide plate 64 on the first spacer 63. Here, although not shown, the arrangement of the display light 68 and the wire may be completed.

In this state, the assembly of the rear panel 65 and the insulation panel 69, which previously form the insulation space 660*a*, may be coupled to the assembly of the front panel 61. That is, the outer spacer 67 may adhere to an end of the rear panel 65 to complete the transparent panel assembly 60. Then, the sealant 608 may be applied to a circumference of the outer spacer 67 to perform sealing.

As described above, in the state in which the insulation space 660*a* is completed, the above-described components may be sequentially assembled to assemble the entire transparent panel assembly, and thus, the insulation performance of the transparent panel assembly 60 may be satisfied.

Figure 11:
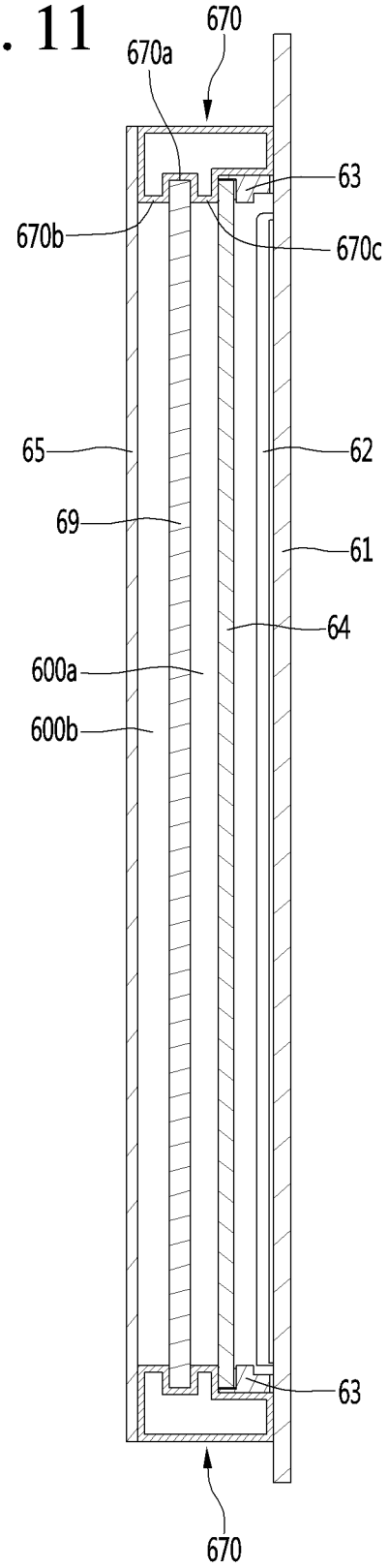
FIG. 11 is a cross-sectional view illustrating another example of the transparent display assembly.

FIG. 11 is a cross-sectional view illustrating another example of the transparent display assembly.

As illustrated in the drawing, the rear panel 65 is attached to the rear panel 65, and the insulation panel 69 is fixed and mounted on the inside of the outer spacer 670. In the state in which the rear panel 65 and the insulation panel 69 are mounted on the outer spacer 670, the insulation space 660*a* may be formed.

For this, a panel groove 670*a* into which the insulation panel 69 is inserted may be defined in an inner surface of the outer spacer 670. Also, a first panel protrusion 670*b* inserted between the rear panel 65 and the insulation panel 69 to maintain a distance between the rear panel 65 and the insulation panel 69 may be disposed on one side with respect to the panel groove 670*a*, and a second panel protrusion 670*c* inserted between the insulation panel 69 and the light guide plate 64 to maintain a distance between the insulation panel 69 and the light guide plate 64 may be disposed on the other side with respect to the panel groove 670*a*. Here, the second panel protrusion 670*c* and the light guide plate 64 may not adhere to each other but come into contact with each other, and the above-described contact member 662 may be disposed.

Also, the outer spacer 670 on which the rear panel 65 and the insulation panel 69 are assembled in the state in which the first spacer 63, the display, and the light guide plate 64 are sequentially seated may adhere to the rear surface of the front panel 61. Also, the sealant 608 may be applied to the circumference of the outer spacer 670.

Through the above-described structure, the transparent panel assembly 60 may have the structure in which the front panel 61, the rear panel 65, and the insulation panel 69 are fixed and mounted on one outer spacer 670 without using the second spacer 66 of FIG. 9. Also, the multi-layered spaces 600*a* and 600*b* may be provided in the transparent panel assembly 60 by using the single structure of the outer spacer 67.

As described above, although the transparent panel assembly 60 according to an embodiment is mounted on the refrigerating compartment door 20 in the state of being assembled, the transparent panel assembly may have a structure that is assembled to the frame of the door even though the transparent panel assembly 60 is not assembled.

Figure 12:
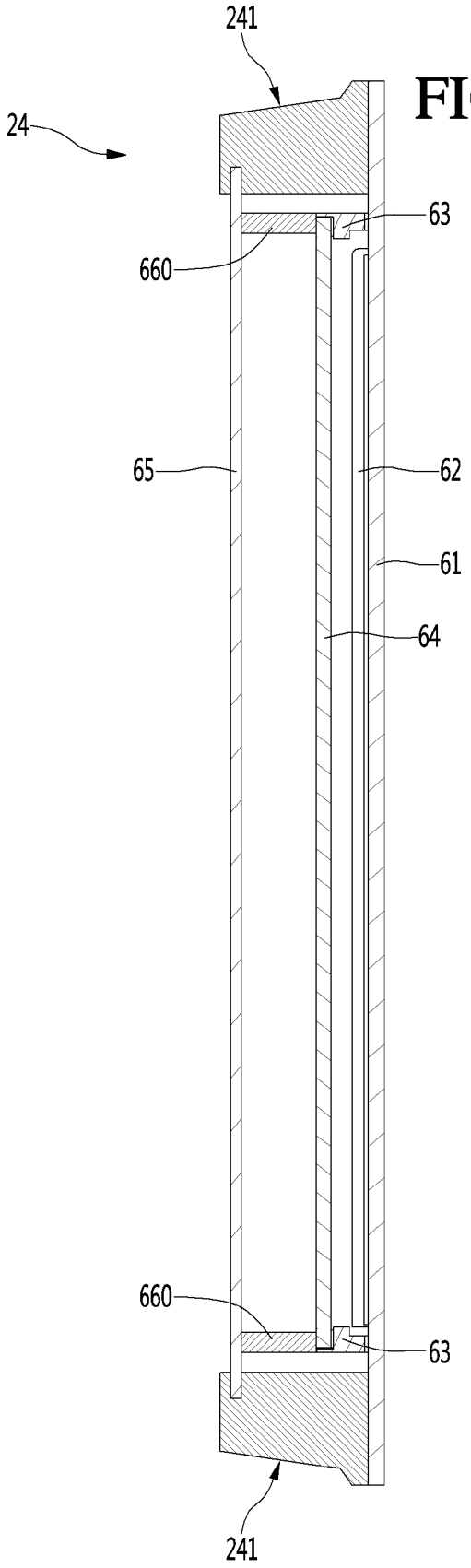
FIG. 12 is a cross-sectional view of a door according to another embodiment.
Figure 13:
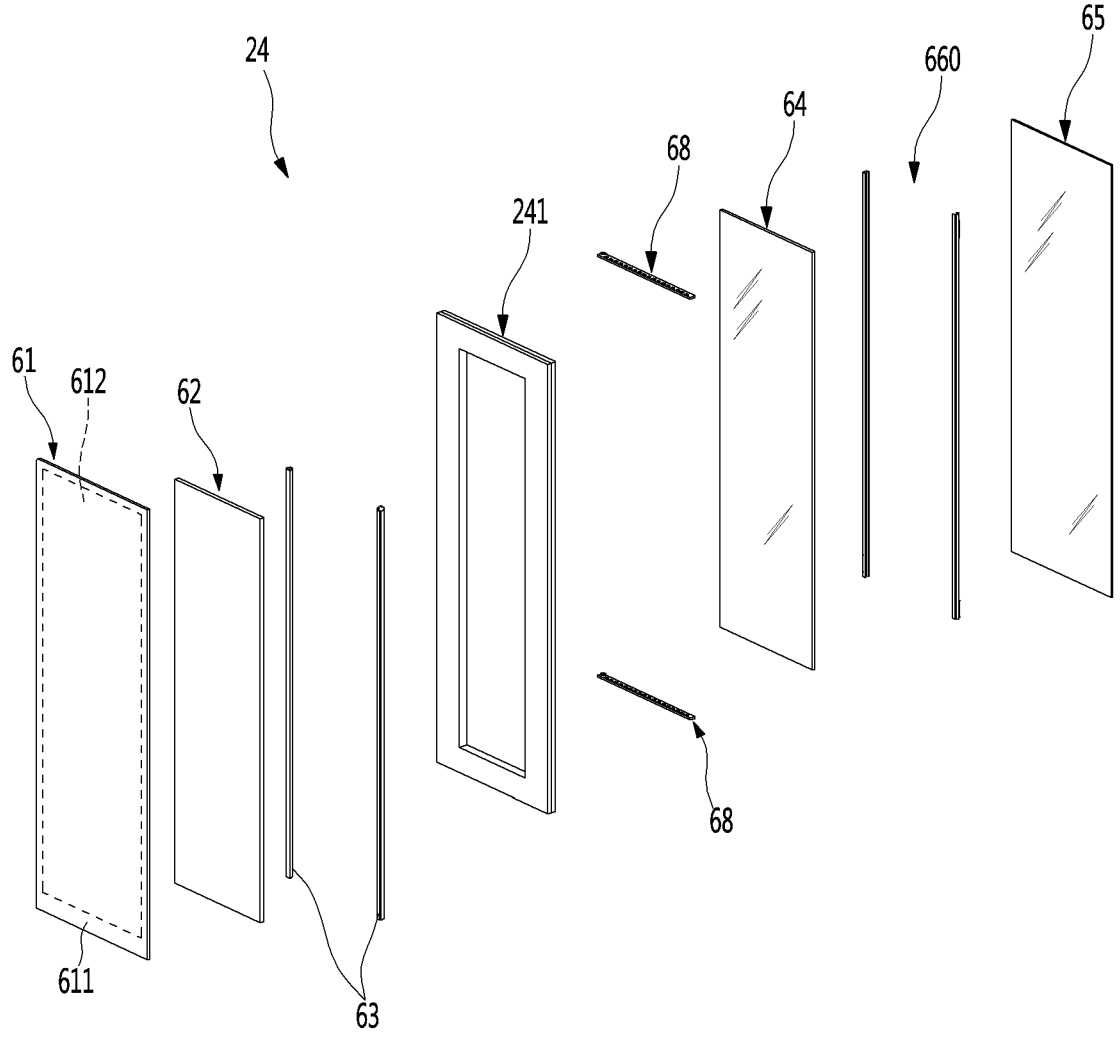
FIG. 13 is an exploded perspective view of the door.

FIG. 12 is a cross-sectional view of a door according to another embodiment. FIG. 13 is an exploded perspective view illustrating the door of FIG. 13.

As illustrated in the drawings, a door 24 according to another embodiment is configured to open and close the interior of the refrigerator 1 such as the refrigerating compartment door 20 according to the above-described embodiment. Also, an outer appearance of the door 24 may be defined by a door frame 241 having a rectangular frame shape with an opened central portion, a front panel 61 mounted on a front surface of the door frame 241, and a rear panel 65 mounted on a rear surface of the door frame 241.

The opened central portion of the door frame may provide a space through which the interior of the refrigerator 1 is seen like the above-described see-through part 80 and be configured to show a screen outputted by the display 62. For this, each of the front panel 61 and the rear panel 65 may be made of a transparent material.

The front panel 61 and the rear panel 65 may have the same configuration as those according to the above-described embodiment to define at least portions of front and rear surfaces of the door. The door frame 241 may define a circumference of the door 24 and simultaneously be fixed and mounted in a state in which the front panel 61 and the rear panel 65 are spaced apart from each other. An insulation material may be filled into the door frame 241 and have an outer surface made of a plastic material to define a portion of an outer appearance of each of side and rear surfaces of the door 24.

Also, in the state in which the front panel 61 and the rear panel 65 are mounted on the door frame 241, a closed space may be defined in the door 24, and a vacuum or insulation gas may be injected to define an insulation space.

A touch film 612 may be disposed on the rear surface of the front panel 61 to detect user's touch manipulation. Also, a display 62 may be disposed on the rear surface of the front panel 61. The display 62 may be closely attached to the rear surface of the front panel 61 and made of a transparent material to allow the user to see the interior of the refrigerator 1.

A light guide plate 64 may be disposed at a rear side of the display 62. The light guide plate 64 may be spaced apart from the front panel 61 by a first spacer 63 disposed on each of both sides thereof. Thus, the light guide plate 64 may be spaced to be spaced a predetermined distance from the display 62.

Also, the display light 68 may be mounted on an inner surface of the light guide plate 64. The light guide plate 64 may be entirely illuminated by light emitted from the display light 68 and serve as a backlight of the display 62.

A second spacer 600 may be disposed between the light guide plate 64 and the rear panel 65. The second spacer 660 may maintain a certain distance between the light guide plate 64 and the rear panel 65. In some cases, the second spacer may be made of a material having elasticity or have a structure having elasticity and stably support the light guide plate 64 even though the light guide plate 64 is contracted or expanded.

As described above, in the door 24 according to another embodiment, each of the front panel 61 and the rear panel 65 may be coupled to the door frame 241. The front panel 61 and the rear panel 65 may not be mounted on the door 24 in the state of being assembled with the transparent panel assembly 60 as described in the above-described embodiment, but each of the front panel 61 and the rear panel 65 is coupled to the door frame 241 to form the door 24.

Also, all the light guide plate 64 and the display light 68 may be disposed in the space defined by the front panel 61 and the rear panel 65.

Figure 14:
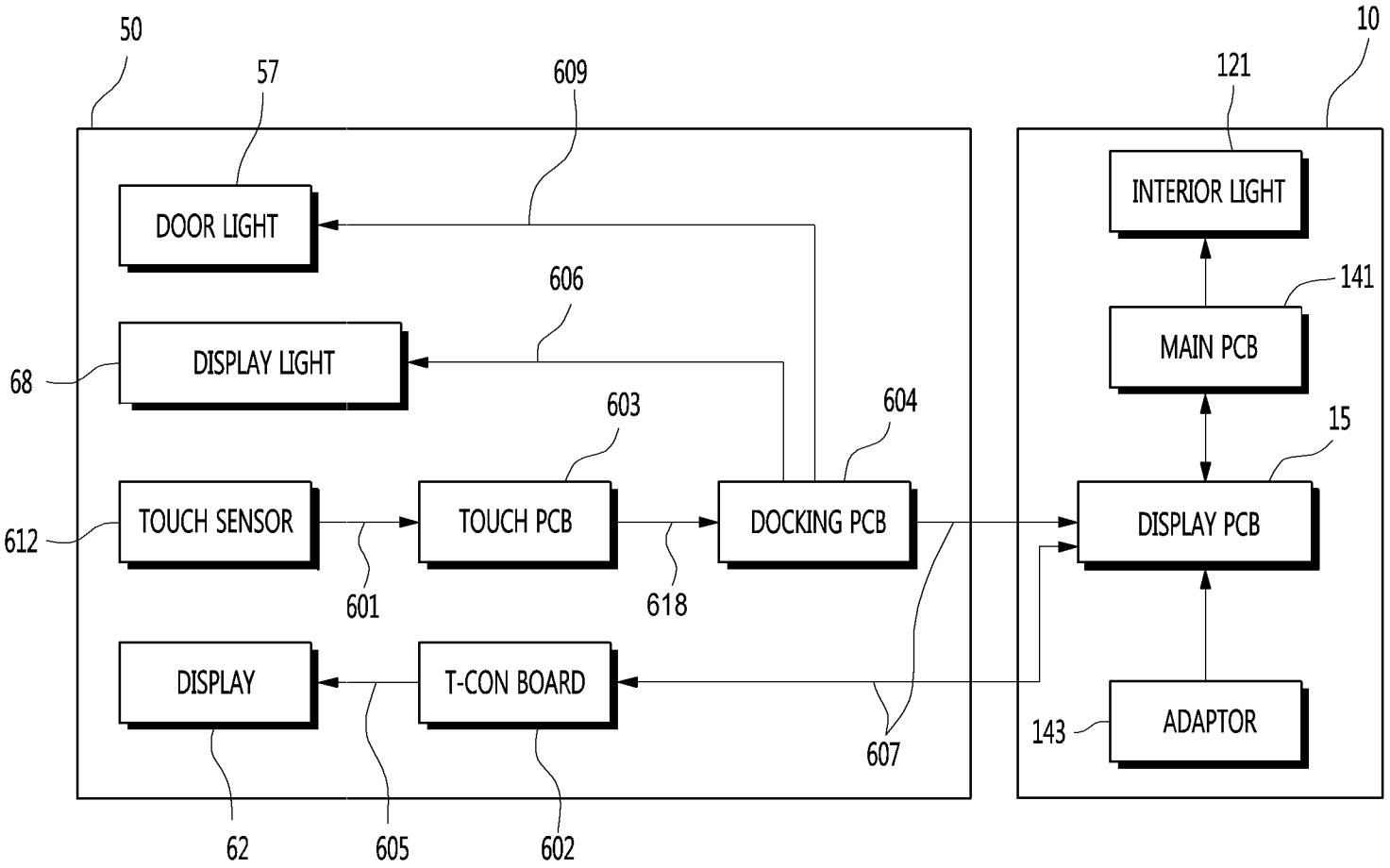
FIG. 14 is a schematic block diagram illustrating a flow of a control signal in components for an operation of the transparent panel assembly.

FIG. 14 is a schematic block diagram illustrating a flow of a control signal in components for an operation of the transparent panel assembly.

As illustrated in the drawing, a plurality of PCBs 602, 603, and 604, i.e., a touch PCB 603, a T-CON board 602, and a docking PCB 604 may be mounted on the sub-door 50.

Also, the plurality of PCBs 602, 603, and 604 may be connected to the plurality of cables 601, 605, and 606 within the sub-door 50.

The cables 601, 605, and 606 connecting the plurality of PCBs 602, 603, and 604 to each other may be provided as the flexible film type FFC or FPC. Thus, the touch cable 601, the display cable 605, and the display light cable 606 may occupy a large space within the sub-door 50 and be disposed to be closely attached to each other along the outside of the transparent panel assembly 60. Also, the connection structure with the PCBs 602, 603, and 604 may also be simply provided and may not be exposed to the outside through the see-through part 80. In addition, when the insulation material 531 is foamed to be molded in the sub-door 50, the PCBs 602, 603, and 604 may not interfere with the insulation material 531.

In more detail, the touch cable 601 may extend from an upper end of the touch sensor 612 and then be connected to the touch PCB 603. The touch PCB 603 may be disposed at a position corresponding to an extending end of the touch cable 601.

The display cable 605 may be connected to the source board 621 to extend upward. Then, the display cable 605 may extend along the circumference of the side surface of the transparent panel assembly 60 and then be connected to the T-CON board 602.

The display light cable 606 may be connected to the display light 68 disposed on each of the upper and lower portions of the transparent panel assembly 60 to extend upward along the outer circumference of the transparent panel assembly 60 and then be connected to the docking PCB 604.

The door light 57 may be provided as a separate part with respect to the transparent panel assembly 60 and mounted on the door liner 56. Thus, the door light cable 609 connected to the door light 57 may extend to the docking PCB 604 without passing through the transparent panel assembly 60 and be provided as a wire type cable. The door light cable 609 may also be provided as a flat and flexible cable like other cables 601, 605, and 606.

The docking PCB 604 may be connected to the touch PCB 603. The docking PCB 604 and the touch PCB 603 may be provided as separate parts. Thus, while the docking PCB 604 and the touch PCB 603 are assembled and mounted on the PCB mounding part 545, the docking PCB 604 and the touch PCB 603 may be connected to each other through a first docking cable 618. The first docking cable 618 may be connected to a PCB connector 604*d* disposed on the docking PCB 604. Also, as occasion demands, the T-CON board 602 may also be connected to the docking PCB 604.

Also, in consideration of efficiency of a voltage situation or signal transmission, the T-CON board 602 may not be connected to the docking PCB 604, but the wire type connection cable 607 may be directly connected to the control unit 14.

As described above, the plurality of electronic components disposed on the sub-door 50, i.e., all of the plurality of flat cables 601, 605, and 606 connected to the electronic components constituting the transparent panel assembly 60 may be connected to the PCBs 602, 603, and 604 in the upper portion of the sub-door 50, and the wire type connection cable 607 extending from the control unit 14 on the cabinet 10 may be simply connected to the docking PCB 604 and the T-CON board 602 to minimize the size of a hole through which the connection cable passes and also minimize the interference when the sub-door 50 is opened or closed.

A main PCB 141, a display PCB 15, and an adaptor 143 may be disposed in the control unit 14 connected by the connection cable 607.

The overall operation of the refrigerator 1 as well as a refrigerating cycle may be controlled by the main PCB 141. The main PCB 141 may be connected to the display PCB 15 to receive operation information of the transparent panel assembly 60.

Also, the adaptor 143 for converting power supplied to the transparent panel assembly 60 may be further disposed on the control unit 14. DC power may be converted into AC power that is suitable for driving the transparent panel assembly 60 by the adaptor 143. Also, since the adaptor 143 has a relatively large size and generate large amount of heat, it may be more efficient when the adaptor 143 is disposed on the control unit 14 on the cabinet 10 rather than the sub-door 50.

The main PCB 141 and the display PCB 15 may be provided as a single body. Also, the main PCB 141 and the display PCB 15 may be collectively called a control unit 14. Alternatively, the control unit 14 may be referred to as one of the main PCB 141 and the display PCB 15.

FIG. 15 is a block diagram illustrating a connection relationship between the main component of the refrigerator and a user's mobile device.

As illustrated in the drawings, the display PCB 15 may include a communication unit 154 communicating with a remote Internet server 2 and be connected to the manipulation input unit 16. Also, the display PCB 15 may be connected to the main PCB 141.

Thus, the main components of the refrigerator 1, which are connected to the main PCB 141, may be controlled by manipulating the transparent panel assembly 60 or the manipulation input unit 16.

The manipulation input unit 16 that is manipulated for the operation of the transparent panel assembly 60 may include one or more of a proximity detection sensor 161, a motion detection sensor 162, a microphone 163, a knock detection device 164, a vision sensor 165, and a manipulation part 166.

In detail, the proximity detection sensor 161 may be disposed in the refrigerating compartment door 20 or the cabinet 10 to detect the user that is close to a position within a set distance with respect to the refrigerator 1. Also, as the user approaches the refrigerator, activation of the transparent panel assembly 60 or manipulation of an operation of the transparent panel assembly 60 may be performed. The proximity detection sensor 161 may be disposed in the refrigerating compartment door 20 in which the see-through part 80 is disposed so that user's intension in visualization of the see-through part 80 is accurately grasped.

The motion detection sensor 162 may be configured to detect movement of the user. The motion detection sensor 162 may detect the movement of the user when the user is disposed with a specific region or moves within the specific region. Also, as the movement of the user is detected, the activation of the transparent panel assembly 60 or the manipulation of an operation of the transparent panel assembly 60 may be performed.

The microphone 163 is configured to receive a user's voice. When the user speaks a specific word, an input of the microphone 163 may be activated. Also, the activation of the transparent panel assembly 60 or the manipulation of an operation of the transparent panel assembly 60 may be performed according to the voice inputted by the user.

The knock detection device 164 is configured to detect user's knock manipulation. The knock detection device 164 may be disposed at one side of the transparent panel assembly 60 or the refrigerating compartment door 20, at which the transparent panel assembly 60 is disposed. Also, when the user knocks the front surface of the transparent panel assembly 60, the knock detection device 164 may detect the user's knock to activate or manipulate the transparent panel assembly 60. Here, various inputs of the manipulation may be performed according to the number of times of knocks or a knock pattern of the transparent panel assembly 60.

The vision sensor 165 may include an image photographing device such as a camera and recognize the user by photographing the front of the refrigerator. The vision sensor 165 may recognize a specific user or a specific gesture of the user to activate or manipulate the transparent panel assembly 60. Here, various inputs of manipulation may be performed according to the recognized gesture of the user.

The manipulation part 166 may be configured so that the user directly touches or pushes the manipulation part 166. The manipulation part 166 may be provided separately from the transparent panel assembly 60. For example, the manipulation part 166 may be integrated with the dispenser 23 to activate or manipulate the transparent panel assembly 60 through the manipulation of the manipulation part 166.

Referring to the main components connected to the main PCB 141, the main PCB 141 may be connected to an external temperature/humidity sensor 111 for measuring a temperature and humidity outside the refrigerator 1 to confirm temperature and humidity information outside the refrigerator 1, thereby controlling an operation of the refrigerator 1.

Also, the main PCB 141 may be connected to an internal temperature sensor 112 for measuring a temperature inside the refrigerator 1 to confirm temperature information within the refrigerator, thereby controlling an operation of the refrigerator 1.

Also, the main PCB 141 may be connected to the ice maker 113 which makes and stores ices to control an operation of the ice maker 113.

Also, the main PCB 141 may be connected to a door switch 114 for detecting an opening/closing of the door 20 to confirm information with respect to whether the door 20 is opened or close and the number of opening/closing of the door 20.

Also, the main PCB 141 may be connected to an internal camera 115 for photographing the interior of the refrigerator 1 to confirm an accommodated state of foods within the refrigerator and information of accommodated objects. Also, the main PCB 141 may be connected to an energy power meter 116 for measuring power consumption to confirm information with respect to power consumption of the refrigerator 1.

Also, the main PCB 141 may be connected to a dispenser 23 to control an operation of the dispenser 23.

Also, the main PCB 141 may be connected to the interior light 121 to be turned on when the refrigerating compartment door 20 is opened. In addition, the main PCB 141 may operate to be associated with the interior light 121 when the transparent panel assembly 60 operates to adjust the transparency and the screen output state of the see-through part 80. That is, brightness and transparency of the door storage space 41 that is seen through the see-through part 80 may be adjusted.

Also, the main PCB 141 may be connected to the speaker 118 to output operation information of the refrigerator 1 or food information, which is stored in the refrigerator 1, or information required by the user through voice.

In addition, the main PCB 141 may be interlocked with various electronic devices provided in the refrigerator 1 in addition to the above-described components to control the operations of the components or confirm information with respect to the components.

The communication unit 154 may be connected to the Internet server 2 through wired/wireless communication. The Internet server 2 may confirm the operation state of the refrigerator 1 through the information transmitted from the main PCB 141 and check and control the operation state of the refrigerator by comparing the information to data in the Internet server 2. Also, the pieces of information of the Internet server 2 may be outputted through the transparent panel assembly 60 by using the communication unit 154 or outputted to the user's mobile device 8.

Also, the Internet server 2 may be connected to the user's mobile device 8 through wireless communication. The user's mobile device 8 may be various devices that are capable of outputting and inputting information through video and/or audio, such as a mobile phone, an exclusive terminal, and a wearable device. Also, the instruction for the operation of the refrigerator 1 as well as the operation information and state of the refrigerator 1 may be realized through the user's mobile device 8.

Also, the image information, voice information, an image, a text, and the like, which are stored in the Internet server 2 or the user's mobile device 8, may also be transmitted to the display PCB 15 through the communication unit 154 and outputted through the transparent panel assembly 60 and the speaker 118.

A usage example of the refrigerator 1, the Internet server 2, and the user's mobile device 8 will be described below.

First, the user may directly manipulate the transparent panel assembly 60, an input through the manipulation input unit 16, or manipulate through the user's mobile device 8 to control a temperature inside the refrigerator 1. Here, the information of the internal temperature sensor 112 may be used.

Also, after confirming the temperature/humidity information within the refrigerator 1 through the external temperature/humidity sensor 111, the temperature within the refrigerator 1 may be adjusted so that quick freezing or deodorization is performed to improve the storage state of the foods. Here, the quick freezing or the sterilization/deodorization may be performed by directly manipulating the transparent panel assembly 60, the input through the manipulation input unit 16, or the manipulation through the user's mobile device. Also, when the quick freezing or the sterilization/deodorization is finished, the finish of the operation may be notified through push by using the transparent panel assembly 60 or the user's mobile device 8.

Also, an execution time of the deforesting operation of the refrigerator 1 may be inputted by directly manipulating the transparent panel assembly 60, the input through the manipulation input unit 16, or the manipulation through the user's mobile device 8 so that a defrost delay operation is performed within a preset time.

Also, ingredients of a recipe, a cooking method, and the like are received from the Internet server 2 through the direct manipulation of the transparent panel assembly 60, the input through the manipulation input unit 16, or the manipulation through the user's mobile device 8 to output the received information through the transparent panel assembly 60.

Also, the information with respect to the opening/closing of the door 20 of the refrigerator 1 may be request through the direct manipulation of the transparent panel assembly 60, the input through the manipulation input unit 16, or the manipulation through the user's mobile device 8. As a result, the push alarm may occur when the door is opened for a preset time or more, or a time zone for reducing the energy consumption may be generated in addition to the guiding of the opened number or time of door to guide the above-described results through the transparent panel assembly 60 or the user's mobile device 8.

Also, the information of the foods accommodated in the refrigerator 1 may be requested through the direct manipulation of the transparent panel assembly 60, the input through the manipulation input unit 16, or the manipulation through the user's mobile device 8. Also, the video information photographed by the camera 115 in the refrigerator 1 may be provided to confirm the stored state of the foods or output an expiration date of the stored foods, which is set by the user, through the transparent panel assembly 60 and the user's mobile device 8. In addition, when the expiration date arrives, push alarm may be outputted.

Also, the operation information such as set states or usage numbers and periods of the ice maker 113 and the dispenser 23 may be outputted through the direct manipulation of the transparent panel assembly 60, the input through the manipulation input unit 16, or the manipulation through the user's mobile device 8 by using the transparent panel assembly 60 and the user's mobile device 8.

Also, an error when the refrigerator 1 operates may be diagnosed through the direct manipulation of the transparent panel assembly 60, the input through the manipulation input unit 16, or the manipulation through the user's mobile device 8, or the firmware may be updated, or program installed in the refrigerator 1 may be updated to the latest version to output the updated firmware or program through the transparent panel assembly 60 and the user's mobile device 8.

The refrigerator 1 may be a portion of the home network and may control operations of other home appliances constituting the home network through the refrigerator 1.

Figure 16:
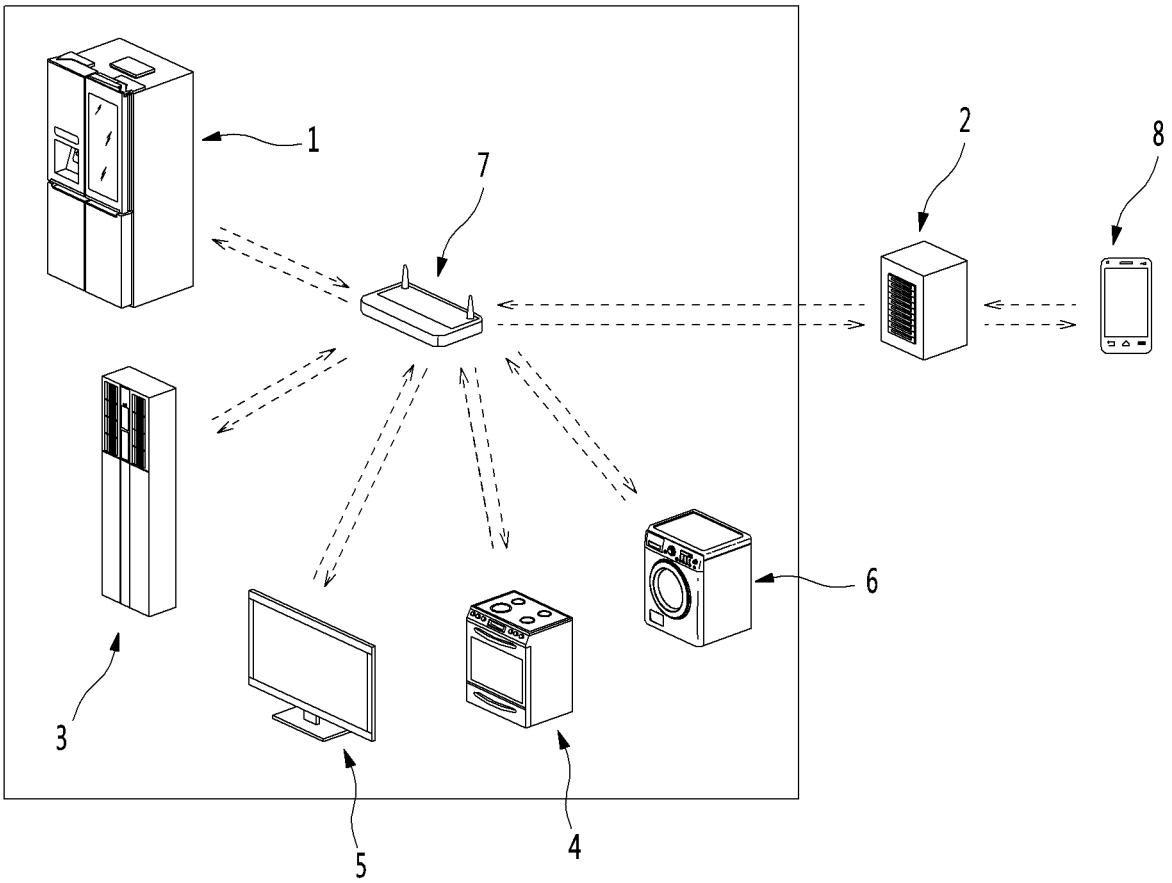
FIG. 16 is a view illustrating a home network system provided in the refrigerator.

FIG. 16 is a view illustrating a home network system provided in the refrigerator.

As described above, the refrigerator 1 may be connected to a wireless router 7 by the communication unit 154, and the wireless router 7 may be connected to home appliances such as an air conditioner 3, an oven 4, a television 5, a washing machine 6 to construct a whole home network system. Here, the refrigerator 1 may function as a main controller of the home network system in a state in which power is always supplied.

Also, the wireless router 7 may be connected to the Internet server 2, and the Internet server 2 may be connected to the user's mobile device 8 that is capable of outputting and inputting the information using the video and/or voice, such as a mobile phone, an exclusive terminal, a wearable device, and the like.

Thus, in order to allow the user to manipulate the operation of the home appliance, a manipulation signal may be generated through the manipulation of the transparent display assembly 60 of the refrigerator 1 or the input through the manipulation input unit 16 and then transmitted to the corresponding home appliance through the wireless router 7 so that the electronic device operates according to the corresponding manipulation. Also, the execution state of the corresponding operation may be outputted through the transparent display assembly 60 or the speaker 182.

A change in operation state of the home appliance may be stored in the Internet server 2 and transmitted and outputted to the user's mobile device 8 through the Internet server 2.

Alternatively, the user may control the operation of the home appliance through the user's mobile device 8. Here, the user's manipulation signal may drive the corresponding home appliance through the wireless router 7 via the Internet server 2 and output the corresponding information through the transparent display assembly 60 or the speaker 182 of the refrigerator 1.

That is, operation information of the hole appliances connected to wireless router 7 may be stored through the refrigerator 1, and the stored information and processed information may be outputted through the transparent panel assembly 60 or the speaker 182.

The wireless router 7 may communicate in a Wi-Fi manner, and a hub for converting the communication manner may be provided in the wireless router 7. The hub may be connected to the wireless router 7 in the Wi-Fi manner and receive signals in Bluetooth, Zigbee, Z-wave, and NEFF manners to communicate with other home appliances or other devices, which do not communicate in the Wi-Fi manner.

Thus, the hub may convert signals of the devices communicating in different manners to communicate with the wireless router 7 in the Wi-Fi manner, and vice versa. Thus, the information with respect to the manipulation of the devices through the refrigerator 1 and the hub and the operations of the devices may be outputted through the refrigerator 1.

For example, when other hole appliances operate, an output and control of an alert through the see-through part 80 of the refrigerator 1 when the alert situation occurs may be performed.

Figure 17:
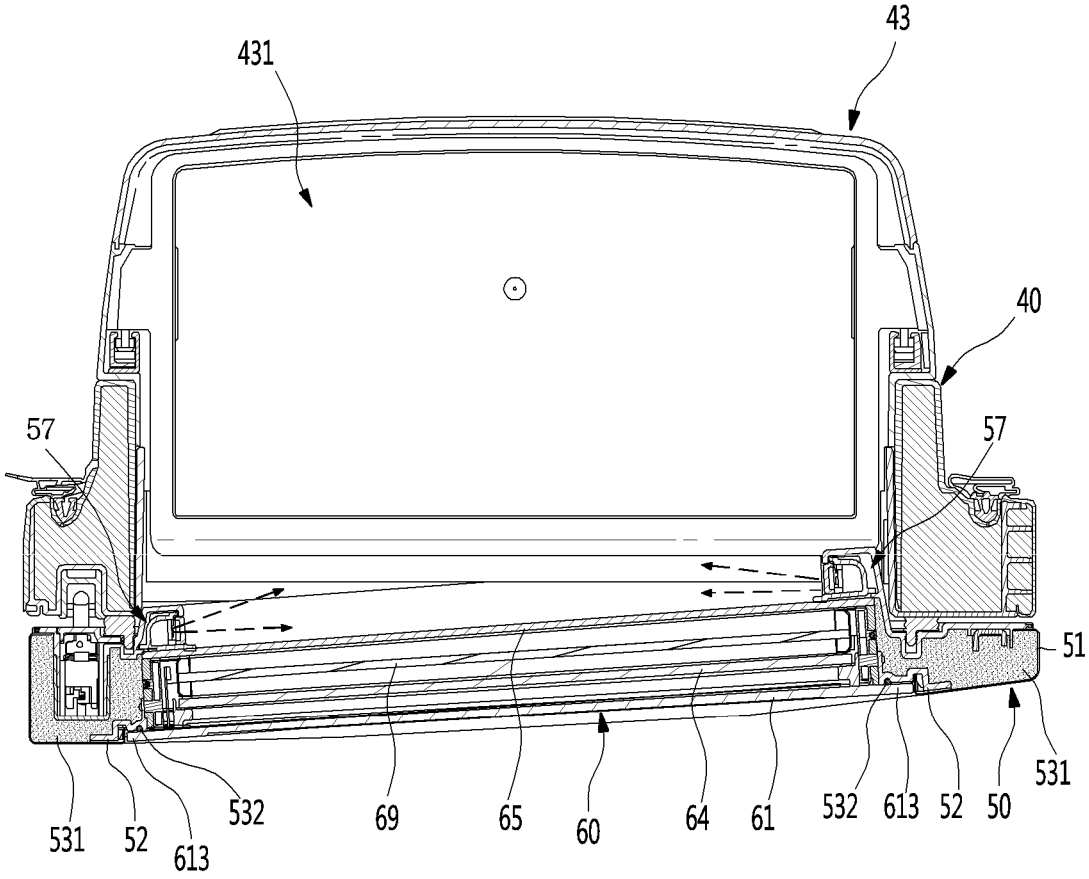
FIG. 17 is a transverse cross-sectional view illustrating a freezing compartment door of the refrigerator.
Figure 18:
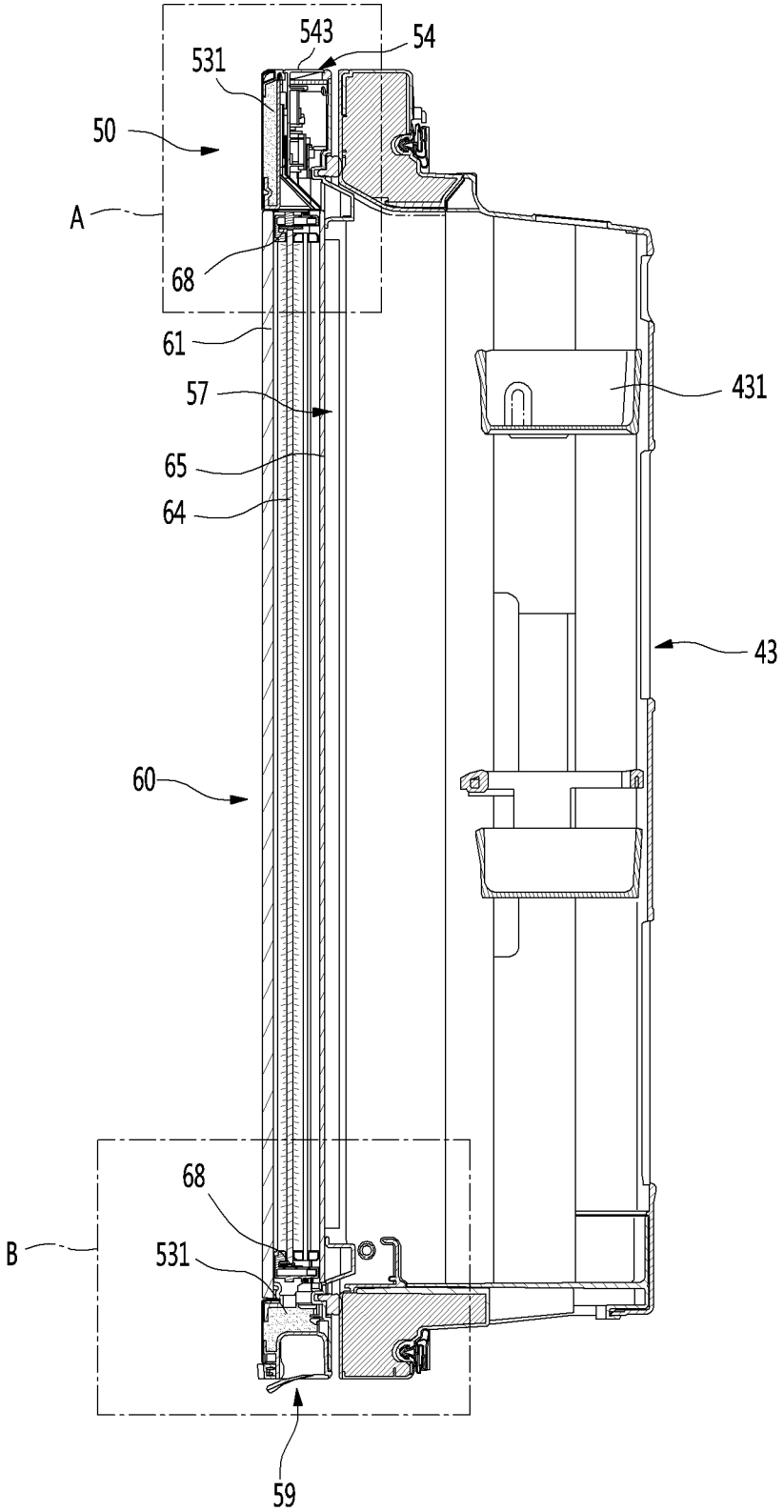
FIG. 18 is a longitudinal cross-sectional view of a refrigerating compartment door.
Figure 19:
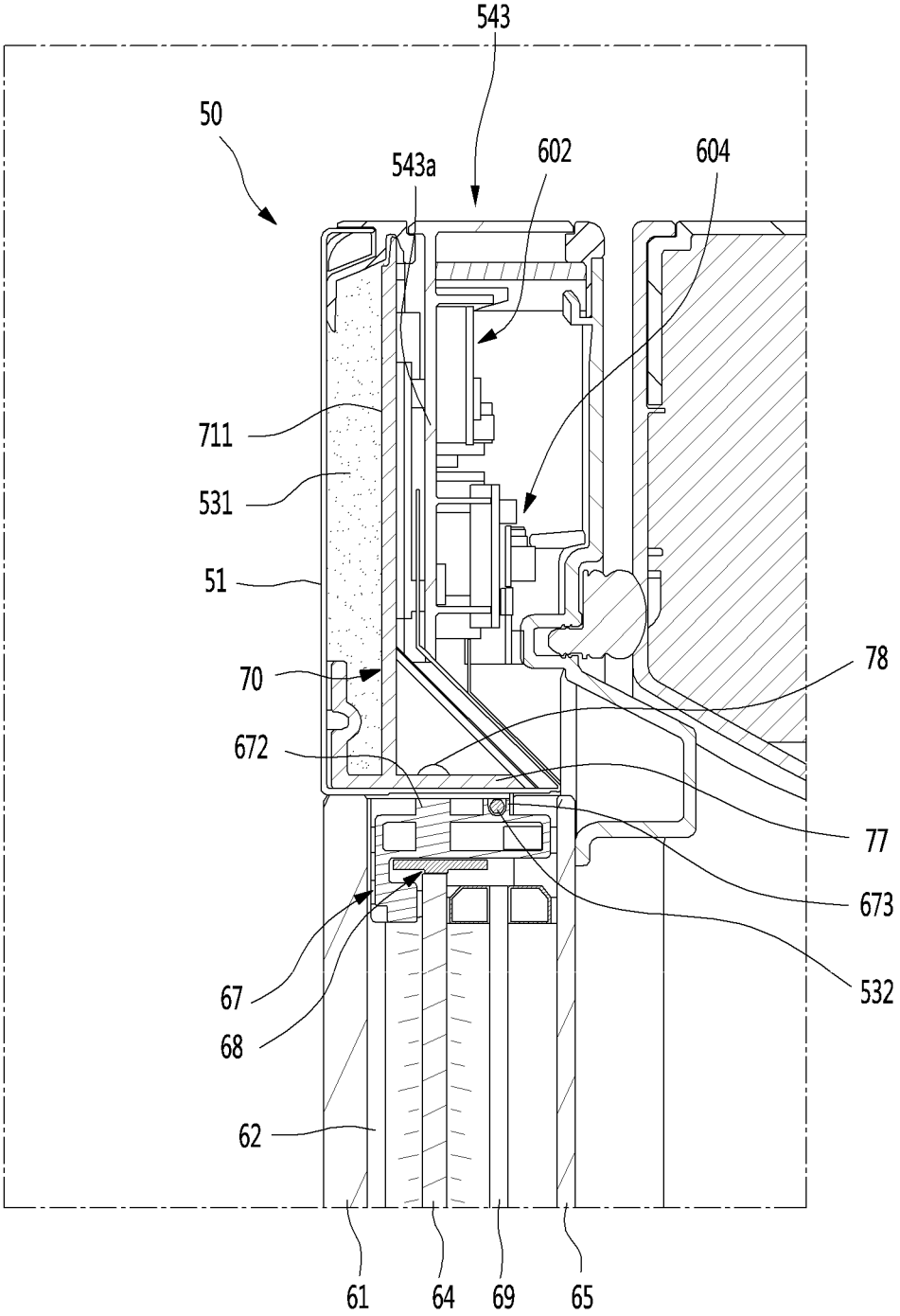
FIG. 19 is an enlarged view illustrating a portion A of FIG. 18.
Figure 20:
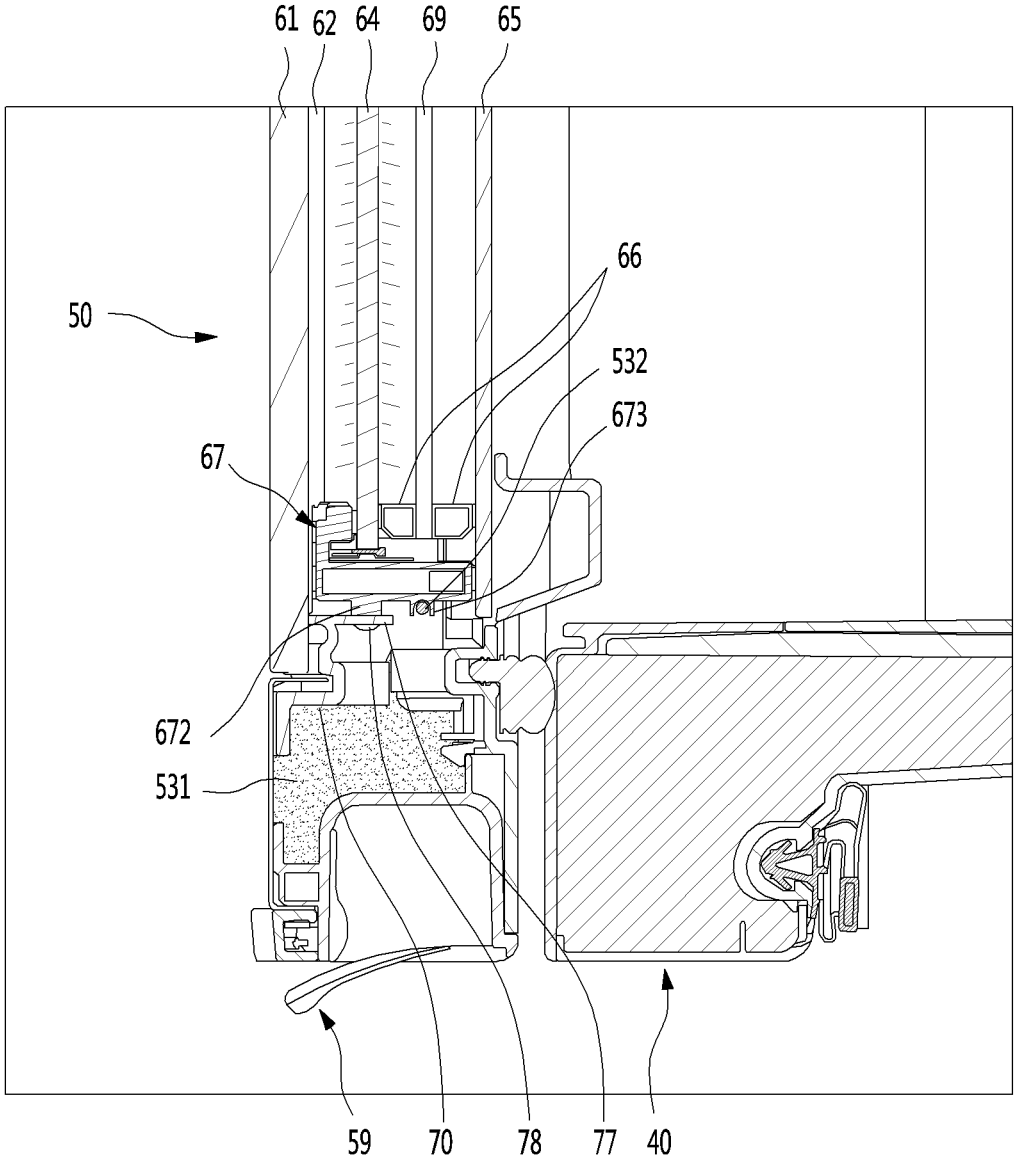
FIG. 20 is an enlarged view illustrating a portion B of FIG. 18.

FIG. 17 is a transverse cross-sectional view illustrating a freezing compartment door of the refrigerator. FIG. 18 is a longitudinal cross-sectional view of the refrigerating compartment door. Also, FIG. 19 is an enlarged view illustrating a portion A of FIG. 18. Also, FIG. 20 is an enlarged view illustrating a portion B of FIG. 18.

As illustrated in the drawings, in a state in which the locking member 593 of the opening device 59 is inserted into a latch hole 421, the sub-door 50 may be maintained in a closed state. In this state, the door light 57 may be maintained in a turn-off state. An opened or closed state of the sub-door 50 may be detected through a door switch that is separately provided.

In the turn-off state of the door light 57, as illustrated in FIG. 1, the rear space of the sub-door 50 may be dark, and thus, the interior of the refrigerator 1 may not be seen through the see-through part 80. Thus, in the closed state of the sub-door 50, if separate manipulation is not performed, the door light 57 may be maintained in the turn-off state, and the interior of the refrigerator 1 may not be seen through the see-through part 80.

In this state, the user may touch-manipulate the front panel 61 to turn on the door light 57. As illustrated in FIG. 17, when the door light 57 is turned on, light emitted from a lighting module 575 may be irradiated to positions of both rear left and right sides of the rear panel 65, which face each other.

The door light 57 may extend from the upper end to the lower end of the rear panel 65. That is, the light emitted by the door light 57 may illuminate the entire rear region of the rear panel 65 from both the left and right sides of the rear panel 65. Thus, the see-through part 80 may be transparent, and the door-side storage space 41 may be visualized through the see-through part 80.

Also, when the user manipulates the front panel 61 disposed on the front surface of the refrigerator 1, the display light 68 may be turned on to turn on the display 62. Thus, the transparent panel assembly 60 may output a screen. Here, the manipulation of the front panel 61 may be inputted as one of a specific position, the touch number, or a pattern. As occasion demands, a separate physical button or sensor may be used to detect the user's manipulation.

In detail, the display light 68 disposed on each of the upper and lower ends of the light guide plate 64 may be turned on together with the display 62 by the user's manipulation. The light guide plate 64 may irregularly reflect and diffuse light of the display light 68 by the turn-on of the display light 68 to emit light having generally uniform brightness to the front display 62.

Also, light may be emitted to the display 62 from the rear side of the display 62 by the light guide plate 64, and simultaneously, a screen based on inputted image information may be outputted on the display 62. Thus, the user may confirm the clearly outputted screen through the see-through part 80.

Also, in the state in which all the door light 57 and the display light 68 are turned on, the door-side storage space 41 may be seen, and also, the screen may be outputted through the display 62.

Hereinafter, a state of the see-through part will be defined with reference to the drawings.

FIGS. 21A to 21E are views illustrating a state of a see-through part according to an operation state of the transparent panel assembly. FIG. 22 is a table showing an operation state of the transparent panel assembly according to a state of the see-through part.

The see-through part 80 may be in one state of total five states of a first state 81, a second state 82, a third state 83, a fourth state 84, and a fifth state 85 according to operation states of the transparent panel assembly 60, the door light 57, and the interior light 121. Alternatively, in some cases, the see-through part 80 may include portions of the five states. The see-through part 80 may be in any one of the five states. Also, the see-through part 80 may be converted within the five states according to user's manipulation.

Figure 21A:
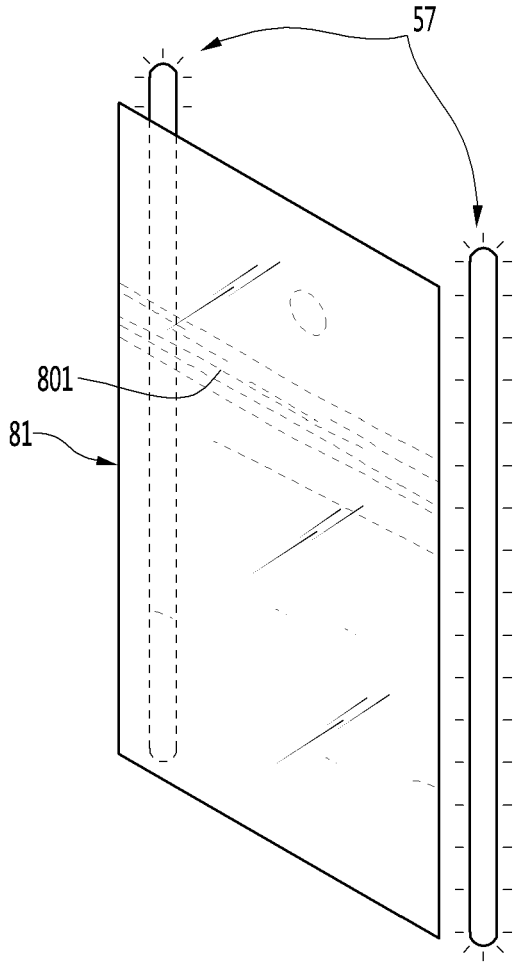
FIGS. 21A to 21E are views illustrating a state of a see-through part according to an operation state of the transparent panel assembly.

In detail, the first state 81 of FIG. 21A may be a state in which the transparency of the see-through part 80 is maximized so that the inside of the door storage space 41 is most clearly seen to the user, and thus, be referred to as a transparent state. Here, the see-through part 80 is called a first screen.

In the first state 81, the door light 57 may be turned on to brighten the door storage space 41, and thus, a rear side of the transparent panel assembly 60 may be brightened up. Thus, the see-through part 80 may be transparent when the see-through part 80 is viewed from the outside of the refrigerator 1. Also, in the first state 81, the interior light 121 may also be turned on. When the interior light 121 is turned on, the interior light 121 together with the door light 57 may also brighten the door storage space 41 to maximally brighten the door storage space 41. Thus, the door storage space 41 may be more clearly seen. The first state 81 may be selected to be used when the user identifies food within the door storage space 41.

Also, in the first state 81, the display light 68 may be turned off. When the display light is turned off, a difference in brightness between the front and rear sides of the transparent panel assembly 60 may be clearer, and thus, the inside of the door storage space 41 may be more clearly seen.

In the first state 81, when the display light 68 is turned off, although the display 62 is turned on, the display 62 does not emit light, and thus, only the door storage space 41 is brightened up. Thus, when the user sees the see-through part 80, the see-through part 80 is transparent, and the inside of the door storage space 41 is clearly seen.

In FIG. 21A, for helping comprehension, although an image 801 is displayed on the entire area, the display 62 is turned in the first state 81, and the image 801 is not outputted on the most area of the see-through part 80. As illustrated in FIG. 41, only a main menu icon 802, a brightness adjustment icon 805, and a clear icon 806, which are outputted on a lower end of the see-through part 80, may be outputted. Particularly, in the state in which the display light 68 is turned on, although the display 62 is turned on, the other area except for the main menu icon 802, the brightness adjustment icon 805, and the clear icon 806 may output an empty screen and thus may not affect the transparency of the see-through part 80. Also, in an embodiment, the image 801 is not limited to a picture, a photograph, and the like, and includes an image, a text, and the like, which is capable of being displayed through the display 62 as well as the photograph.

Alternatively, as illustrated in the drawings, the output of the image 801 may be outputted on the screen in even the first state 81. Also, since the display light 68 is turned off, the image 801 on the output screen may be unclear when compared with that in the second state 82. Thus, in the first state, information of food may be supplementarily displayed through the image 801 in the state in which the confirmation of the food stored in the door storage space 41 is main.

Also, if the operation of the transparent panel assembly 60 is capable of being manipulated by the manipulation input unit 16, the display light 68 and the display 62 may be turned off in the first state 81, and thus, the main menu icon 802 may not be outputted.

In an embodiment, it is not limited that the door light 57 is disposed in the refrigerating compartment door 20. For example, the door light 57 may be disposed in the refrigerator 1.

Also, when one light 57 or 121 of the door light 57 and the interior light 121 is provided, the display 62 may be turned on, the display light 68 may be turned off, and the lights 57 and 121 may be turned on in the first state 81. In the second state, all the display 62, the display light 68, and the lights 57 and 121 may be turned on. Also, in the third state 83, the display 62 and the display light 68 may be turned on, and the lights 57 and 121 may be turned off. Also, in the fourth state 84, the display 62 may be turned on, the display light 68 may be turned off, and the lights 57 and 121 may be turned on. Also, in the fifth state, all the display 62, the display light 68, and the lights 57 and 121 may be turned off.

Figure 21B:
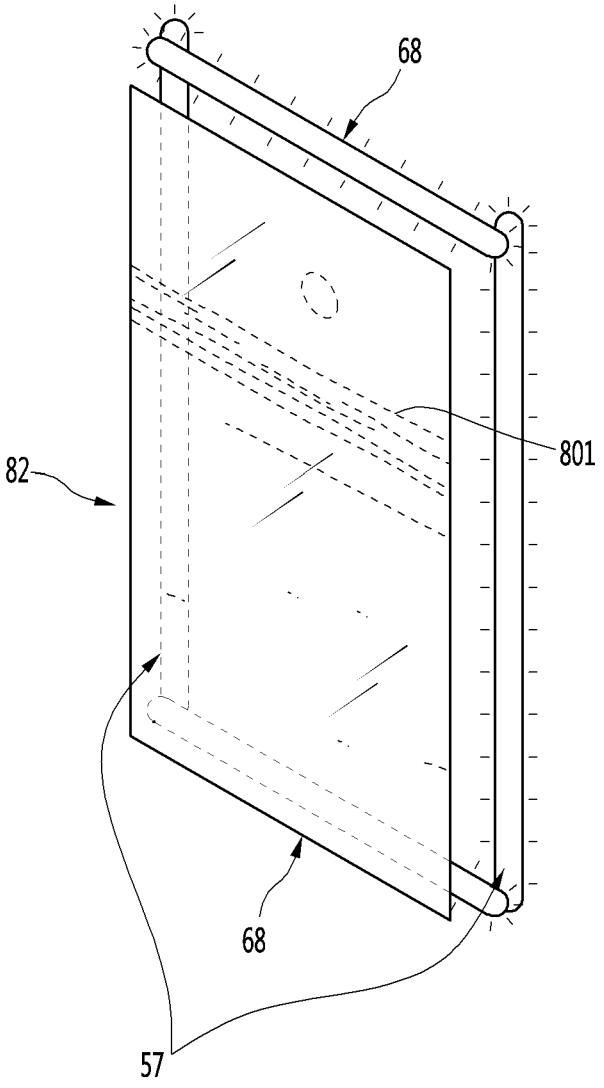

In the second state 82 of FIG. 21B, the inside of the door storage space 41 may be seen to the user, and the image 801 may be outputted on the screen. Thus, the see-through part 80 may have a transparency less than that in the first state 81, and the image 801 may have a transparency greater than that in the second state 82. As described above, the second state 82 may be a semi-transparent state. Here, the see-through part 80 may be called a second screen.

In the second state 82, the door light 57 may be turned on to brighten the door storage space 41, and thus, the rear side of the transparent panel assembly 60 may be brightened up. Thus, when the see-through part 80 is viewed from the outside of the refrigerator 1, the inside of the door storage space 41 may be seen.

Also, in the second state 82, the interior light 121 may be turned off. In the second state 82, when the door storage space 41, i.e., the rear side of the transparent panel assembly 60 is excessively brightened up, the image 801 outputted on the display 62 may not be well identified. The interior light 121 may be turned on if it intends that the image 801 to be outputted is seen to be recognizable or to more clearly show the door storage space 41.

Also, in the second state 82, the display light 68 may be turned on, and the display 62 may also be turned on. When the display light 68 and the display 62 are turned on, information outputted through the transparent panel assembly 60, i.e., the image 801 may be seen to the user. That is, in the second state 82, the inside of the door storage space 41 may be confirmed, and simultaneously, the image 801 outputted through the display 62 may be confirmed.

In the second state 82, the image 801 outputted through the display 62 may not be well seen when compared with that in the first state 81. Thus, the user may preferentially recognize the screen outputted through the see-through part 80 rather than the confirmation of the food, which is seen through the door storage space 41. That is, the second state 82 may be selected to be used when the user outputs the screen through the see-through part 80 and schematically confirms food within the door storage space 41.

A difference between the first state 81 and the second state 82, which are seen through the see-through part 80, may include a difference between the brightness within the door storage space 41 and the transparency of the see-through part 80 and a difference in transparency of the image outputted through the display 62. Thus, the first and second states 81 and 82 may be selectively utilized.

Figure 21C:
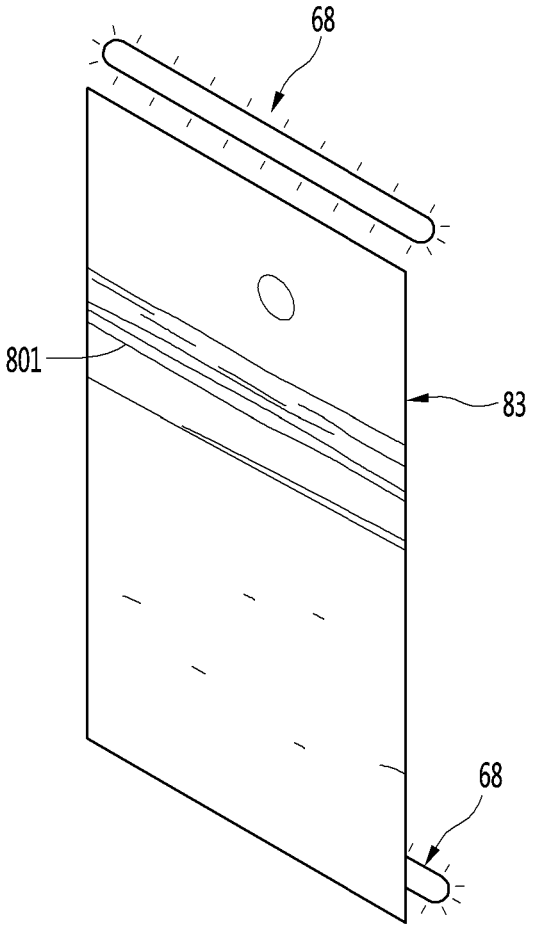

In the third state 83 of FIG. 21C, an image 801 may be outputted to transmit information to the user through the see-through part 80. In the third state, since the see-through part is in an opaque state, the inside of the door storage space is almost invisible unless it is in a very close position. As described above, the second state 82 may be in the opaque state. Here, the see-through part 80 may be called a third screen.

In the second state 82, the door light 57 may be turned off to get dark the door storage space 41. Thus, when the see-through part 80 is viewed from the outside of the refrigerator 1, the inside of the door storage space 41 may not be seen. Also, the interior light 121 may also be turned off, and thus, the door storage space 41 may not be well seen.

Also, in the third state 83, the display light 68 may be turned on, and the display 62 may also be turned on. When the display light 68 and the display 62 are turned on, information outputted through the transparent panel assembly 60, i.e., the image 801 may be seen to the user.

In the third state 83, since the door light and the interior light 121 are turned off, only the image 801 outputted through the display 62 may be seen through the see-through part 80. Here, the image 801 seen through the see-through part 80 may be in the clearest state when compared with those in the first state 81 and the second state 82. Also, the door storage space 41 may get dark, and the see-through part 80 may be in the opaquest state.

Figure 21D:
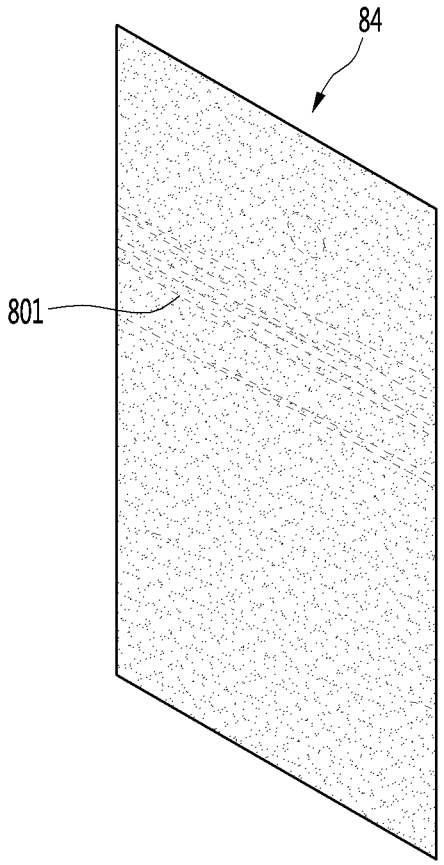

The fourth state of FIG. 21D may be a state which is a screen used to be limited when the right door 22 in which the see-through part 80 is provided is opened and in which, when the user opens the right door 22, information is capable of being transmitted while preventing the user from glaring. As described above, in the second state 82, the see-through part 80 may be called the second screen.

In the fourth state 84, when the right door 22 is opened in the state in which the screen is outputted through the display 62, the user may feel the glare by the door light 57 or the display light 68 of the right door 22. Thus, the door light 57 and the display light 68 may be turned off. Also, the information outputted through the display 62 may be maintained to allow the user to confirm the information through the display 62.

Here, minimum light that is enough to show the image 801 outputted through the display 62 may be provided through the turn-on of the interior light 121, and the interior light 121 may serve as a backlight of the display 62. Thus, the image 801 seen through the see-through part 80 may be in the most unclear state when compared with those in the first state 81, the second state 82, and the third state 83. Here, since the user approaches the refrigerator 1 to open the right door 22, it is difficult to acquire the information through the see-through part 80. This state may be most useful in a situation in which accommodating food while confirming the information outputted through the see-through part 80, for example, a situation in which the food is taken out while viewing recipe.

Figure 21E:
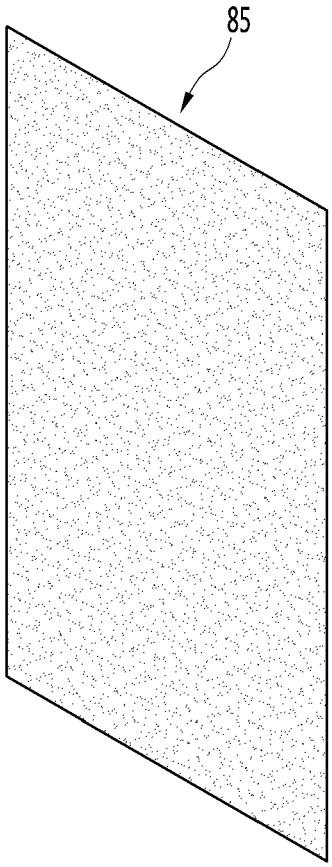

The fifth state 85 of FIG. 21E is in the opaquest state of the see-through part 80 when compared with the previous state. Here, all the interior light 121, the door light 57, the display light 68, and the display 62 are turned off. As described above, in the fifth state 85, the see-through part 80 may be called a fifth screen.

In the fifth state, the see-through part 80 is in the darkest state in the state in which the refrigerator 1 is not used. Thus, the output of the screen through the see-through part 80 and the viewing of the inside of the door storage space 41 are not performed. Also, in the fifth state 85, an area of the see-through part 80 is displayed with a black color, and thus, it is difficult to identify the interior of the refrigerator 1.

In the state in which the user does not the refrigerator 1, the see-through part 80 may generally operate to standby in the fifth state 85. When the user manipulates the manipulation input unit 16, the state may be converted into the first to fourth states 81 to 84.

The first state 81 and the second state 82 in which the interior of the refrigerator 1 is seen may be called a transparent state. Here, the transparent state means a state in which the interior of the refrigerator 1 is seen somewhat through the see-through part and also is not defined as only the completely transparent state.

In the first state 81 and the second state 82, the viewing and information of the interior of the refrigerator 1 may be enabled at the same time. That is, usability may be maximized, and thus, the first and second states may be called a see-through screen state or a "smart instaview" state.

Also, the fifth state in which the viewing of the interior of the refrigerator 1 is difficult may be called an opaque state. Here, the opaque state may mean a state in which the interior of the refrigerator 1 is not well seen when the see-through part 80 is viewed at a general use distance of the refrigerator 1 and also may not be defined as only the completely opaque state. That is, in the opaque state, when the user sees the see-through part 80, food accommodated in the door storage space 41 inside the refrigerator 1 is not well seen. Also, the opaque state may further include the third state 83.

The first state 81, the second state 82, the third state 83, and the fourth state 84, in which the screen is outputted through the see-through part 80, may be called an output state or a turn-on state. The fifth state in which the screen is not outputted through the see-through part 80 may be called a non-output state or a turn-off state.

In the first state 81 and the second state 82, the viewing and information of the interior of the refrigerator 1 may be enabled at the same time. That is, usability may be maximized, and thus, the first and second states may be called a see-through screen state or a "smart instaview" state.

Hereinafter, various examples of a process of converting the state of the see-through part 80 according to the situations or user's manipulation will be described with reference to the accompanying drawings.

Figure 23:
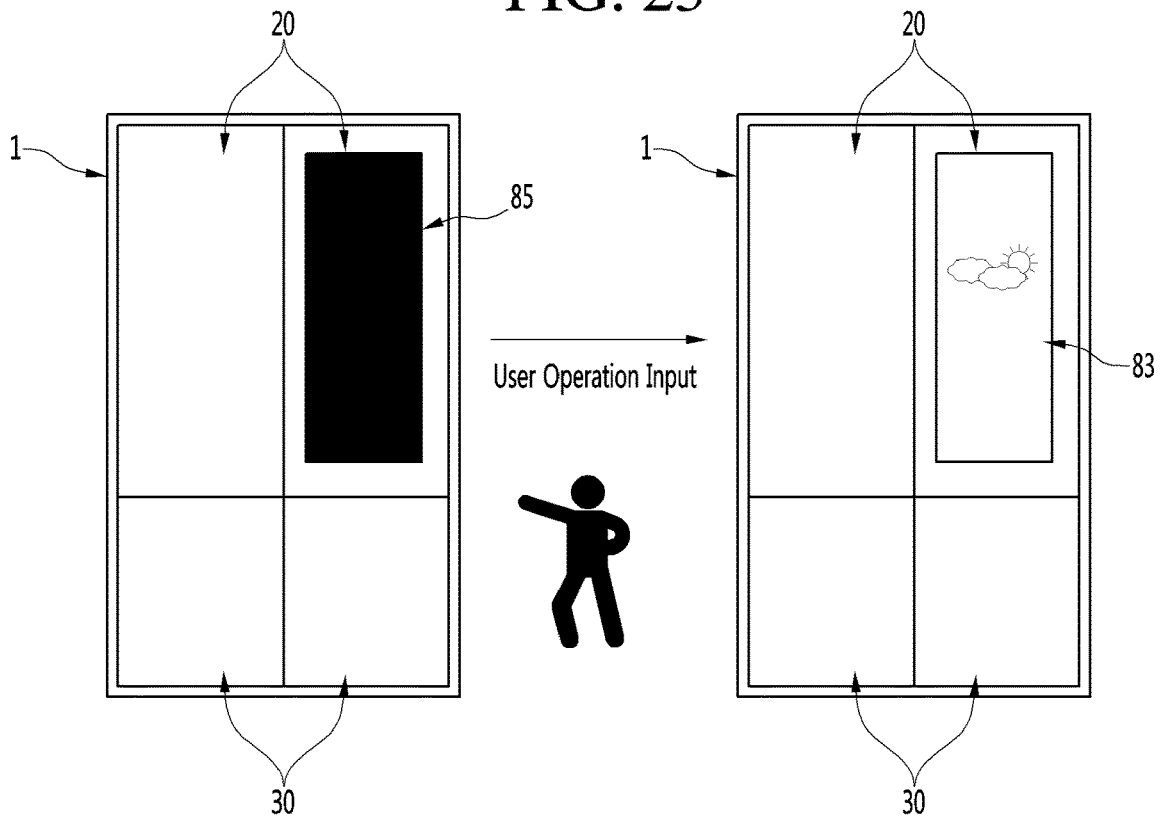
FIG. 23 is a view sequentially illustrating an example in which the see-through part is turned on in a turn-off state.

FIG. 23 is a view sequentially illustrating an example in which the see-through part is turned on in the turn-off state.

As illustrated in the drawing, in the refrigerator 1 according to this embodiment, the see-through part 80 before the user's manipulation may standby in the fifth state.

Also, the user may input the manipulation into the refrigerator 1 through the manipulation input unit 16. Here, the manipulation of the manipulation input unit 16 may be performed through the proximity detection sensor 161, the motion detection sensor 162, the microphone 163, the knock detection device 164, the vision sensor 165, and the manipulation part 166. Alternatively, a front surface of the transparent panel assembly 60 may be touched to input the manipulation.

When the user's manipulation is inputted, the see-through part 80 may output a screen of the third state 83. In the third state 83, various pieces of information may be transmitted through the see-through part 80, and information that is capable of being confirmed by the user may be outputted in the state in which the interior of the refrigerator 1 is opaque.

That is, when the user does not confirm the inside of the door storage space 41 but confirm the information that is capable of being outputted through the see-through part 80, the manipulation input unit 16 may be manipulated to convert the fifth state 85 into the third state 83.

Also, the user may manipulate the transparent panel assembly 60 to perform the next operation.

Figure 24:
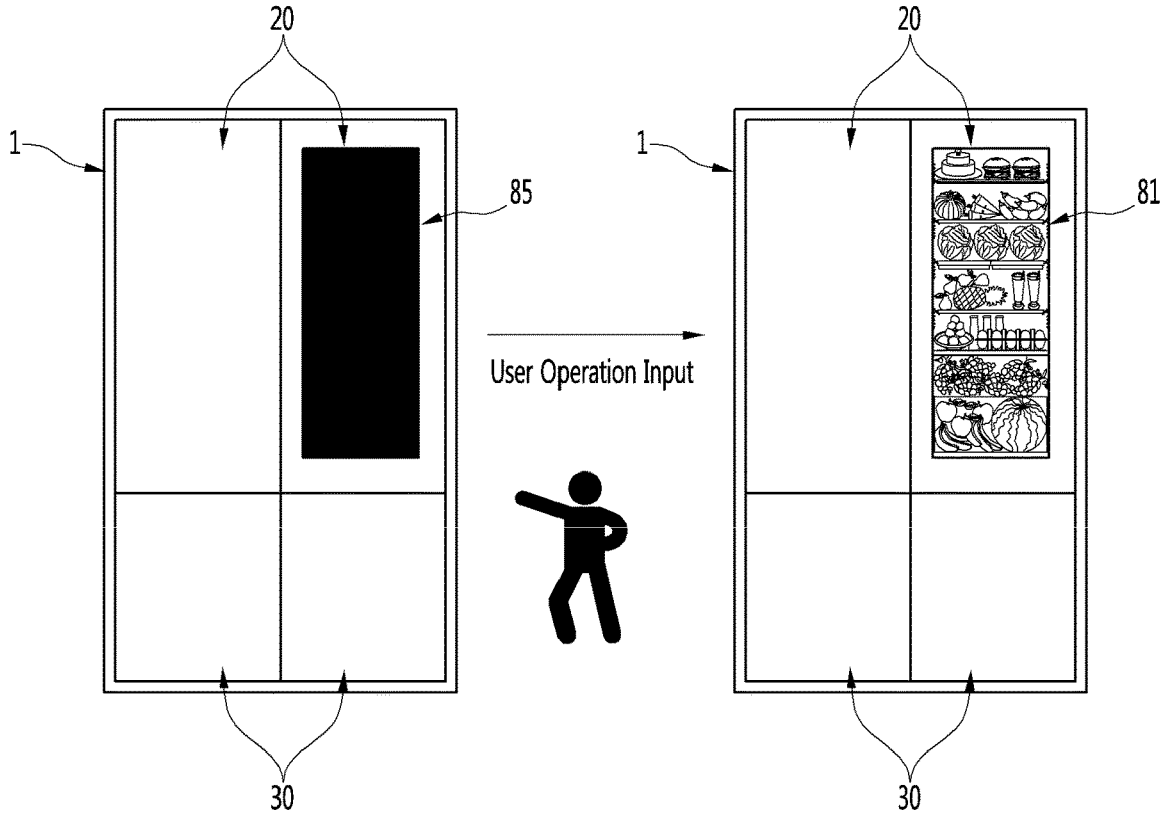
FIG. 24 is a view sequentially illustrating another example in which the see-through part is turned on in the turn-off state.

FIG. 24 is a view sequentially illustrating another example in which the see-through part is turned on in the turn-off state.

As illustrated in the drawing, in the refrigerator 1 according to this embodiment, the see-through part 80 before the user's manipulation may standby in the fifth state.

Also, the user may input the manipulation into the refrigerator 1 through the manipulation input unit 16. Here, the manipulation of the manipulation input unit 16 may be performed through the proximity detection sensor 161, the motion detection sensor 162, the microphone 163, the knock detection device 164, the vision sensor 165, and the manipulation part 166. Alternatively, a front surface of the transparent panel assembly 60 may be touched to input the manipulation.

When the user's manipulation is inputted, the see-through part 80 may become the first state 81. The first state 81 may be a state in which the door storage space 41 is most clearly seen. Here, the user may activate the see-through part 80 and simultaneously accurately confirm the door storage space 41.

That is, if the user intends to only confirm the door storage space 41, the see-through part 80 may be converted from the fifth state into the first state 81. Also, the user may manipulate the transparent panel assembly 60 to perform the next process.

Figure 25:
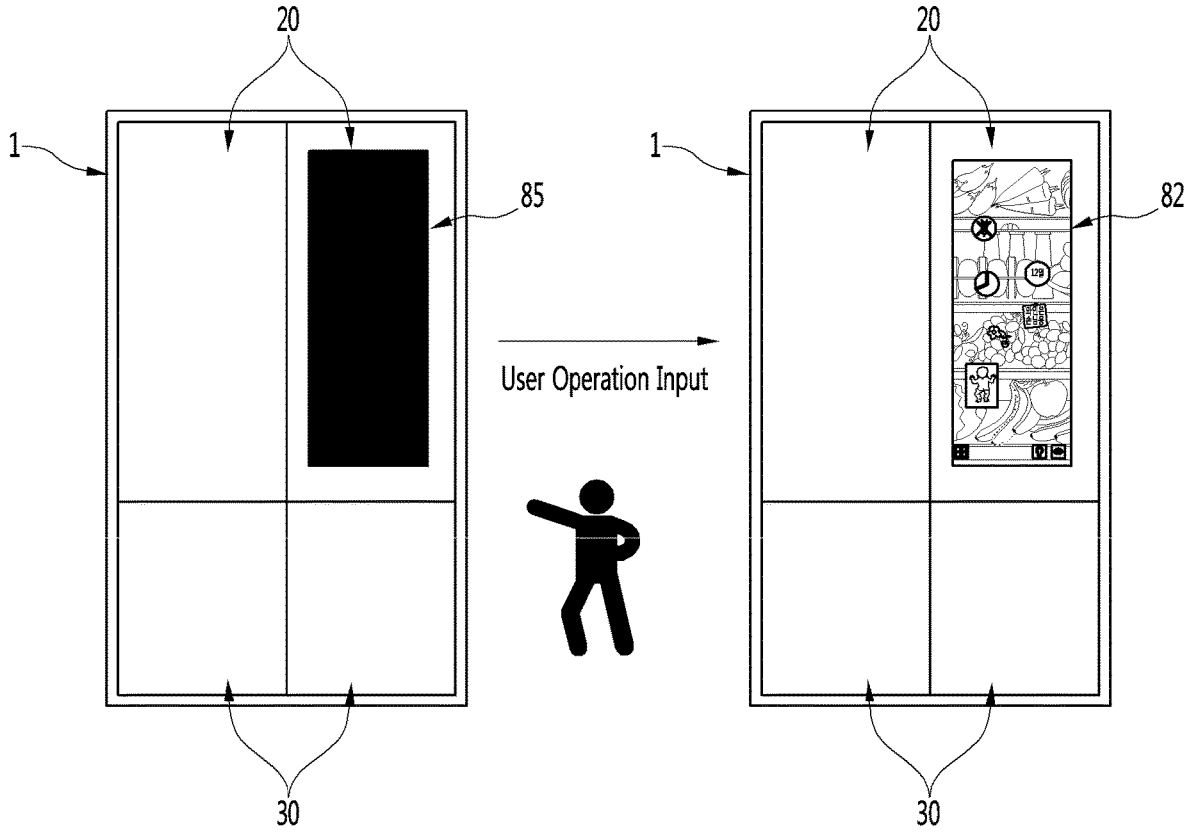
FIG. 25 is a view sequentially illustrating further another example in which the see-through part is turned on in the turn-off state.

FIG. 25 is a view sequentially illustrating further another example in which the see-through part is turned on in the turn-off state.

As illustrated in the drawing, in the refrigerator 1 according to this embodiment, the see-through part 80 before the user's manipulation may standby in the fifth state.

Also, the user may input the manipulation into the refrigerator 1 through the manipulation input unit 16. Here, the manipulation of the manipulation input unit 16 may be performed through the proximity detection sensor 161, the motion detection sensor 162, the microphone 163, the knock detection device 164, the vision sensor 165, and the manipulation part 166. Alternatively, a front surface of the transparent panel assembly 60 may be touched to input the manipulation.

When the user's manipulation is inputted, the see-through part 80 may become the second state 82. The second state 82 may be a state in which the door storage space 41 is seen somewhat, and simultaneously, the screen is outputted through the see-through part 80.

That is, if the user intends to confirm the door storage space 41 and obtain the output information, the see-through part 80 may be converted from the fifth state into the second state 82. Also, the user may manipulate the transparent panel assembly 60 to perform the next process.

As illustrated in FIGS. 23 to 25, the user may selectively activate the see-through part 80 through the manipulation input unit 16 from the fifth state 85 that is the standby state into the first state 81, the second state 82, and the third state 83. For this, in the manipulation input unit 16, an input condition matching each state may be set. Thus, the user may manipulate the manipulation input unit 16 according to the corresponding condition. Alternatively, the see-through part 80 may be set to be activated to be converted from the fifth state 85 to one of the first state 81 or third state or to the third state 83 through the setting. When the input of the manipulation input unit 16 is confirmed, the see-through part 80 may be converted to the set state.

Figure 26:
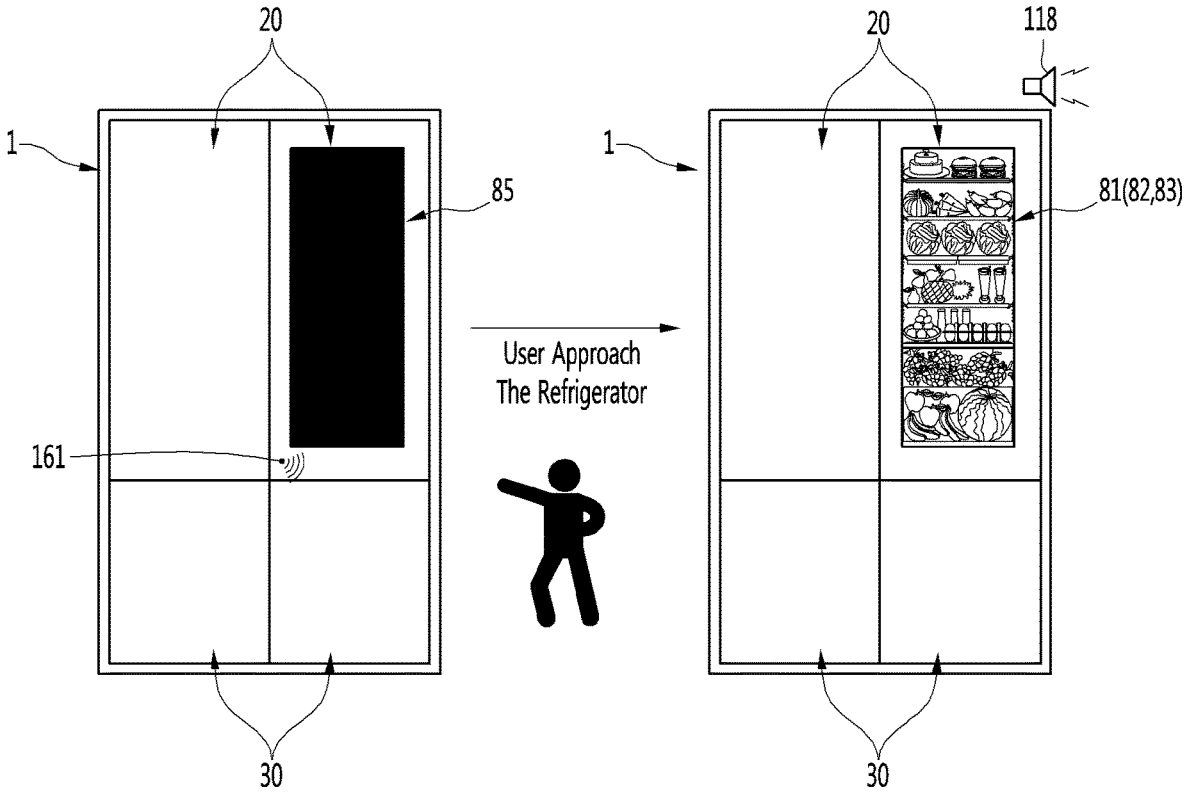
FIG. 26 is a view sequentially illustrating further another example in which the see-through part is turned on the turn-off state.

FIG. 26 is a view sequentially illustrating further another example in which the see-through part is turned on the turn-off state.

As illustrated in the drawing, in the refrigerator 1 according to this embodiment, the see-through part 80 before the user's manipulation may standby in the fifth state.

Also, if information or alert to be transmitted to the user exists even though the user does not manipulate a specific manipulation, the state may be converted into an output state in which the information is transmitted through the see-through part 80 in the fifth state 85 regardless of the intention of the user, i.e., the first state 81, the second state 82, or the third state 83.

Here, a state in which the user is located at a set distance or region may be detected, and then the see-through part 80 may be converted in state. Here, the set distance or region may mean a faraway state unlike the distance and region by which the user approaches the refrigerator 1 to use the refrigerator 1, i.e., a distance of information in which the user is capable of seeing the refrigerator 1, for example, a distance and region in which the user is located in an indoor space.

The see-through part 80 is converted from the fifth state 85 into the output state, and then a sound is outputted through the user's mobile device 8. As a result, the user may grasp the information by heating the sound outputted from the user's mobile device even though the user does not directly see the refrigerator 1 or is doing something else or be induced to approach the front of the refrigerator 1. Also, the alert may be outputted through the see-through part 80 and transmitted to the user's mobile device 8 disposed at a remote place. In addition, the user and the indoor user may share the information or communicate with each other.

Figure 27:
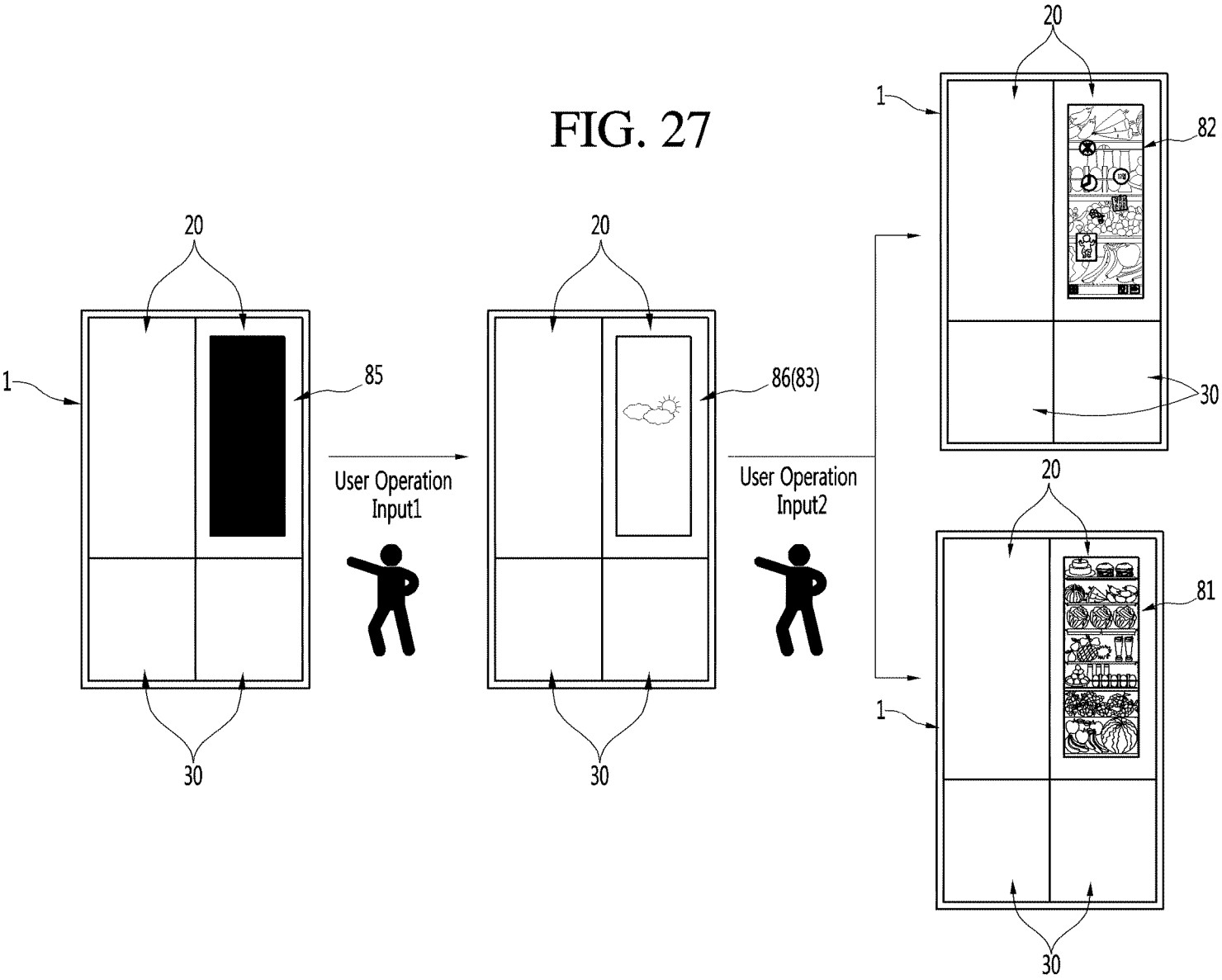
FIG. 27 is a view sequentially illustrating further another example in which the see-through part is turned on in the turn-off state.

FIG. 27 is a view sequentially illustrating further another example in which the see-through part is turned on in the turn-off state.

As illustrated in the drawing, in the refrigerator 1 according to this embodiment, the see-through part 80 before the user's manipulation may standby in the fifth state.

Also, the user may input the manipulation into the refrigerator 1 through the manipulation input unit 16. Here, the manipulation of the manipulation input unit 16 may be performed through the proximity detection sensor 161, the motion detection sensor 162, the microphone 163, the knock detection device 164, the vision sensor 165, and the manipulation part 166. Alternatively, a front surface of the transparent panel assembly 60 may be touched to input the manipulation.

When the user's manipulation is inputted, the see-through part 80 may output a screen of the sixth state 86. The sixth state 86 may the same state as the third state 83. However, a set screen may be outputted.

Here, the set screen may be operation information such as weather information, news, a temperature of the refrigerator, and the like, and output the information set in the sixth state 86 in the state in which the interior of the refrigerator is opaque as in the third state 83.

Particularly, when the see-through part 80 is turned on in the fifth state 85, if it is reluctant to expose the door storage space that is in dirty state, the state may be converted into a visible state via the sixth state 86.

Thus, when the fifth state 85 is converted into the sixth state 86, the sixth state 86 may be manipulated to be converted into the first state 81 or the third state 83 by user's selection. The manipulation may be performed through the manipulation input unit 16 but may be preferably performed through the touch manipulation of the transparent panel assembly 60.

For example, if the user intends to clearly confirm the door storage space 41 in the sixth state 86, the transparent panel assembly 60 may be touched or dragged, or the number of times of knocks may be adjusted to convert the sixth state 86 into the first state 81.

Also, when it is required to confirm the information through the see-through part 80 rather than the confirmation of the door storage space 41 or confirm the door storage space 41 and confirm the information outputted through the see-through part 80 in the sixth state 86, the transparent panel assembly 60 may be touched or dragged in a different manner, or the number of times of knocks may be adjusted to convert the sixth state 86 into the second state 82.

As described above, the sixth state 86 may be referred to as a glance state 86 in which simple information displayed when changed to another screen or at the moment when the see-through part 80 is turned on.

The glance state 86 may perform a function such as a basic wallpaper or a start standby screen, and the user may confirm the basic information through the see-through part 80 of the glance state 86. Here, the basic information may be displayed at a glance without additional operations such as weather, news, other notifications, operation information of the refrigerator, or information to be delivered to the user before use of the refrigerator.

Particularly, when the refrigerator 1 is connected to a server or a plurality of other home appliances through a network as illustrated in FIG. 15 or 16, information of the server 2 and alert information from other home appliances may be outputted in the glance state 86.

Also, the glance state 86 may be a state in which the display 62 is outputted in the state in which the see-through part 80 is opaque, and thus, the interior of the refrigerator 1 may be seen through the see-through part 80. Also, the basic information and the information grasped at the moment, which are outputted when the user opens or closes the door 24, or when the see-through part 80 is initially activated may be outputted to the user.

Particularly, when the see-through part 80 is turned on, the state may be converted into the glance state. Here, the operation state of the refrigerator 1 and the information to be intended to be transmitted first to the user may be transmitted prior to the viewing of the interior of the refrigerator 1, and then, the interior of the refrigerator 1 may be changed into the visible state through the manipulation of the user in the glance state.

The moment at which the see-through part is activated or the moment at which the refrigerating compartment door 20 is opened and closed may be a state in which the user approaches the refrigerator 1. Here, since the see-through part 80 is seen, the state may be converted into the glance state so that the basic operation information of the refrigerator 1 or the set specific information may be shown.

Figure 28:
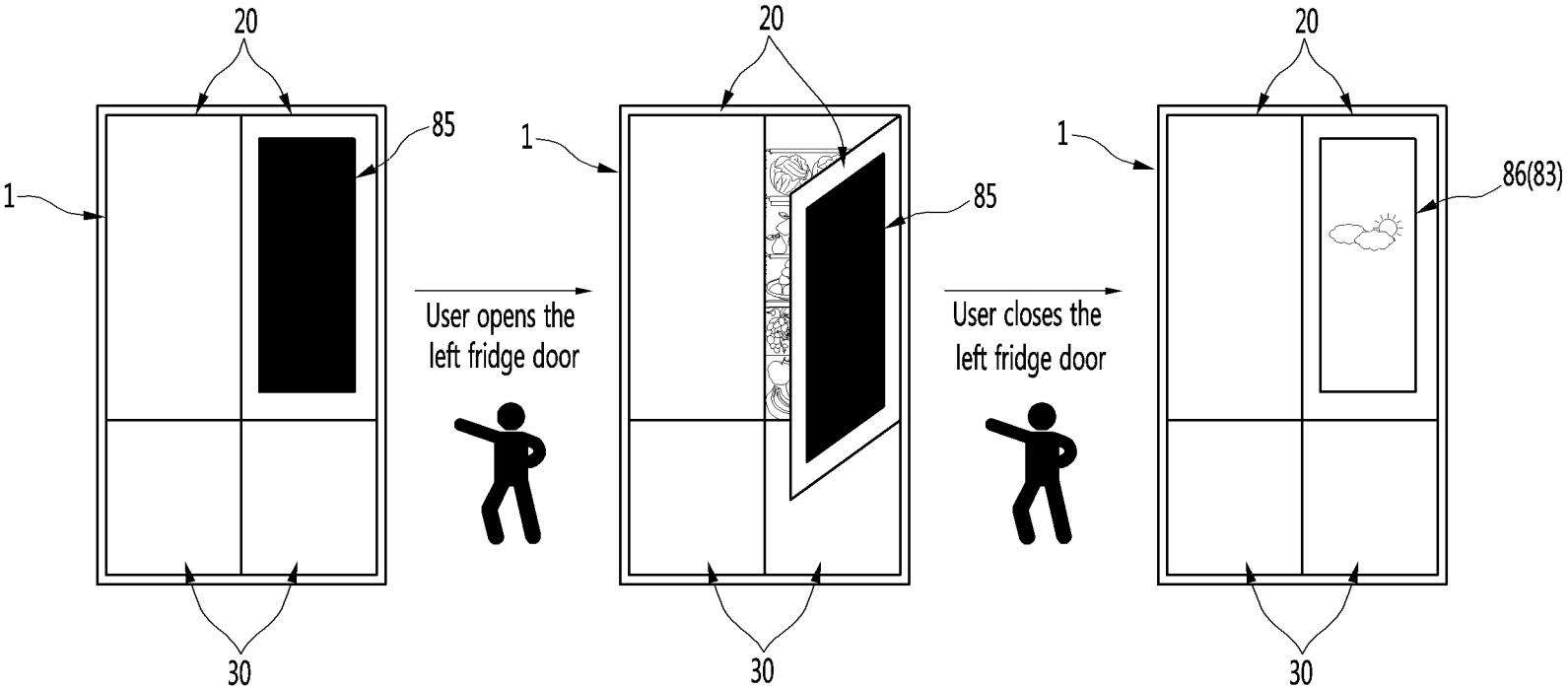
FIG. 28 is a view sequentially illustrating a state change when one refrigerating compartment door is closed after being opened in the state in which the see-through part is turned off.
Figure 29:
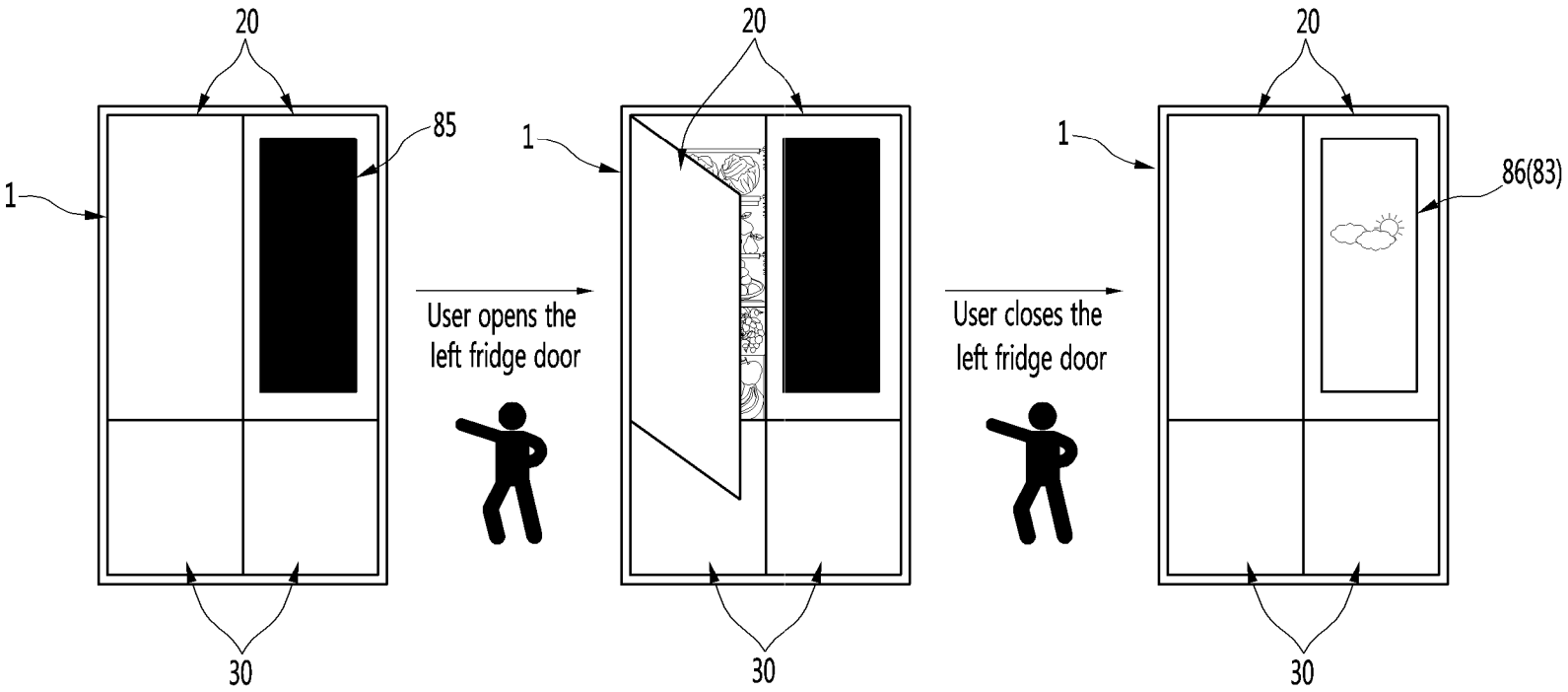
FIG. 29 is a view illustrating a state change when the other refrigerating compartment door is closed after being opened in the state in which the see-through part is turned off.

FIG. 28 is a view sequentially illustrating a state change when one refrigerating compartment door is closed after being opened in the state in which the see-through part is turned off. Also, FIG. 29 is a view illustrating a state change when the other refrigerating compartment door is closed after being opened in the state in which the see-through part is turned off.

As illustrated in the drawing, in the refrigerator 1 according to this embodiment, the see-through part 80 before the user's manipulation may standby in the fifth state.

In this state, the user may open the left or right refrigerating compartment door 20 to accommodate food. When the food is completely accommodated, the refrigerating compartment door 20 is closed. The see-through part 80 may be maintained in the fifth state 85 in the state in which the refrigerating compartment door 20 is opened. Also, the see-through part 80 may be converted from the fifth state 85 to the sixth state 86 at the moment at which the refrigerating compartment door 20 is closed.

The sixth state 86 may be the above-described glance state. Here, the preset information may be transmitted to the user.

Also, the see-through part 80 may be converted from the fifth state 85 to the third state 83 at the moment at which the refrigerating compartment door 20 is closed after being opened. In this case, the see-through part 80 may output a specific alert occurring when the refrigerator operates or an alert designated by the user to the user in the third state 83. Particularly, when the right door 22 of the refrigerating compartment door 20 is closed after being opened, since the interior of the refrigerator is always confirmed by opening the right door 22, it is unnecessary to convert the state of the see-through part again into the visible state. Thus, the state may be converted into the sixth state 86 or the third state 83 in which the information is transmitted in the opaque state.

Also, if additional manipulation of the user is not performed after being converted into the sixth state 86 and the third state 83, the see-through part may be converted into the fifth state 85 to become the standby state.

Figure 30:
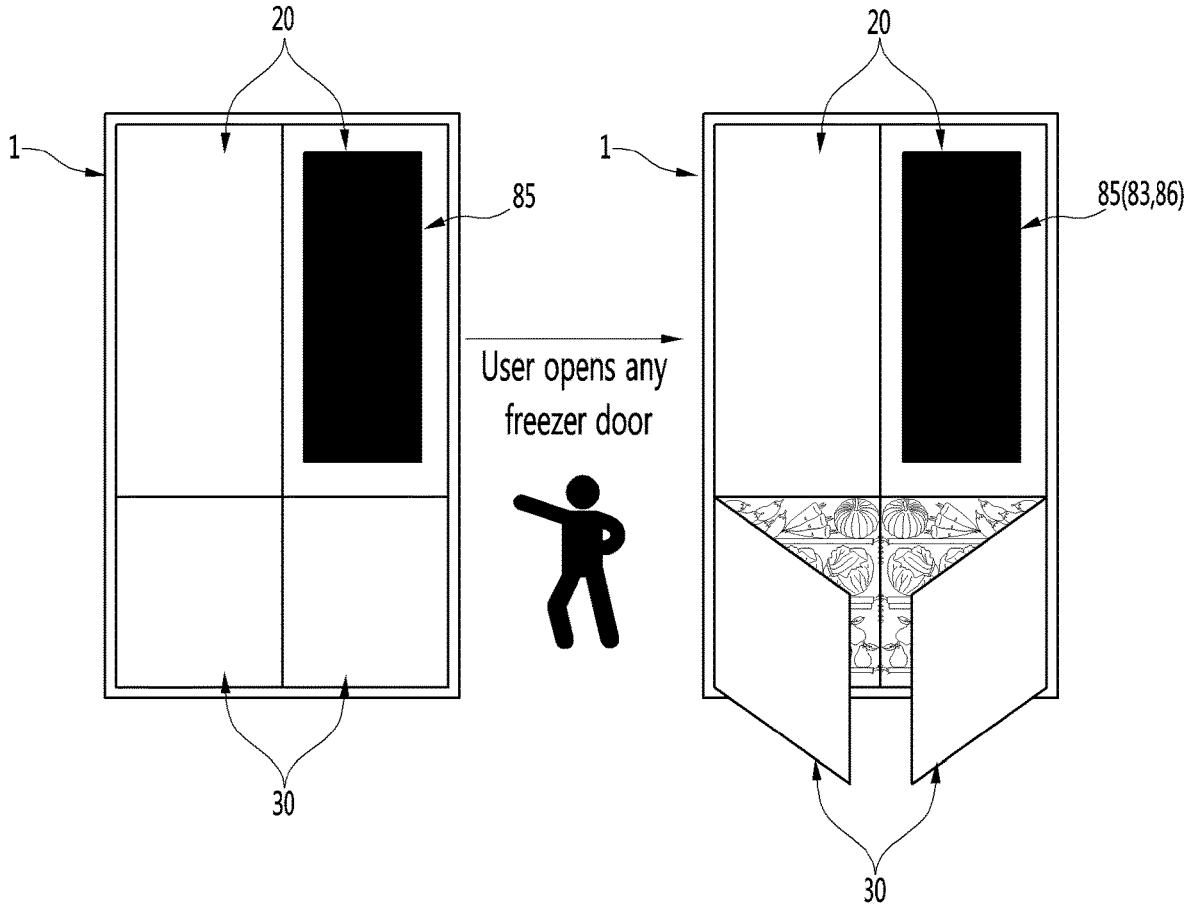
FIG. 30 is a view sequentially illustrating a state change when a freezing compartment door is closed after being opened in the state in which the see-through part is turned off.
Figure 31:
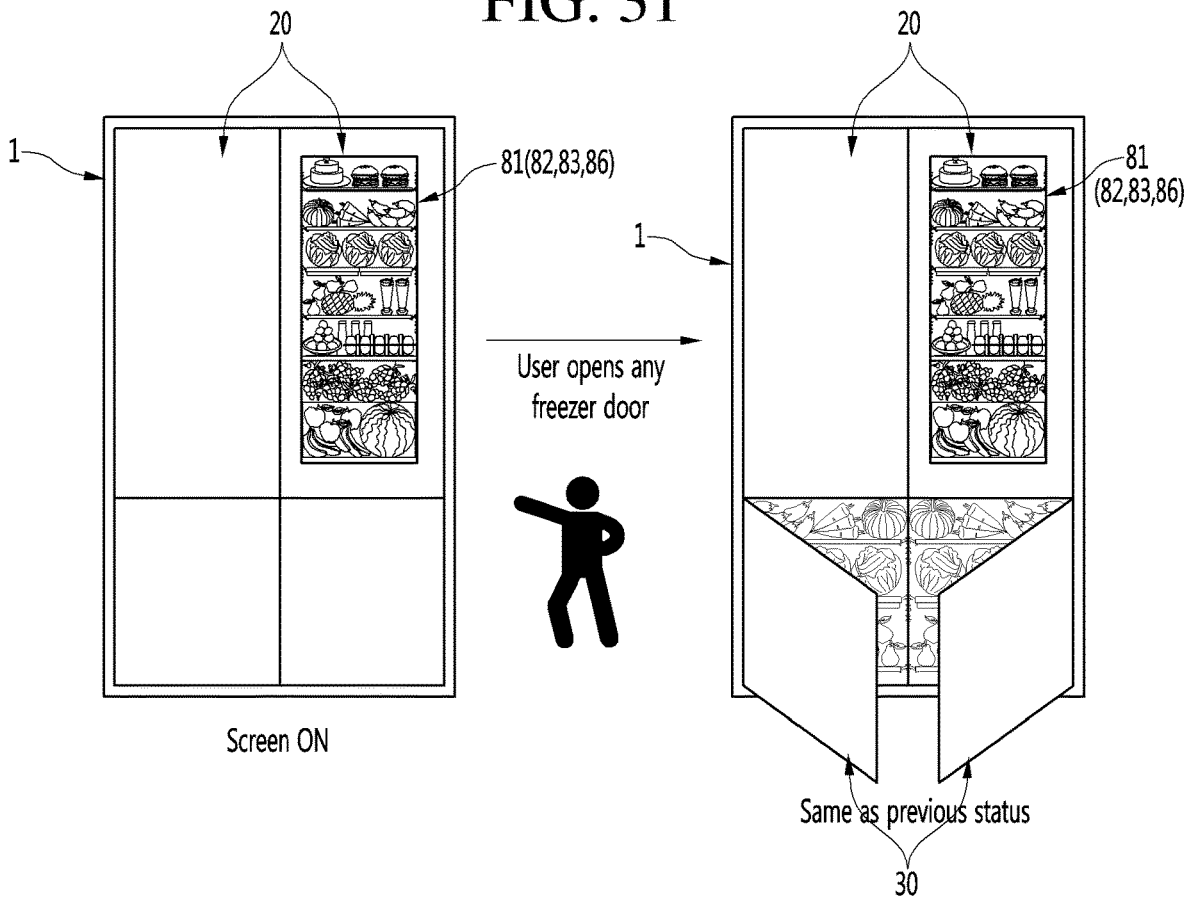

FIG. 30 is a view sequentially illustrating a state change when a freezing compartment door is closed after being opened in the state in which the see-through part is turned off. Also, FIG. 31 is a view sequentially illustrating a state change when the freezing compartment door is closed after being opened in the state in which the see-through part is turned on.

As illustrated in the drawing, in the refrigerator 1 according to this embodiment, the see-through part 80 stands by to a state such as the fifth state 85 before the user's manipulation. When the user manipulates the see-through part 80, the see-through part may become one of the first state 81, the second state 82, the third start, and the sixth state.

In the above-described state, the user opens and closes the freezing compartment 13 to accommodate food into the freezing compartment 13. However, when the freezing compartment 13 is opened and closed, the see-through part 80 may be maintained in the previous state.

That is, although the freezing compartment 13 is opened and closed, the see-through part 80 is not changed in state. When the see-through part 80 is in the fifth state 85, the sixth state 86 may be maintained. When the see-through part 80 is in one of the first state 81, the second state 82, the third state 83, and the sixth state 86, the state may be maintained.

As illustrated in FIG. 30, when the see-through part 80 is in the fifth state 85, and the freezing compartment door 30 is in the closed state, if the user closes the freezing compartment door 30 after the freezing compartment door 30 is opened, the see-through part 80 may be in the sixth state 86 and the third state 83 to transmit information to the user. When the user approaches the refrigerator 1, the information may be easily transmitted. Thus, although the freezing compartment door 30 is opened, since the user approaches the refrigerator 1, the sixth state 86 or the third state 83 in which the basic operation information or various alerts of the refrigerator 1 are provided to the user may be outputted.

Figure 32:
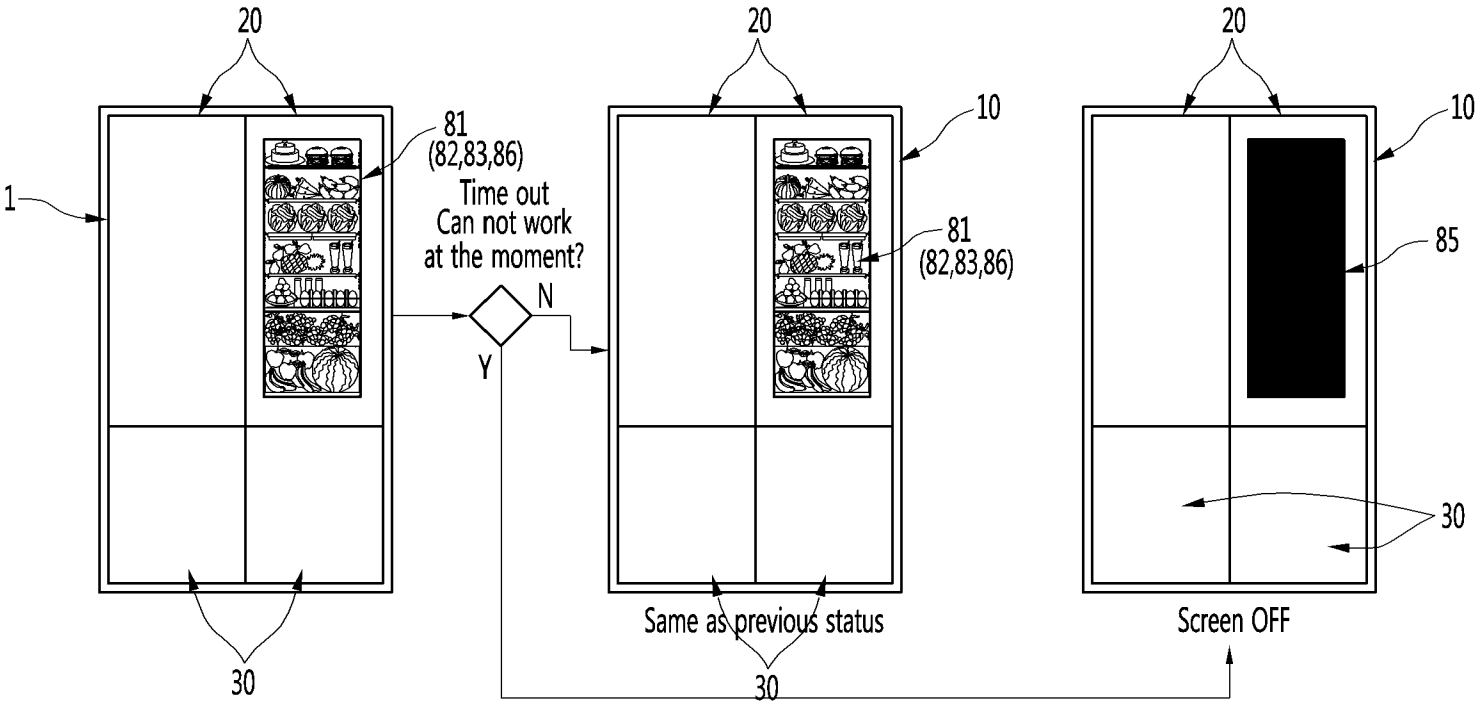

FIG. 32 is a view sequentially illustrating a state change according to whether a set time elapses in the see-through part is turned on.

As illustrated in the drawing, in the refrigerator according to an embodiment, the see-through part 80 may be activated by the manipulation of the user to allow the see-through part 80 to become one of the first state 81, the second state 82, the third state 83, and the sixth state 86.

In this state, the user may manipulate the transparent panel assembly 60 to utilize the see-through part 80 through the conversion of the state or the screen manipulation. Here, the screen state of the see-through part 80 may be activated to be continuously maintained in the previous state as long as the manipulation of the transparent panel assembly 60 is continuously performed within the set time.

Also, when the manipulation of the transparent panel assembly 60 is not performed for the set time (for example, about 15 seconds) in the state in which the see-through part 80 is activated, the see-through part 80 may be automatically converted for power saving. Alternatively, the set time may vary as necessary.

Also, when the see-through part 80 is turned off like the fifth state 85, the see-through part 80 may be activated again through the manipulation of the manipulation input unit 16 or the manipulation of the transparent panel assembly 60.

Here, when the see-through part 80 is activated again within the set time (for example, about 5 seconds) after the see-through part 80 is turned off, the state before the see-through part 80 is turned off may be outputted.

Figure 33:
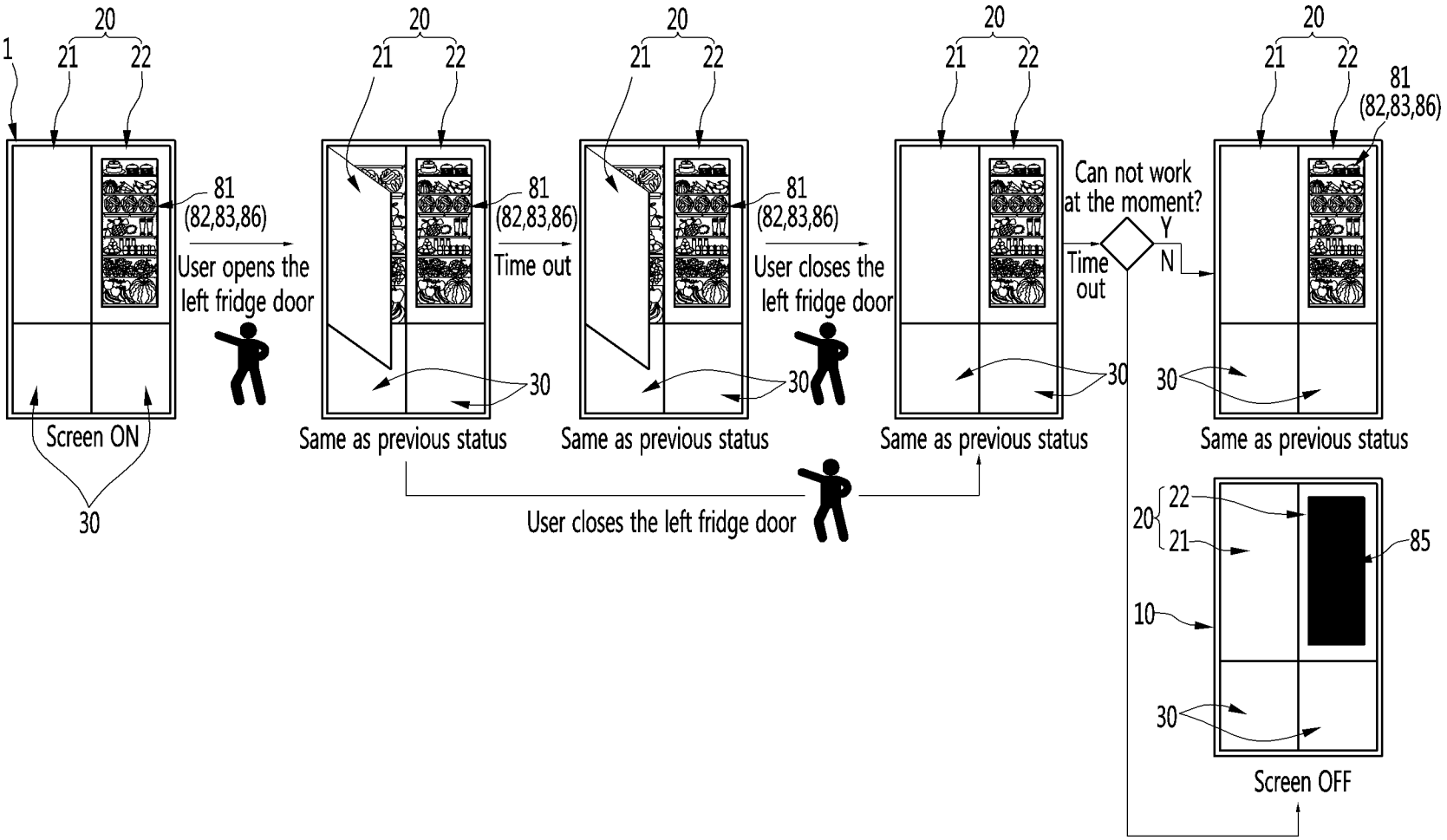
Figure 34:
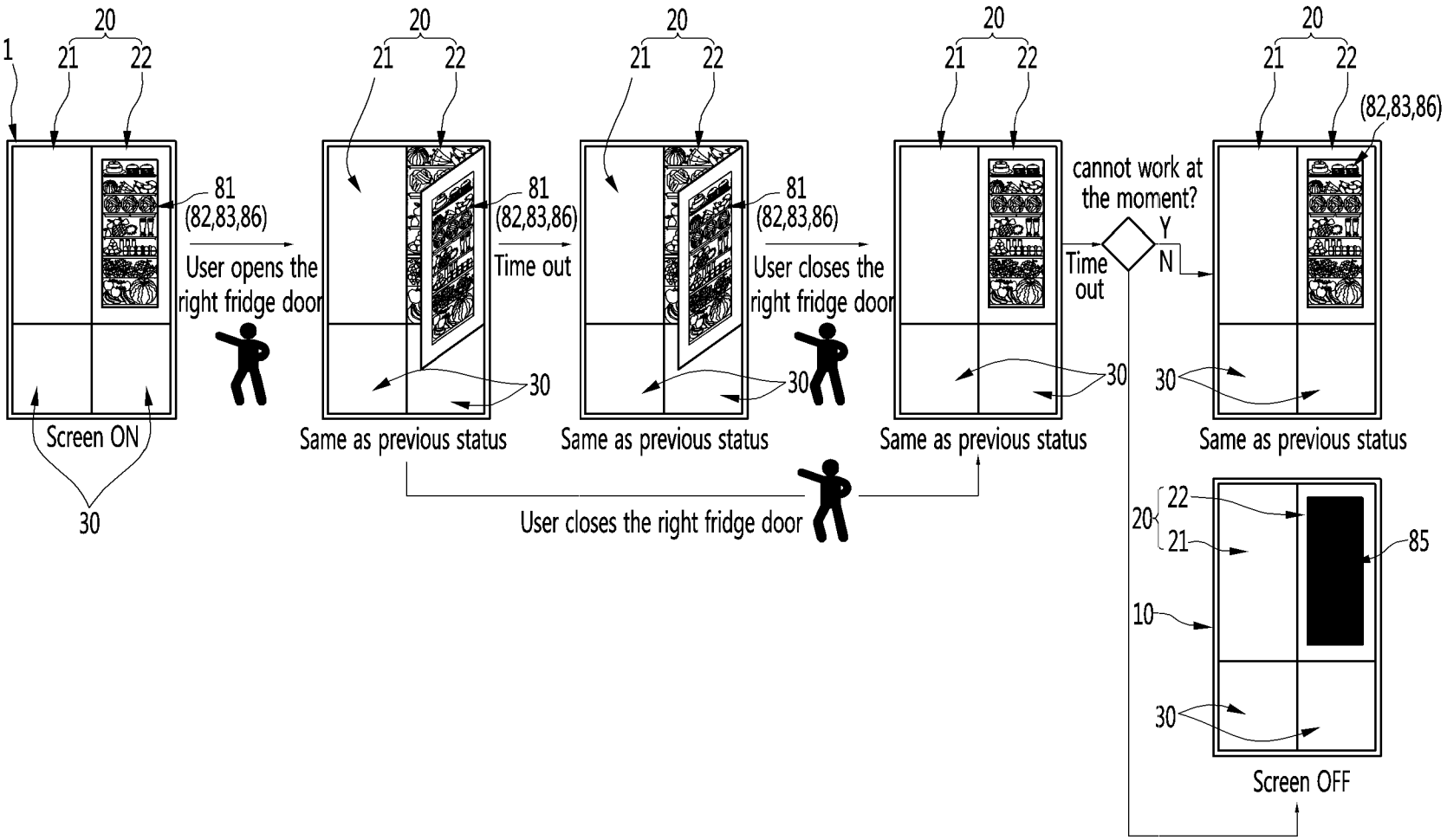

FIG. 33 is a view sequentially illustrating a state change when one refrigerating compartment door is closed after being opened in the state in which the see-through part is turned on. Also, FIG. 34 is a view sequentially illustrating a state change when the other refrigerating compartment door is closed after being opened in the state in which the see-through part is turned on.

As illustrated in the drawing, in the refrigerator 1 according to this embodiment, the see-through part 80 stands by to a state such as the fifth state 85 before the user's manipulation. When the user manipulates the see-through part 80, the see-through part may become one of the first state 81, the second state 82, the third start, and the sixth state.

In this state, the user may manipulate the transparent panel assembly 60 to utilize the see-through part 80 through the conversion of the state or the screen manipulation.

Also, when the see-through part 80 is activated in one of the first state 81, the second state 82, the third state 83, and the sixth state 86, the user may open the refrigerating compartment door 20.

Although the refrigerating compartment door 20 is opened, the see-through part 80 may be maintained in the previous state as ever, and the user may confirm the information and see the interior of the refrigerator 1 through the see-through part 80. Particularly, an operation of taking the food in or out while confirming the scree outputted on the see-through part 80 may be performed.

In the state in which the see-through part 80 is activated, when the refrigerating compartment door 20 is opened, even though the set time (for example, about 15 seconds) elapses without performing separate manipulation on the transparent panel assembly 60, the previous screen state may be continuously maintained in the state in which the see-through part 80 is continuously activated. Here, even though the left door 21 or the right door 22 of the refrigerating compartment door 20 is opened, the see-through part 80 may be maintained in state. Although not shown, when all the left door 21 and the right door 22 are opened, the see-through part 80 may be maintained in the just previous state.

In the state in which the see-through part 80 is activated to become the state in which the information is outputted, the user may open the refrigerating compartment door 20 to accommodate the food. Here, the user may accommodate the food while seeing the activated see-through part 80 or manipulating the transparent panel assembly 60.

When the food is completely accommodated, the user may close the refrigerating compartment door 20. Even though the refrigerating compartment door 20 is closed, the see-through part 80 may be in the activated state as ever and be maintained in the previous state.

In this state, the user may then manipulate the transparent panel assembly 60 and convert the screen state or change the outputted screen.

On other hand, in the state in which the refrigerating compartment door 20 is closed, and the see-through part 80 is activated as ever to be maintained in the previous state, when the set time elapses without performing separate manipulation by the user, the see-through part 80 may be converted into the fifth state 85, and the see-through part 80 may be in the turn-off state.

Figure 35:
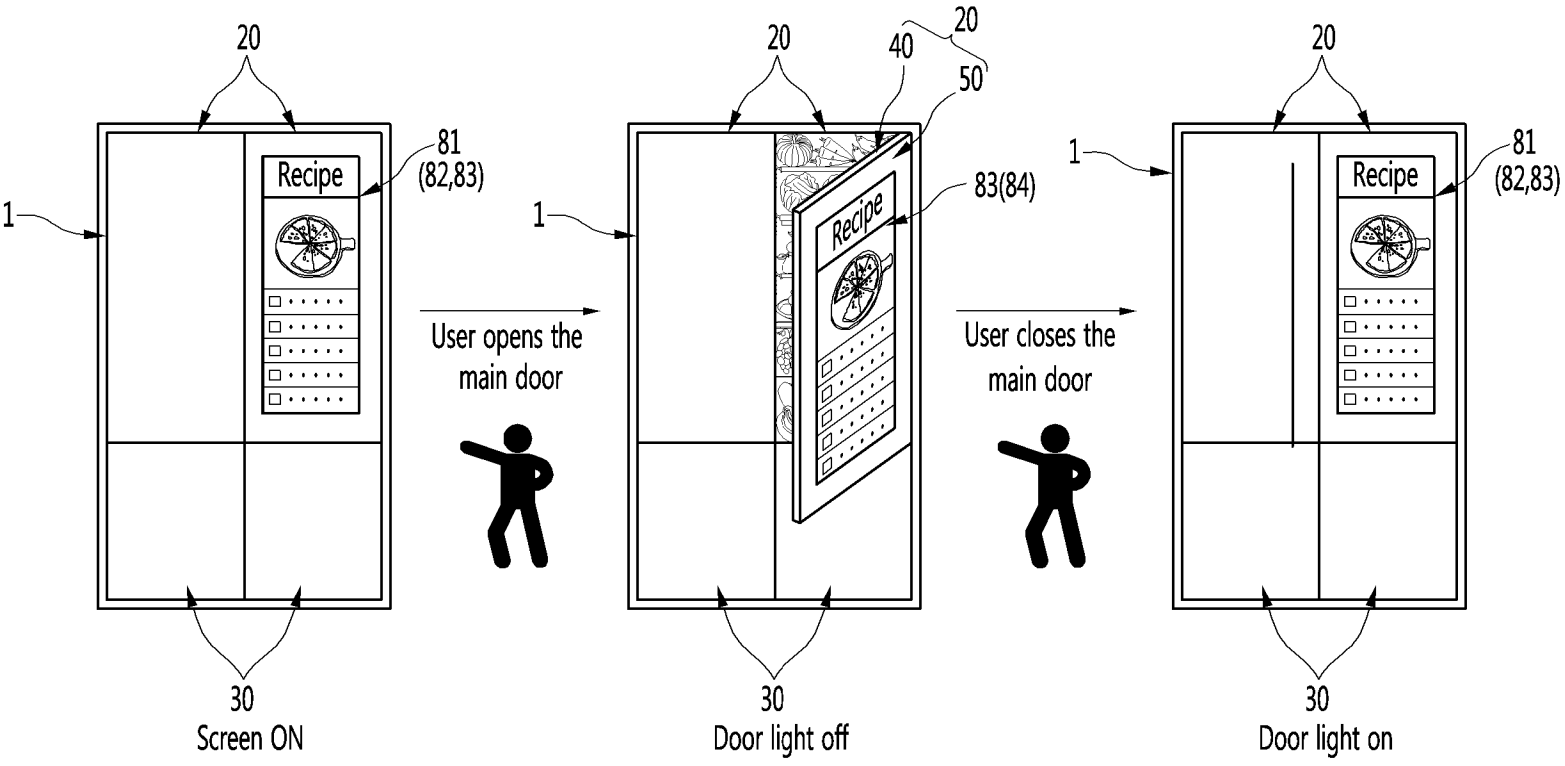

FIG. 35 is a view sequentially illustrating a state change when the main door of the refrigerating compartment door is closed after being opened in the state in which the see-through part is turned on.

As illustrated in the drawing, in the refrigerator according to an embodiment, the see-through part 80 may be activated by the manipulation of the user to allow the see-through part 80 to become one of the first state 81, the second state 82, and the third state 83. In this state, the user may manipulate the transparent panel assembly 60 to utilize the see-through part 80 through the conversion of the state or the screen manipulation.

In this state, the main door 40, of the main door 40 and the sub-door 50 to which the see-through part 80 is disposed, may be opened. The main door 40 may be opened to accommodate the food in the refrigerating compartment 12.

Also, in the state in which the main door 40 is opened, the see-through part 80 may become the fourth state 84 or the third state 83. In the fourth state 84 or the third state 83, the door light 57 may be turned off to prevent the user from glaring by the door light 57 exposed when the user opens the main door 40.

That is, the door light 57 may be disposed on the rear surface of the main door 40 or each of both left and right sides of the main door 40. In the state in which the main door 40 is opened, the door light 57 may be directly exposed to the user. Thus, since the fourth state 84 or the third state 83, in which the door light 57 is turned off, is realized, even though the user opens the main door 40, the glare of the user may be prevented.

Also, when the main door 40 is opened, the see-through part 80 may become the fourth state 84 or the third state 83 to output the information through the see-through part 80 as ever, and the user may conform the information through the see-through part 80. That is, the food may be accommodated in the refrigerating compartment 12, and simultaneously, the information may be confirmed through the see-through part 80.

For example, the user may confirm recipe by allowing the see-through part 80 to become the third state so as to see desired recipe in the state in which the user closes the refrigerating compartment door 20.

Also, when the necessary material is stored in the refrigerating compartment 12, the main door 40 may be opened to take out the food within the refrigerating compartment 12. In this process, the see-through part 80 may become the fourth state 84 or the third state 83 to allow the user to continuously take out the foods while confirming the see-through part 80. Here, in the state in which the main door 40 is opened, the door light 57 may be turned off, and the interior light 121 may be turned on. Thus, the user may accommodate the food without feeling the glare due to the door light 57.

When the desired food is completely taken out from the refrigerating compartment 12, the main door 40 may be closed. When the main door 40 is closed, the door light 57 may be turned on, and then, the just previous screen may be more brightened and clear. Thus, the user may cook the food while confirming the scree outputted through the see-through part 80. Also, here, although the set time elapses, additional setting may be further performed so that the see-through part 80 is not converted into the fifth state 85 but maintained in the third state.

When the main door 40 is closed, it may be determined that the confirmation of the recipe is no longer required because all necessary articles are taken out. Here, the see-through part 80 may be converted into the first state 81, the second state 82, and the third state to output the same screen as the previous state.

Figure 36:
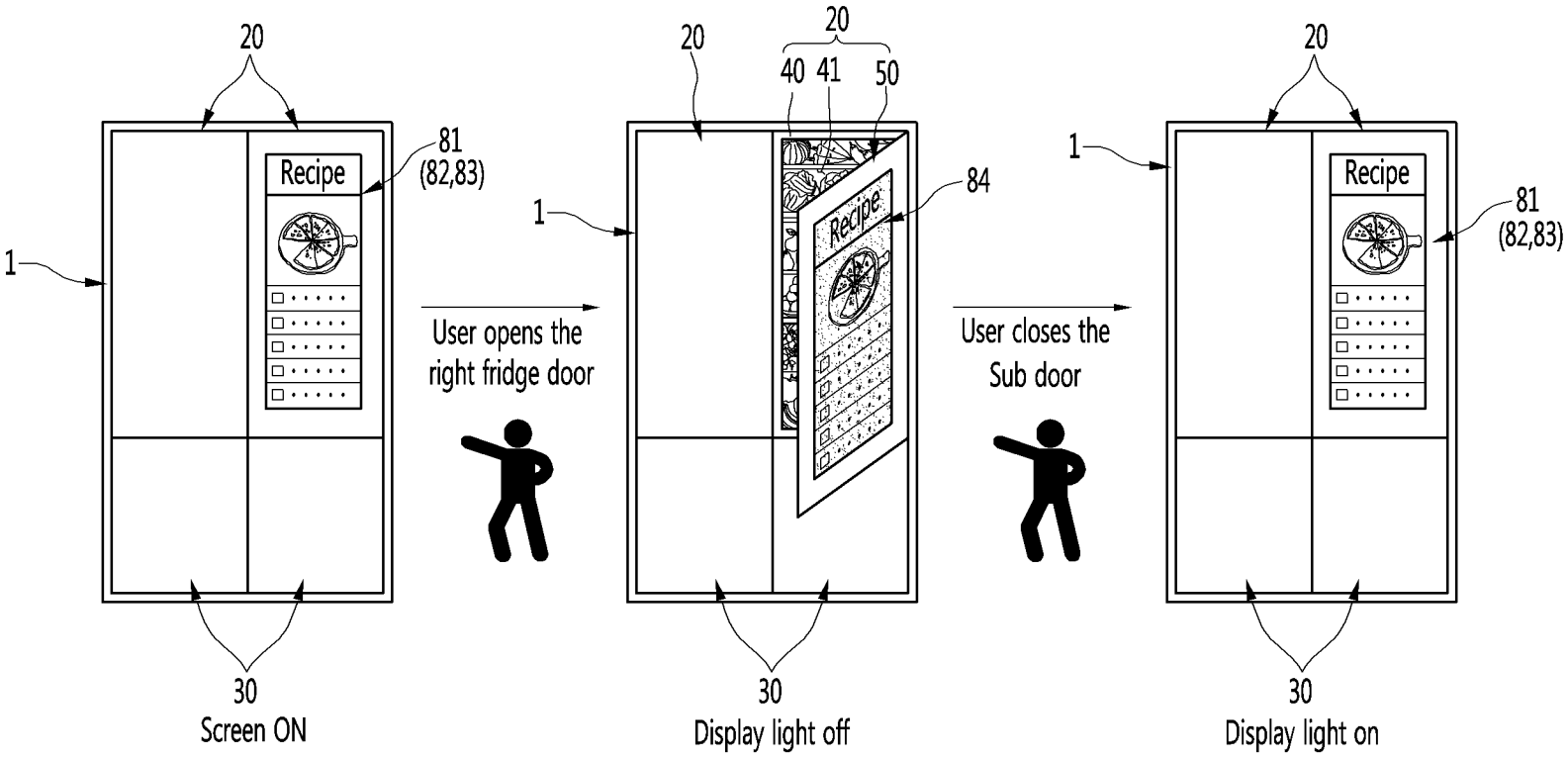

FIG. 36 is a view sequentially illustrating a state change when the sub-door of the refrigerating compartment door is closed after being opened in the state in which the see-through part is turned on.

As illustrated in the drawing, in the refrigerator according to an embodiment, the see-through part 80 may be activated by the manipulation of the user to allow the see-through part 80 to become one of the first state 81, the second state 82, and the third state 83. In this state, the user may manipulate the transparent panel assembly 60 to utilize the see-through part 80 through the conversion of the state or the screen manipulation.

In this state, the sub-door 50, of the main door 40 and the sub-door 50 to which the see-through part 80 is disposed, may be opened. The food may be accommodated into the door storage space 41 through the opening of the sub-door 50.

Also, in the state in which the sub-door 50 is opened, the see-through part 80 may become the fourth state 84. The fourth state 84 may be a state in which the door light 57 and the display light are turn off. Here, the glare of the user due to the door light 57 and the display light 68, which are exposed when the user opens the main door 40, may be prevented.

That is, the display light 68 may be provided in the transparent panel assembly 60. When the rear surface of the sub-door 50 is exposed due to the opening of the sub-door 50, the display light 68 may be directly exposed to the user through the rear surface of the sub-door 50. Thus, since the fourth state 84, in which the door light 68 is turned off, is realized, even though the user opens the sub-door 50, the glare of the user may be prevented.

When the sub-door 50 is opened, the door light 57 may be also directly exposed to the user to cause the glare of the user. Thus, the door light 57 may be turned off.

On the other hand, the interior light 121 may be turned on to indirectly brighten the door storage space 41 so that the user easily accommodates the food into the door storage space 41. In addition, the interior light 121 may serve as a light source that brightens somewhat the screen of the display 62 that is turned on in the fourth state 84.

Thus, when the sub-door 50 is opened, the see-through part 80 may become the fourth state 84 to output the information through the see-through part 80 as ever, and the user may conform the information through the see-through part 80. That is, the food may be accommodated in the door storage space 41, and simultaneously, the information may be confirmed through the see-through part 80.

For example, the user may confirm recipe by allowing the see-through part 80 to become the third state so as to see desired recipe in the state in which the user closes the refrigerating compartment door 20.

Also, when the necessary material is stored in the door storage space 41, the sub-door 50 may be opened to take out the food within the door storage space 41. In this process, the see-through part 80 may become the fourth state 84 to allow the user to continuously take out the foods while confirming the see-through part 80. Here, in the state in which the sub-door 50 is opened, the display light 68 may be turned off. Thus, the user may accommodate the food without feeling the glare due to the display light 68.

When the desired food is completely taken out from the refrigerating compartment 12, the sub-door 50 may be closed. When the sub-door 50 is closed, the display light 68 may be turned on, and then, the just previous screen may be more brightened and clear. Thus, the user may cook the food while confirming the scree outputted through the see-through part 80.

Figure 37:
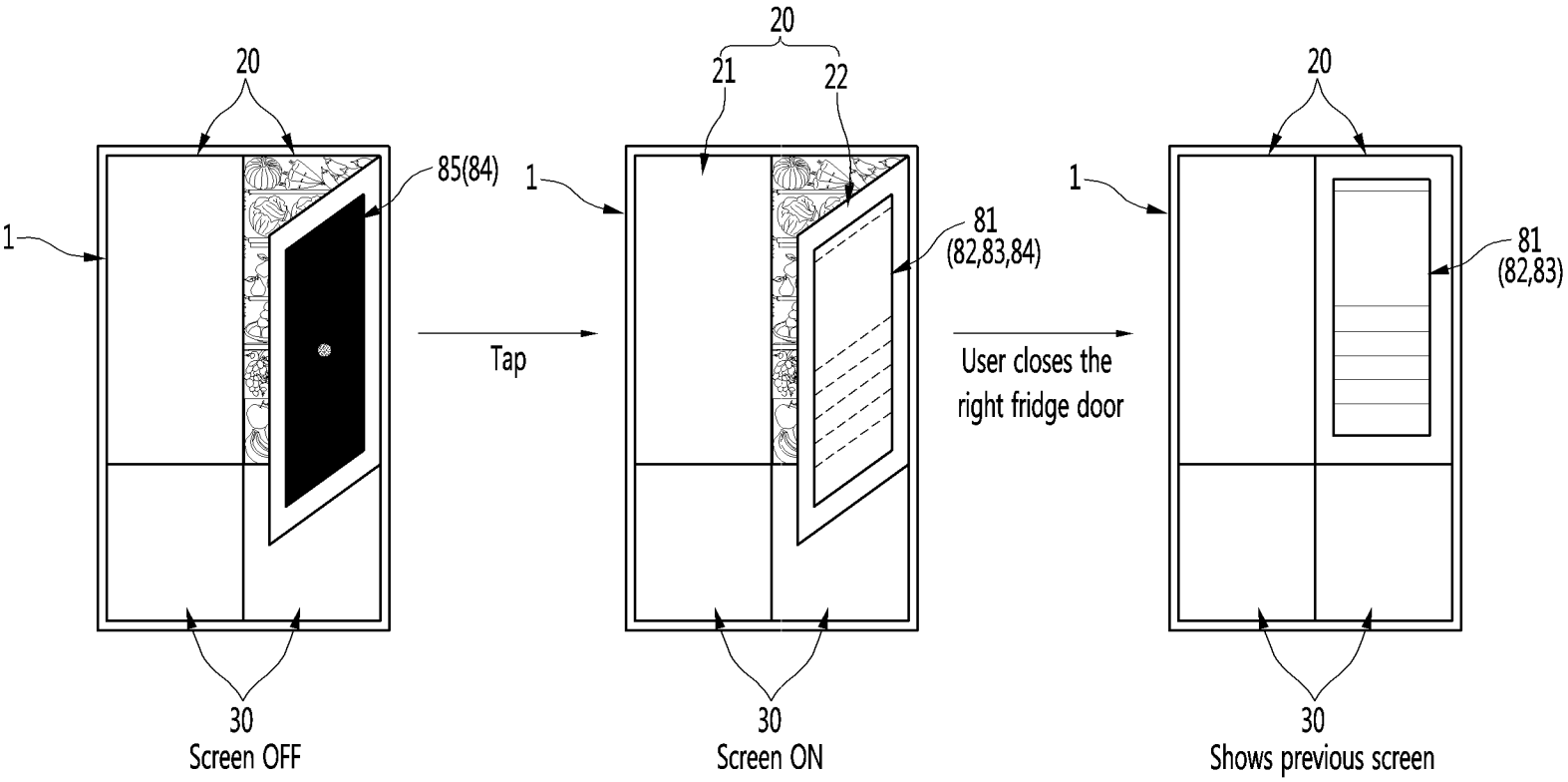
FIG. 37 is a view sequentially illustrating a state change when the refrigerating compartment door is closed after the user's manipulation in the state in which the refrigerating compartment door is opened, and the see-through part is turned off.

FIG. 37 is a view sequentially illustrating a state change when the refrigerating compartment door is closed after the user's manipulation in the state in which the refrigerating compartment door is opened, and the see-through part is turned off.

As illustrated in the drawings, in an embodiment, in the state in which the right door 22, to which the see-through part 80 is provided, of the refrigerating compartment door 20 including the left door 21 and the right door 22 is opened, the see-through part may become the fifth state 85.

Also, the user may need to open the right door 22 and confirm the see-through part 80 while accommodating the food. In this case, when the user taps or touches the front surface of the see-through part 80, the see-through part may be turned on in the state of being opened like the fifth state 85.

That is, in the state in which the right door 22 is opened, the see-through part 80 may be activated from the fifth state 85 to one of the first state 81, the second state 82, the third state 83, and the fourth state 84 by the manipulation of the user.

Thus, when the user intends to confirm or edit the information through the see-through part 80 while the food is accommodated in the refrigerating compartment 12 or the door storage space 41, the transparent panel assembly 60 may be manipulated to activate the see-through part 80.

When the food is completely accommodated in the refrigerating compartment 12 and the door storage space 41, the user may close the right door 22. When the right door 22 is closed, the see-through part 80 may become one of the first state 81, the second state 82, and the third state 83. When the right door 22 is opened, the outputted screen information may be maintained as it is.

Figure 38:
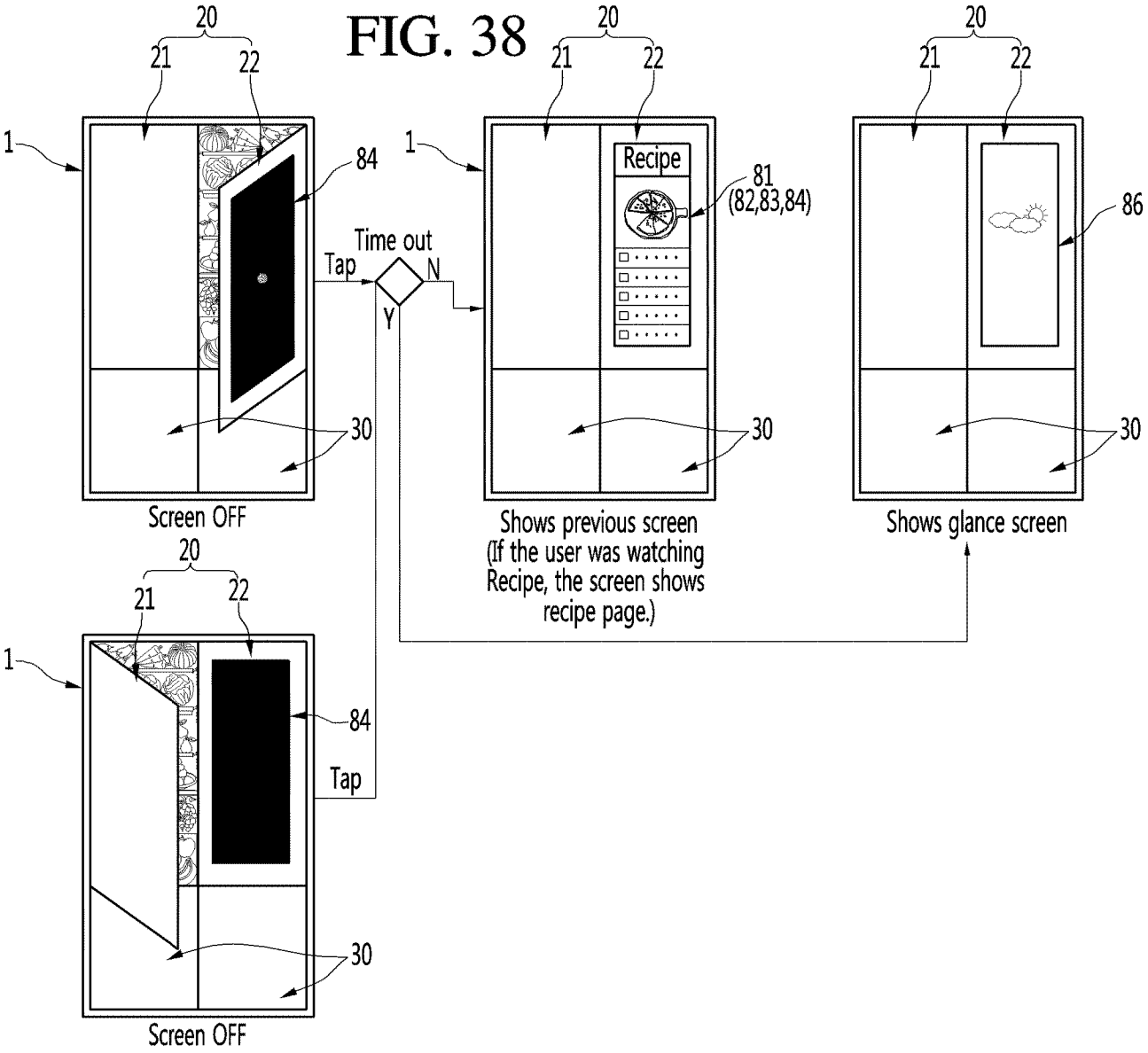
FIG. 38 is a view sequentially illustrating a state change according to whether the set time elapses when the refrigerating compartment door is closed after the user's manipulation in the state in which the refrigerating compartment door is opened, and the see-through part is turned off.

FIG. 38 is a view sequentially illustrating a state change according to whether the set time elapses when the refrigerating compartment door is closed after the user's manipulation in the state in which the refrigerating compartment door is opened, and the see-through part is turned off.

As illustrated in the drawing, according to an embodiment, in the state in which the left door 21 and/or the right door 22 are/is opened, the see-through part 80 may become the fifth state 85.

Also, the user may need to open the left door 21 and/or right door 22 and confirm the see-through part 80 while accommodating the food. In this case, when the user taps or touches the front surface of the see-through part 80, the see-through part may be turned on in the state of being opened like the fifth state 85. That is, in the state in which the right door 22 is opened, the see-through part 80 may be activated from the fifth state 85 to one of the first state 81, the second state 82, the third state 83, and the fourth state 84 by the manipulation of the user.

Thus, when the user intends to confirm or edit the information through the see-through part 80 while the food is accommodated in the refrigerating compartment 12 or the door storage space 41, the transparent panel assembly 60 may be manipulated to activate the see-through part 80.

In the state in which the user manipulates the transparent panel assembly 60 to activate the see-through part 80, when the set time (for example, about 1 minute) elapses without performing additional manipulation, all the left door 21 and the right door 22 may be closed to allow the see-through part 80 to become the sixth state 86.

That is, in the state in which the refrigerating compartment door 20 is opened, when the user does not manipulate the see-through part 80 for the set time because all the operations through the see-through part 80 are completed, it is determined that the confirmation of the information through the see-through part 80 is finished, and thus, the see-through part 80 is converted into the sixth state 86.

On the other hand, in the state in which the user manipulates the transparent panel assembly 60 to activate the see-through part 80, when all the left door 21 and the right door 22 are closed in the state in which the set time (for example, about 1 minute) does not elapse from the final manipulation, the see-through part 80 may become the first state 81, the second state 82, and the third state 83 to output the same screen as that when the left door 21 or the right door 22 is opened.

That is, in the refrigerating compartment door 20 is opened, it is determined that the set time does not elapse after the user manipulates the see-through part 80, and thus, the all the operations are not completed, the just previous screen may be continuously displayed through the see-through part 80.

For example, in the state in which the refrigerating compartment door 20 is opened, when the refrigerating compartment door 20 is closed in the state in which the set time does not elapse while confirming the recipe by converting the see-through part 80 into the turn-on state by the user, the see-through part 80 may be maintained in the screen state in which the recipe is outputted as ever.

Figure 39:
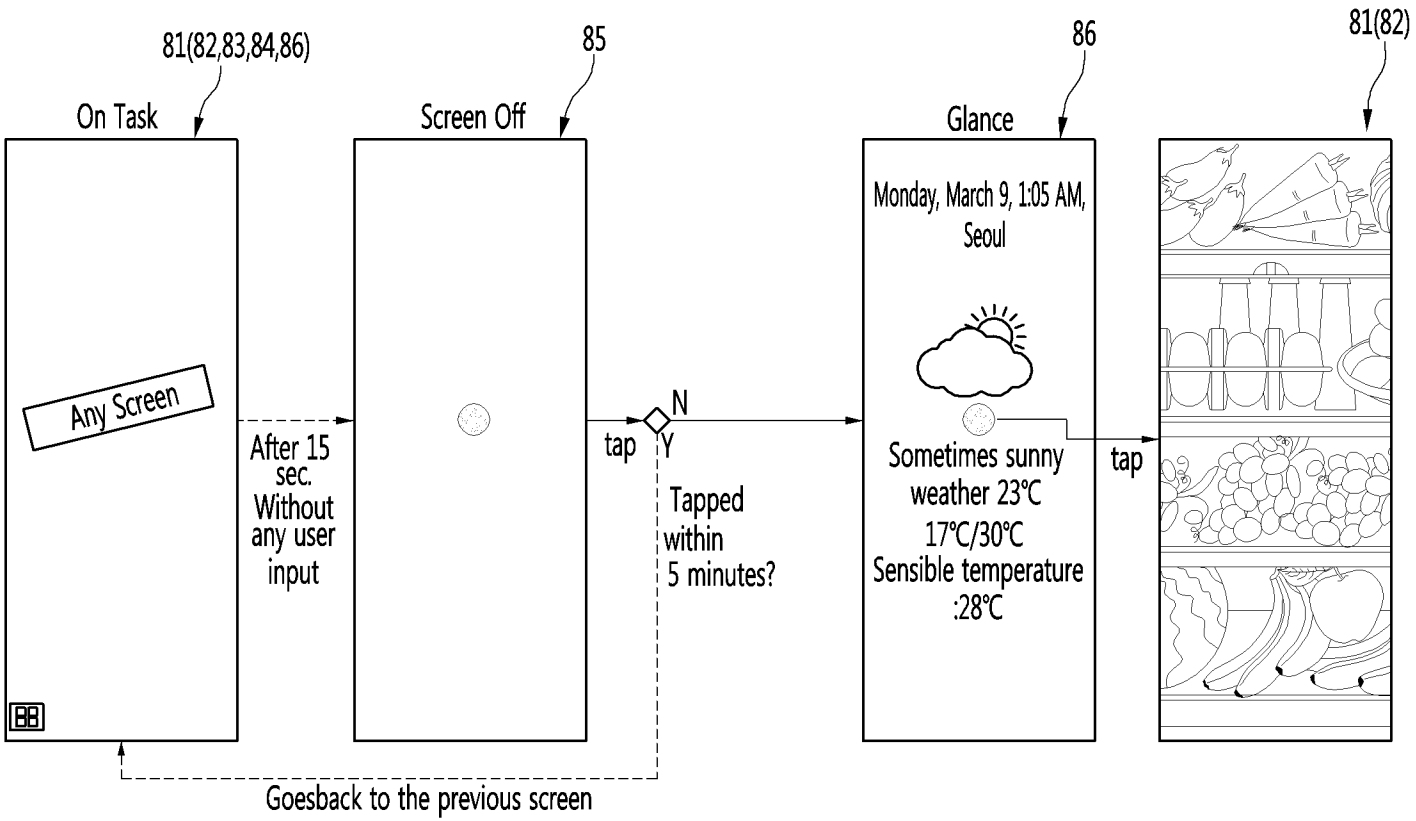
FIG. 39 is a view sequentially illustrating a state change of the see-through part according to whether the set time elapses.

FIG. 39 is a view sequentially illustrating a state change of the see-through part according to whether the set time elapses.

As illustrated in the drawing, when the user's manipulation is not performed until the set time (for example, about 15 seconds) elapses in the state in which the see-through part 80 according to an embodiment is in one of the first state 81, the second state 82, the third state 83, the fourth state 84, and the sixth state 86 except for the fifth state 85, the see-through part 80 may become the fifth state 85 in which the see-through part 80 is turned off.

Also, when the user's manipulation is inputted again within the set time (for example, about 5 minutes) after the see-through part 80 becomes the fifth state 85, the see-through part 80 returns to the state in which the final screen state is displayed. That is, the operation performed in the previous state may be continuously performed, or the previous information may be continuously confirmed.

On the other hand, after the see-through part 80 becomes the fifth state 85, when the user's manipulation is inputted after the set time (for example, about 5 minutes), the see-through part 80 is turned on again.

When the see-through part 80 is turned on again, the see-through part 80 may become the sixth state 86. When the refrigerator 1 is connected to the network, in the sixth state, the information may be received from the network to output information such as weather. Alternatively, in the sixth state 86, the other information received from the network that is set in the glance state may be displayed.

When the user performs additional manipulation in the state in which the see-through part 80 is converted into the sixth state 86, the see-through part 80 may be converted into the first state 81 or the second state 82.

Also, when the see-through part 80 is turned on again, if the refrigerator 1 is not connected to the network, the see-through part 80 may be converted into the smart instaview state, i.e., the first state 81 and the second state 82. That is, the see-through part 80 may be converted into the first state 81 and the second state 82 to see the door storage space 41 and output the screen through the display 62 and thereby to stand by in the user's manipulation state.

Figure 40:
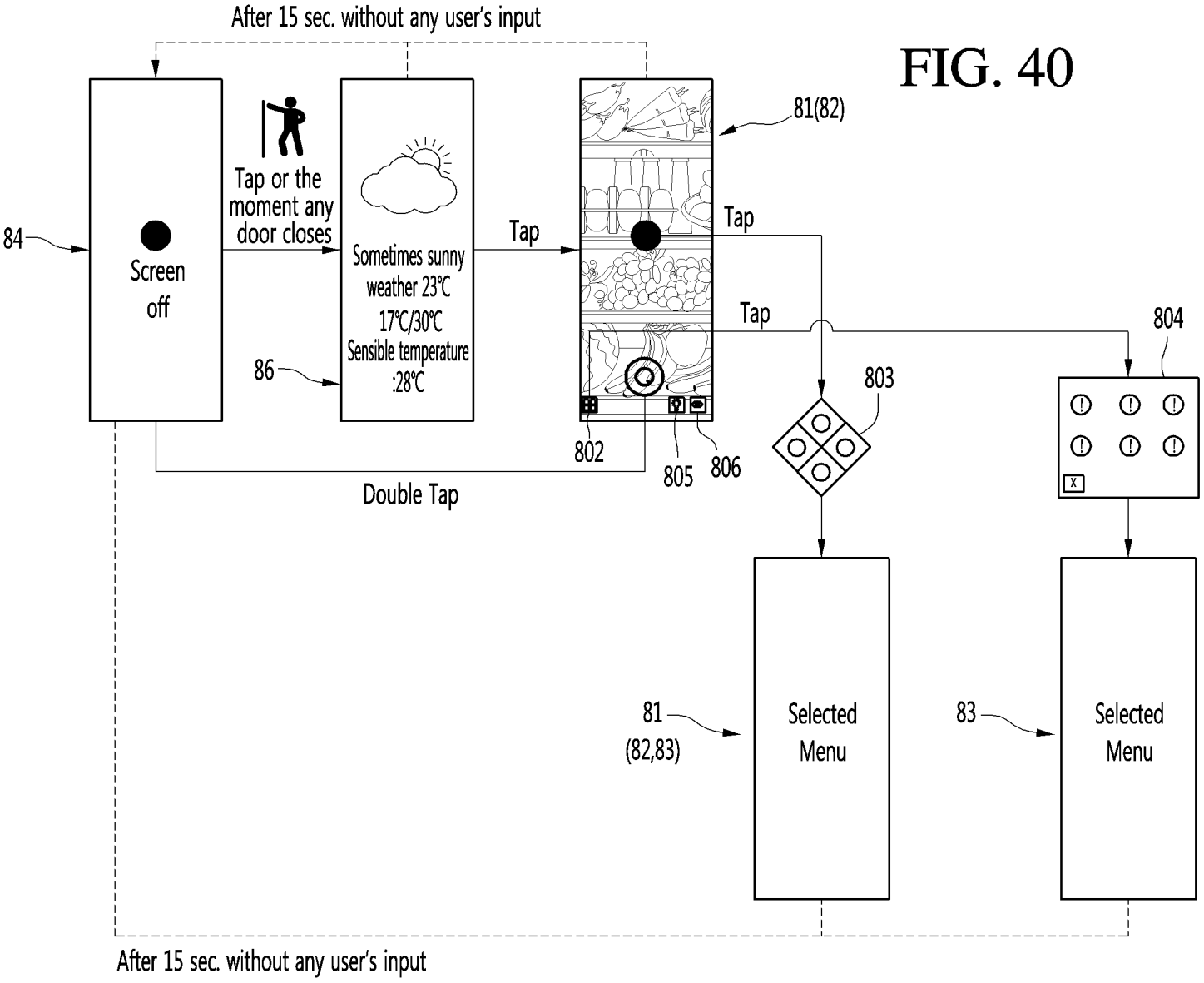
FIG. 40 is a view sequentially illustrating a state change according to the entire manipulation of the see-through part.

FIG. 40 is a view sequentially illustrating a state change according to the entire manipulation of the see-through part.

As illustrated in the drawing, in the refrigerating compartment door 20 is closed, the see-through part 80 may be converted into the sixth state 86 by the manipulation input through the manipulation of the manipulation input unit 16 of the user or the manipulation of the transparent panel assembly 60 to transmit the information to the user through the preset screen.

Also, when the user's manipulation is additionally inputted, the see-through part 80 may become the first state 81 or the second state 82 to visualize the door storage space 41 and output the screen.

Particularly, the main menu icon 802, the brightness adjustment icon 805, and the clear icon 806 may always outputted on the lower end of the see-through part 80 by using the display 62. In the first state 81 or the second state 82, the main menu icon 802, the brightness adjustment icon 805, and the clear icon 806 may always exposed so that the user manipulates the icons at any time.

When the main menu icon 802 is manipulated, a main menu pop-up window is popped up, and a desired menu may be selected through the main menu pop-up window 804. When the desired menu is selected on the main menu pop-up window 804, the screen of the see-through part 80 may be converted into the selected screen. The screen capable of being selected on the main menu pop-up window 804 may be one screen in the first state 81, the second state 82, and the third state 83. This will be described below in more detail.

When any position, on which other output icons are not displayed is pushed in the state in which the see-through part 80 is outputted in the first state 81 or the second state 82, is pushed, a situation menu pop-up window 803 may be popped up. Thus, a desired menu may be selected through the situation menu pop-up window 803. When the desired menu is selected on the situation menu pop-up window 803, the screen of the see-through part 80 may be converted into the selected screen. The screen capable of being selected on the situation menu pop-up window 803 may be one screen in the first state 81, the second state 82, and the third state 83. This will be described below in more detail.

When any position on which other output icons are not displayed in the state in which the see-through part 80 is outputted in the first state 81 or the second state 82, is continuously pushed, the see-through part 80 may be converted from the first state 81 or the second state 82 into a turn-off state, i.e., the fifth state 85.

Also, when the set time (for example, about 15 seconds) elapses without additional manipulation in the first state 81, the second state 82, and the third state 83, which are converted on the see-through part 80, the screen of the see-through part 80 may be converted into the turn-off state, i.e., the fifth state 85.

FIGS. 41A to 41E are views of a screen displayed when a situation menu is manipulated.

As illustrated in the drawing, when the situation menu pop-up window 803 is manipulated, the screen of the see-through part 80 may be one of the first state 81, the second state 82, and the third state 83. Also, the screens outputted on the situation menu pop-up window 803 relate to output icons 90 outputted on the screens in the first state 81 and the second state 82. The icons may be outputted in the form of labels, stickers, and the like so that position manipulation movement of the user is enabled, and the information is recorded and corrected.

Figure 41A:
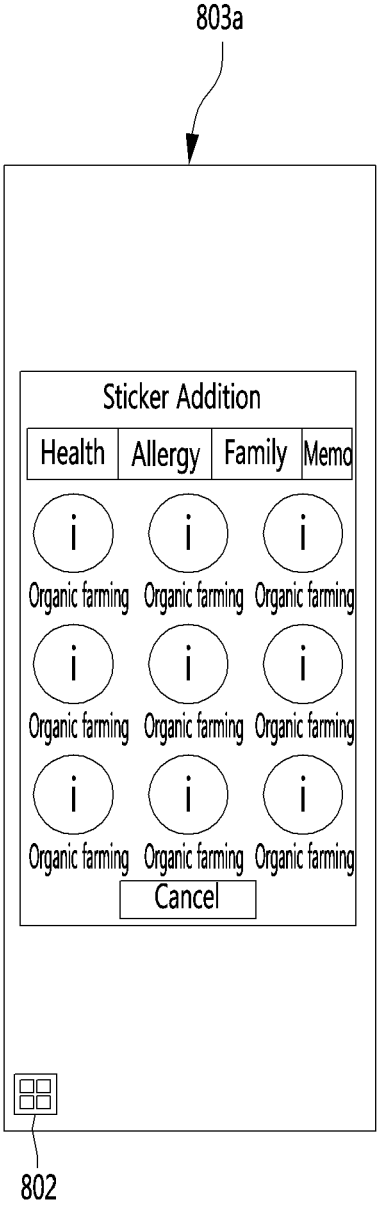
FIGS. 41A to 41E are views of a screen displayed when a situation menu is manipulated.
Figure 41B:
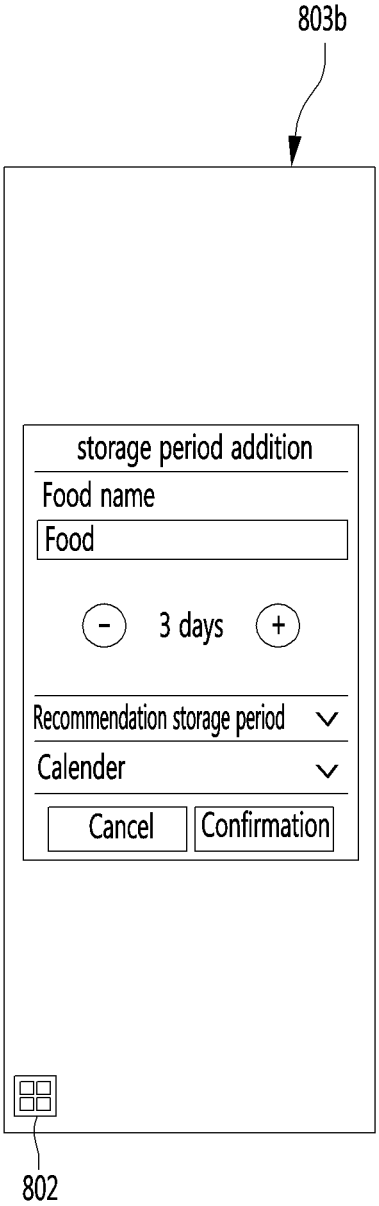
Figure 41C:
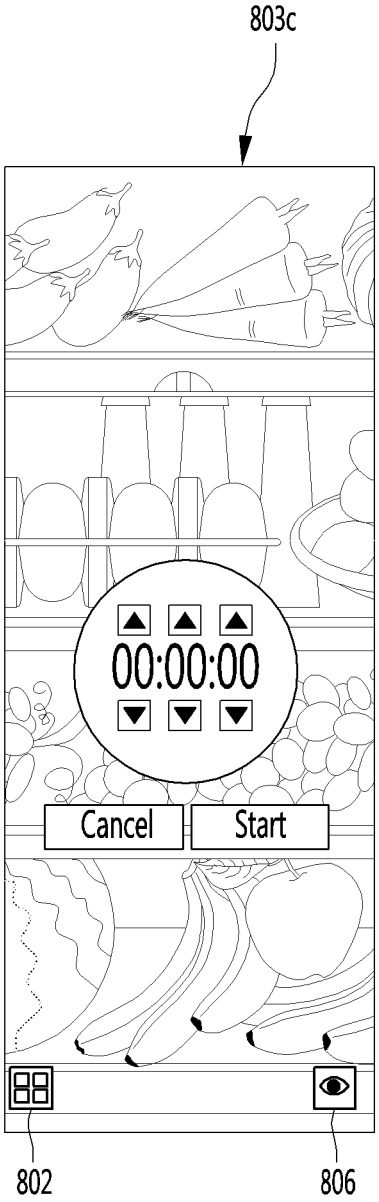
Figure 41D:
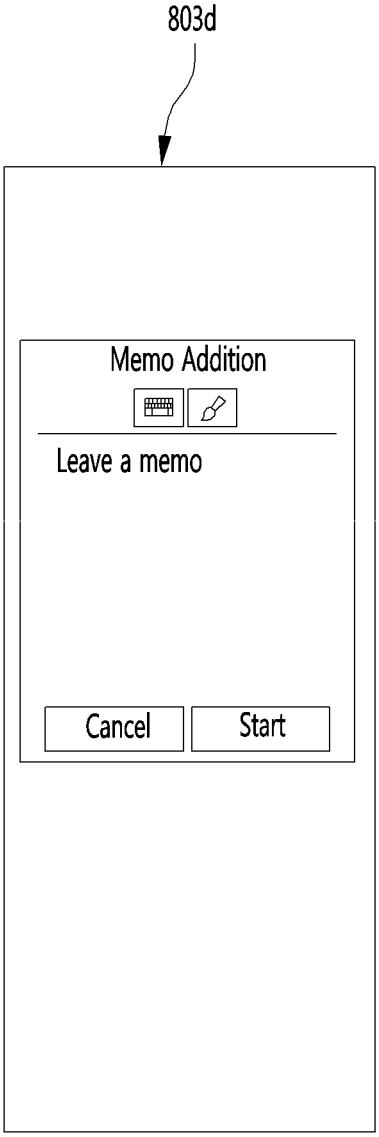
Figure 41E:
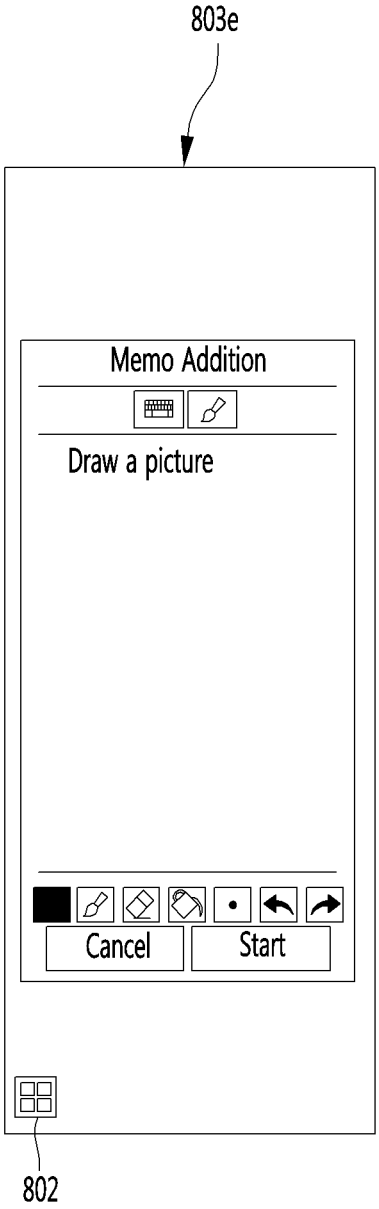

In more detail, FIG. 41A is a sticker generation screen 803*a* by which kinds and categories of the labels or stickers, which are capable of being outputted through the see-through part 80, are determined. Also, FIG. 41B is a storage period generation screen 803*b* for outputting a storage period of stored food. Also, FIG. 41C is a timer period generation screen 803*c* for outputting a set time alert. Also, FIG. 41D is a memo generation screen 803*d* for outputting a text-based memo inputted by the user. Also, FIG. 41E is a picture memo generation screen 803*e* for outputting a picture-based memo inputted by the user.

FIGS. 42A to 42E are views of a screen displayed when a main menu is manipulated.

As illustrated in the drawing, when the main menu pop-up window 804 is manipulated, the screen of the see-through part 80 may become the third state 83. Also, the screens outputted on the main menu pop-up window 804 do not relate to generation and movement of the output icons 90 outputted on the screens in the first state 81 and the second state 82. The screens include screens on which the processing and operation are mainly enabled in the third state 83.

Figure 42A:
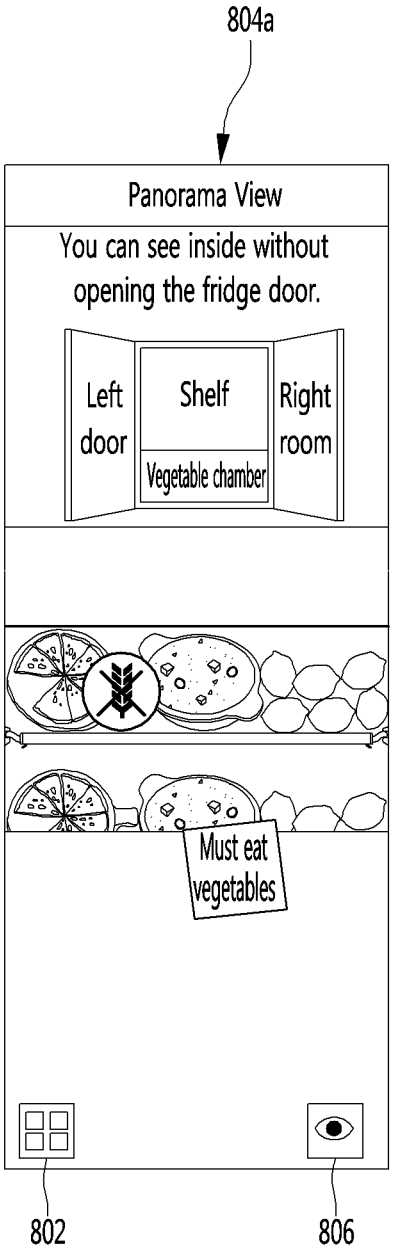
FIGS. 42A to 42E are views of a screen displayed when a main menu is manipulated.
Figure 42B:
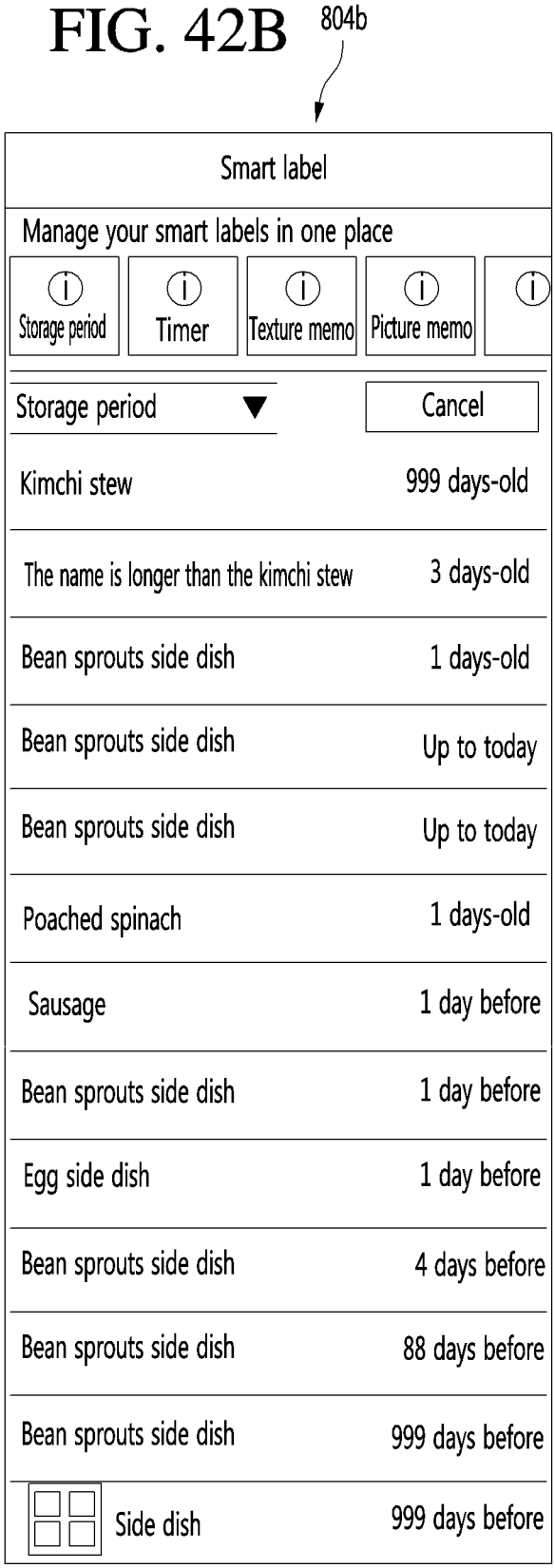
Figure 42C:
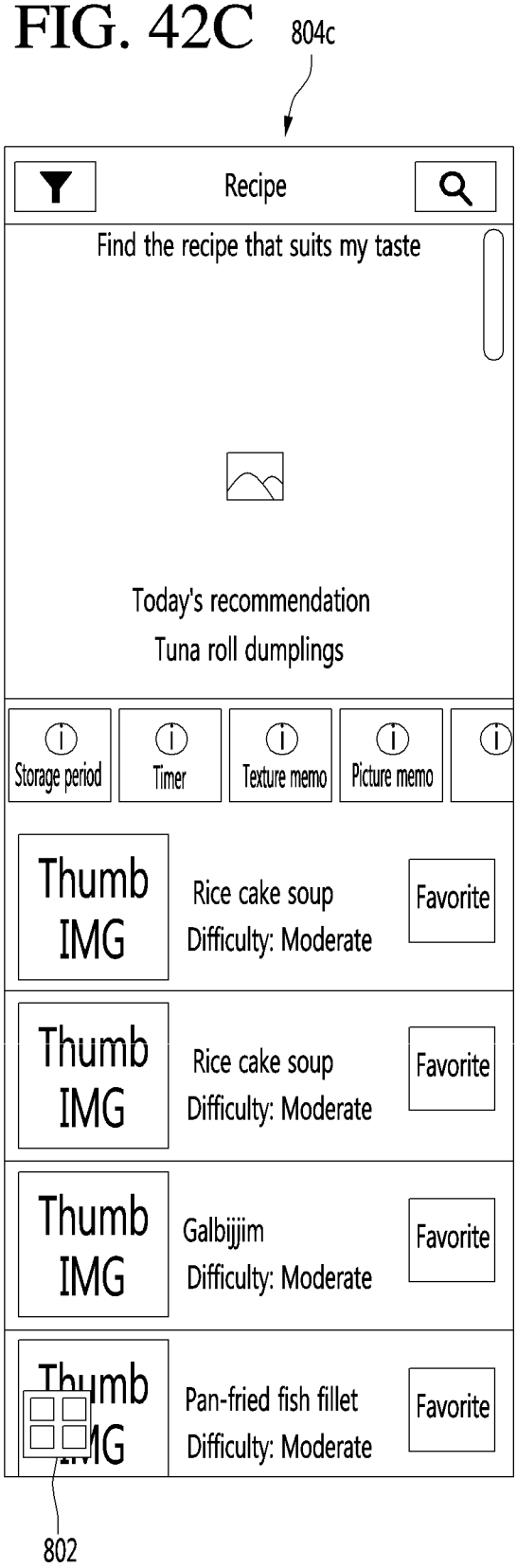
Figure 42D:
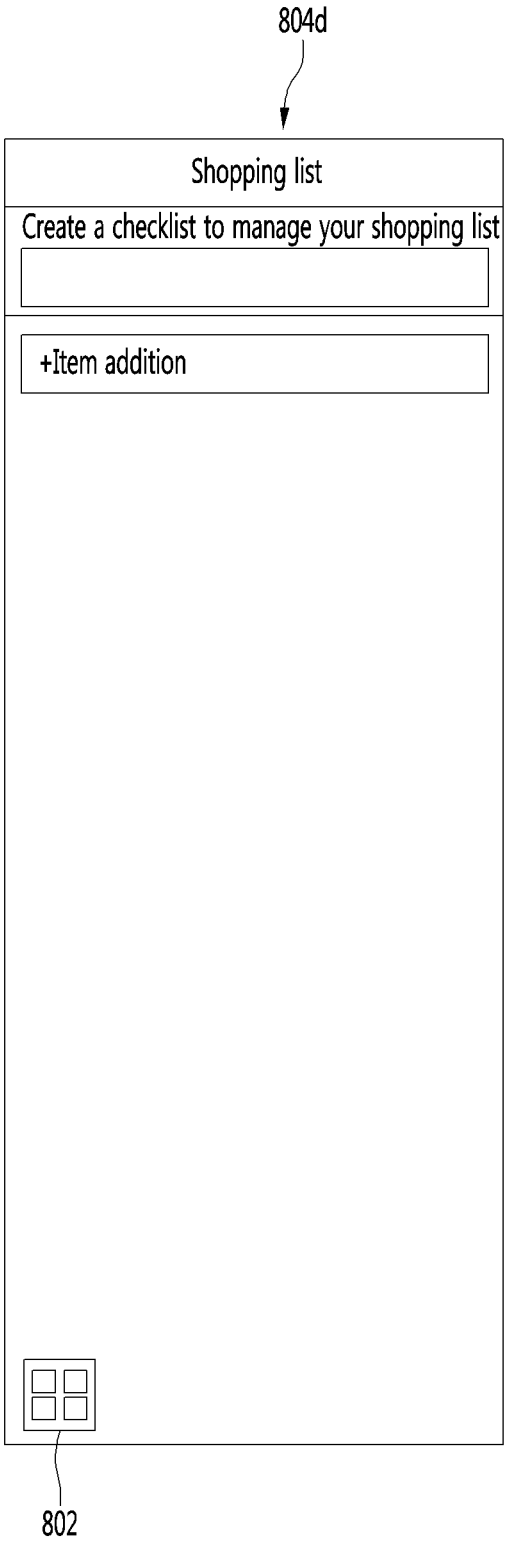
Figure 42E:
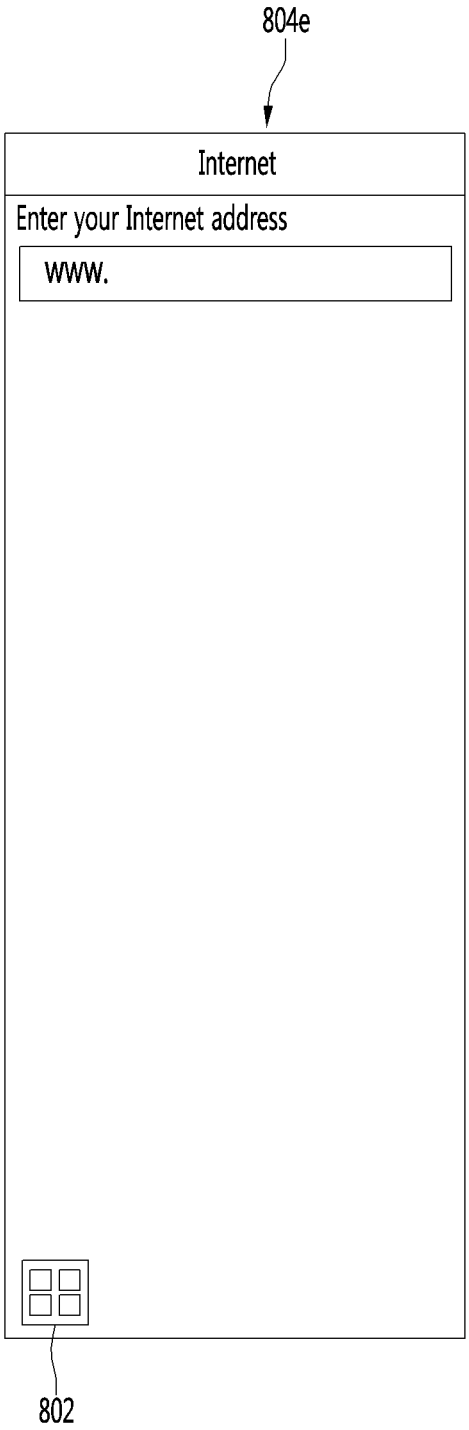

In more detail, FIG. 42A is a panorama view screen 804*a*, i.e., a screen for displaying and editing photographs of food within the refrigerator, which are photographed by an interior camera 115. Also, FIG. 42B is a smart label screen 804*b*, i.e., a screen on which the entire output icons 90 is listed and also is capable of being edited and deleted. Also, FIG. 42C is a recipe selection screen 804*c*, i.e., a screen on which a list of recipes capable of being outputted through the see-through part is displayed and edited. Also, FIG. 42D is a shopping list screen 804*d*, i.e., a screen on which a list to be shopped is managed. Also, FIG. 42E is an Internet screen 804*e*, i.e., a screen on which the user is accessible through an Internet address.

Figure 43:
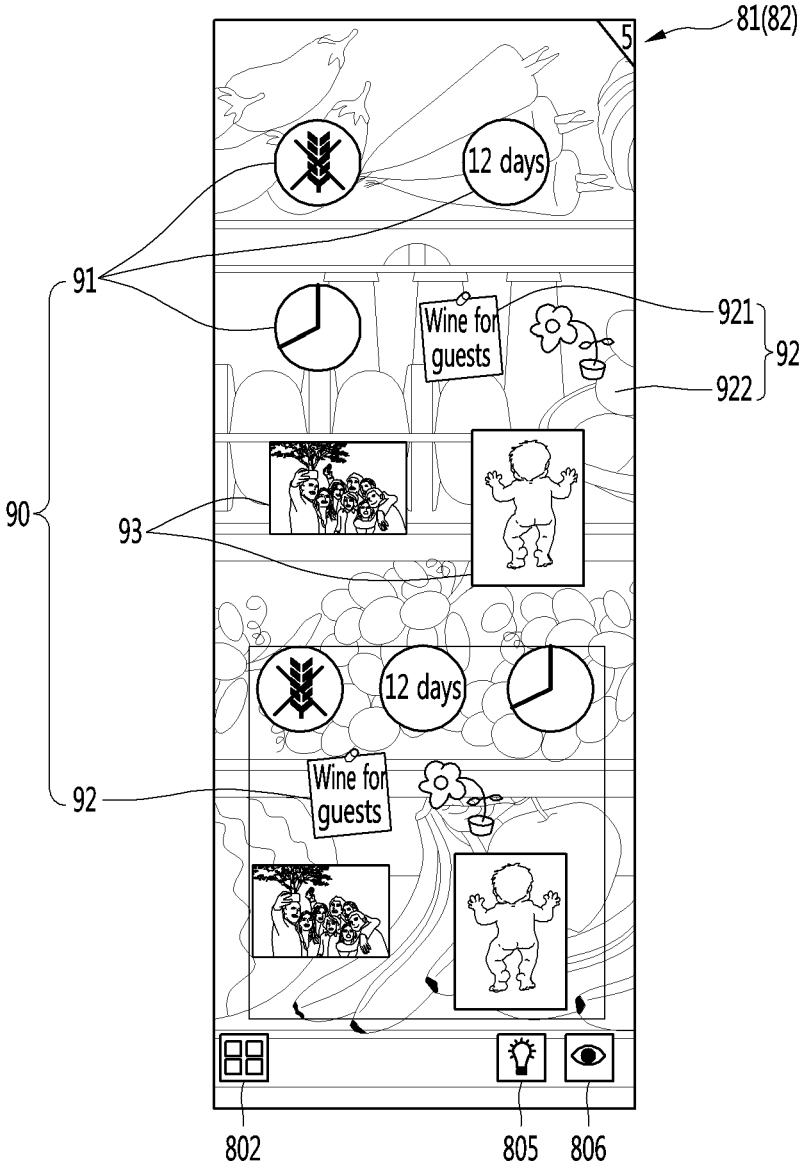
FIG. 43 is a view illustrating a configuration of a screen that is capable of being outputted and manipulated in a visible state of the see-through part.

FIG. 43 is a view illustrating a configuration of a screen that is capable of being outputted and manipulated in a visible state of the see-through part.

As illustrated in the drawing, an object to be displayed when the see-through part 80 is in the first state 81 or the second state 82 may include the main menu icon 802, the brightness adjustment icon 805, the clear icon, and the output icons 90.

The main menu icon 902 may be always generated in the first state 81, the second state 82, the third state 83, and the fourth state 84 to activate the main menu pop-up window 804 through the user's manipulation.

Also, the brightness adjustment icon 805 may adjust brightness of the screen displayed on the see-through part 80. The clear icon 806 may collectively hide or show the output icons displayed on the see-through part 80. The brightness adjustment icon 805 and the clear icon 806 will be described below in more detail.

The output icon 90 may include a label 91 on which a kind of food, a storage period timer, and the like are outputted in a circular shape, an image sticker 93 on which a photograph image is outputted in the form of a rectangular shape, and a memo sticker 92 constituted by a picture memo or a text memo 921. Also, the output icon 90 may move in position through the drag and also be edited and deleted by the user's selection.

Particularly, in the case of the label 91, the shape of the icon is schematically displayed in a non-manipulation state. However, when the label 91 is pushed, specific information such as information on the specific type of food, nutrition, recipe, date information such as date of purchase, shelf life, shelf life, time of set timer and remaining time may be more particularly confirmed.

Figure 44:
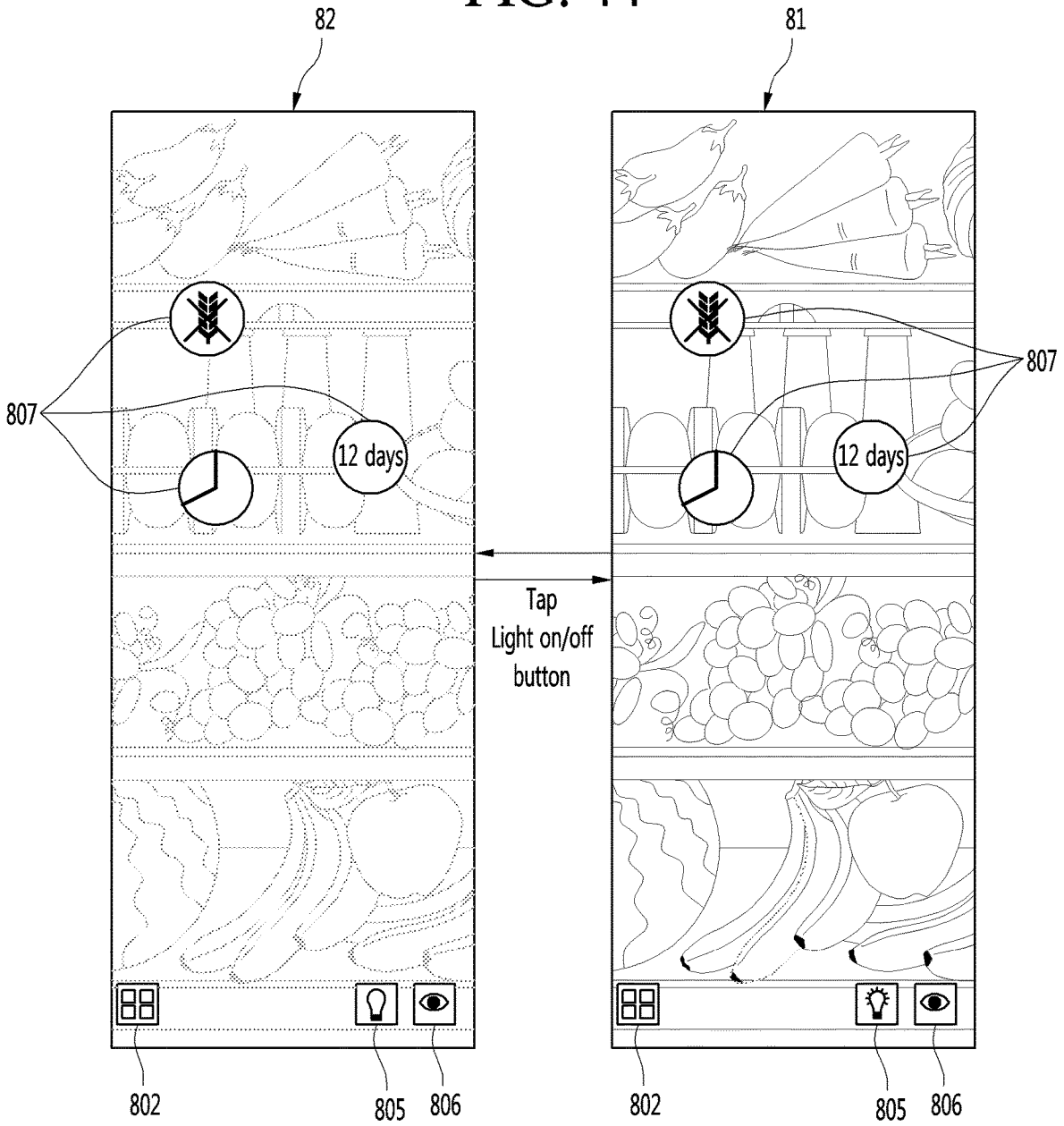
FIG. 44 is a view illustrating a state in which an interior visualization level of the see-through part is adjusted.
Figure 45:
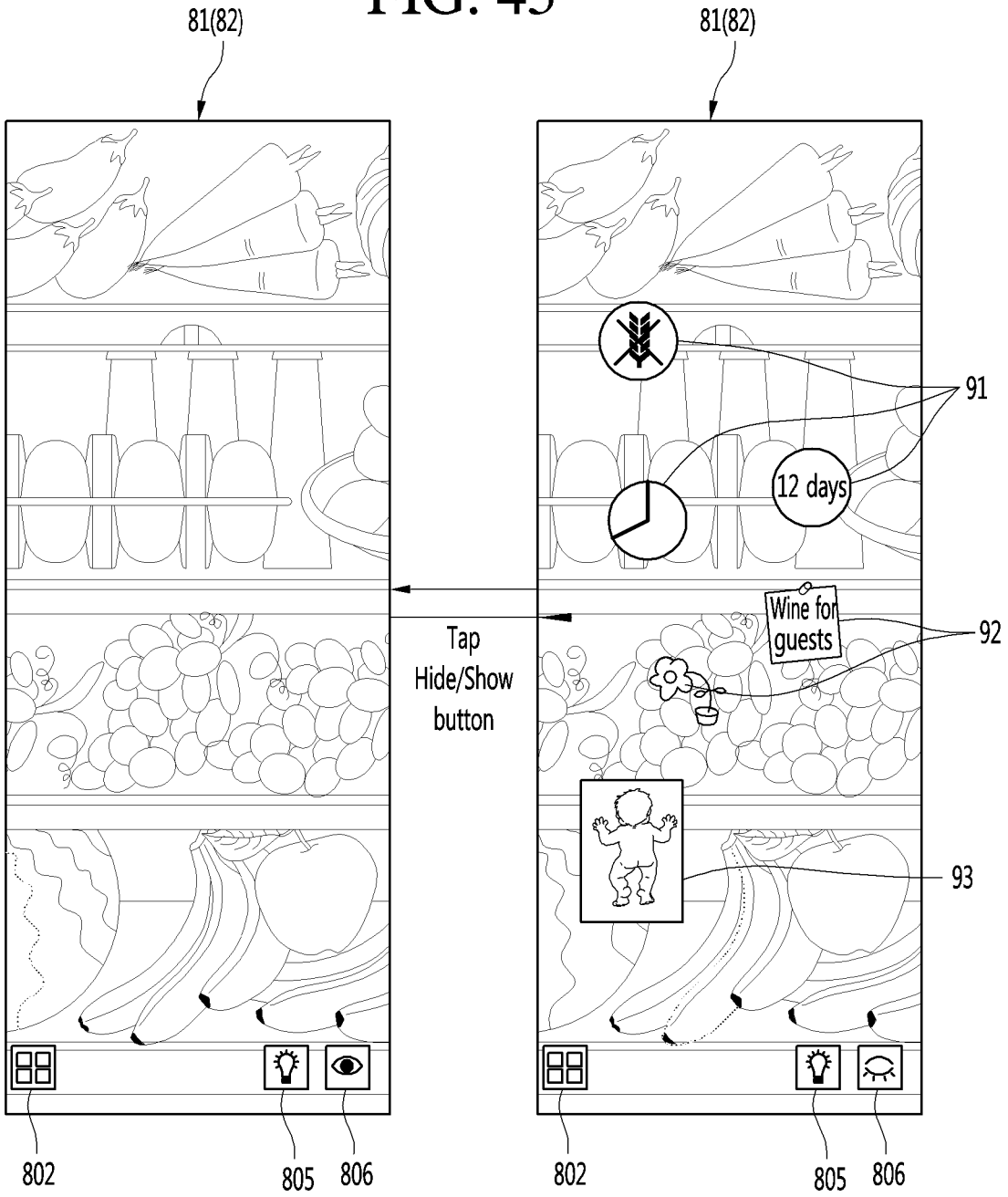
FIG. 45 is a view illustrating a state in which activation of an output state in the see-through part is adjusted.

FIG. 44 is a view illustrating a state in which an interior visualization level of the see-through part is adjusted. FIG. 45 is a view illustrating a state in which activation of an output state in the see-through part is adjusted.

As illustrated in the drawing, when the see-through part 80 is in the first state 81 and the second state 82, the brightness adjustment icon 805 and the clear icon 806 may be always exposed on the lower end or any area of the see-through part 80.

The brightness adjustment icon 805 may indicate a current brightness state, and the brightness or transparency of the see-through part 80 may be adjusted when the brightness adjustment icon 805 operates. For example, as illustrated in FIG. 44, when the brightness adjustment icon 805 is turned off, the see-through part 80 may be opaque somewhat like the second state 82. Thus, the food stored in the door storage space 41 may be seen only in silhouette.

In this state, when the brightness adjustment icon 805 is manipulated, the display light 68 may be turned off, and the see-through part 80 may increase in transparency like the first state 81. Thus, the food stored in the door storage space 41 may be more clearly seen. Also, the see-through part 80 may be converted into the first state 81, and the brightness adjustment icon 805 may be converted into the turn-on state. Thus, the user may easily identify the food.

The brightness of the see-through part 80 may be adjusted in multi stages, but two stages. In this case, the brightness may be adjusted by selective combination of the door light 57 and the interior light 121 or by adjusting the door light 57 itself.

The clear icon 806 may collectively hide or display the output icons 90 displayed through the current see-through part 80. For example, as illustrated in FIG. 14, when the clear icon 806 is turned off, all the output icons 90 are hidden on the see-through part 80. Thus, only the main menu icon 802, the brightness adjustment icon 805, and the clear icon 806 may be outputted through the see-through part 80. In this state, when it is intended to confirm the inside of the door storage space 41 through the see-through part 80, if the stored food is not well seen by being hidden by the output icons, this case may be used.

Although the interrupted output icon 90 is dragged to move in position, in the case in which the output icons are too many, the output icons may be collectively hidden, and then, the door storage space 41 may be confirmed. Then, the icons may be collectively outputted again to their original portions so as to be conveniently used. Also, a case in which the see-through part 80 is neatly seen may be used.

In this state, if it is intended to see the output icons 90 again, the clear icon may be manipulated. When the clear icon 806 is manipulated, the output icons 90 may be outputted again to the previous positions before the output icons 90 are hidden. Also, the clear icon 806 may be converted into the turn-on state.

Figure 46:
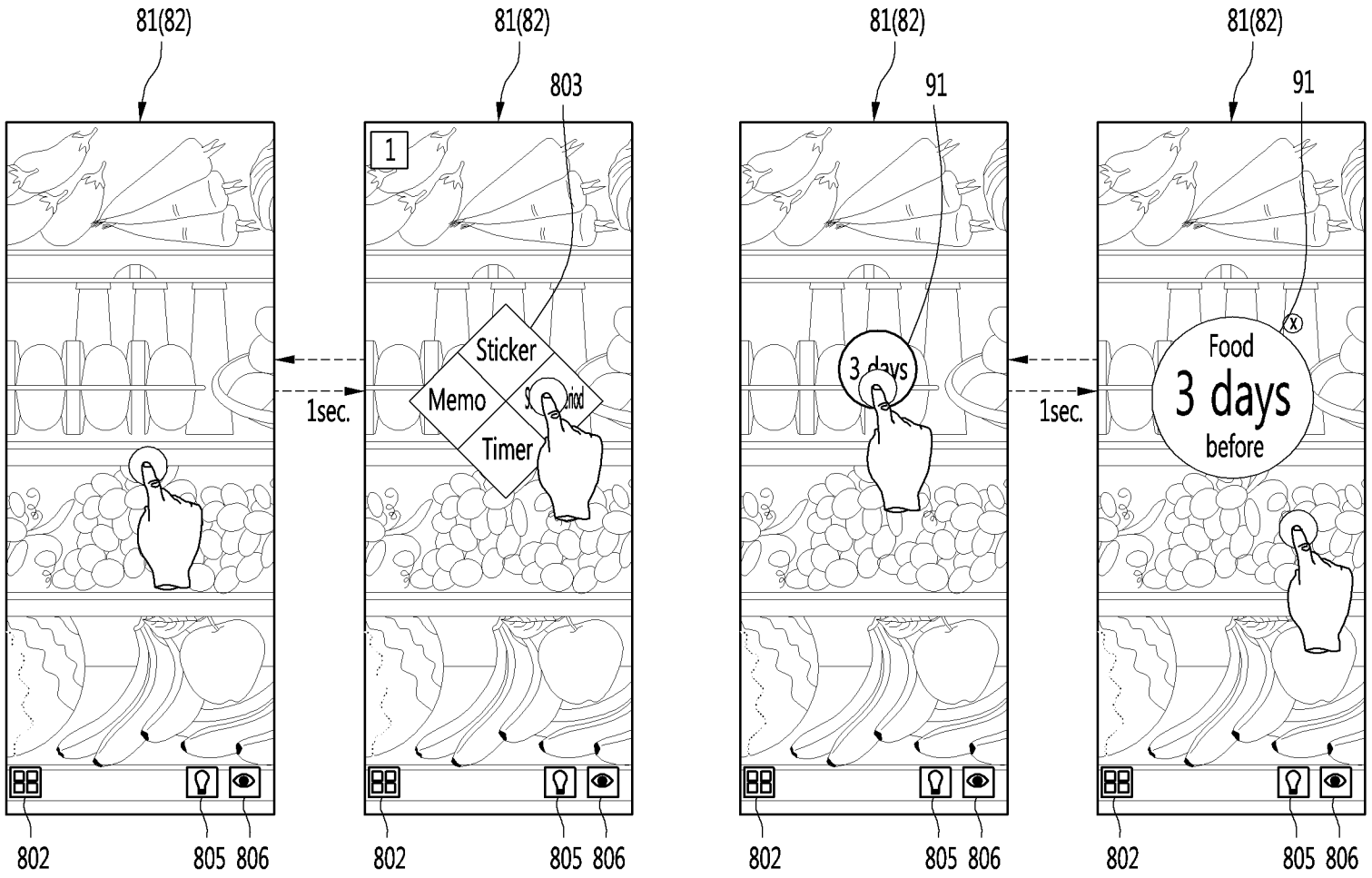
FIG. 46 is a view sequentially illustrating a state in which the situation menu is manipulated through the see-through part.
Figure 47:
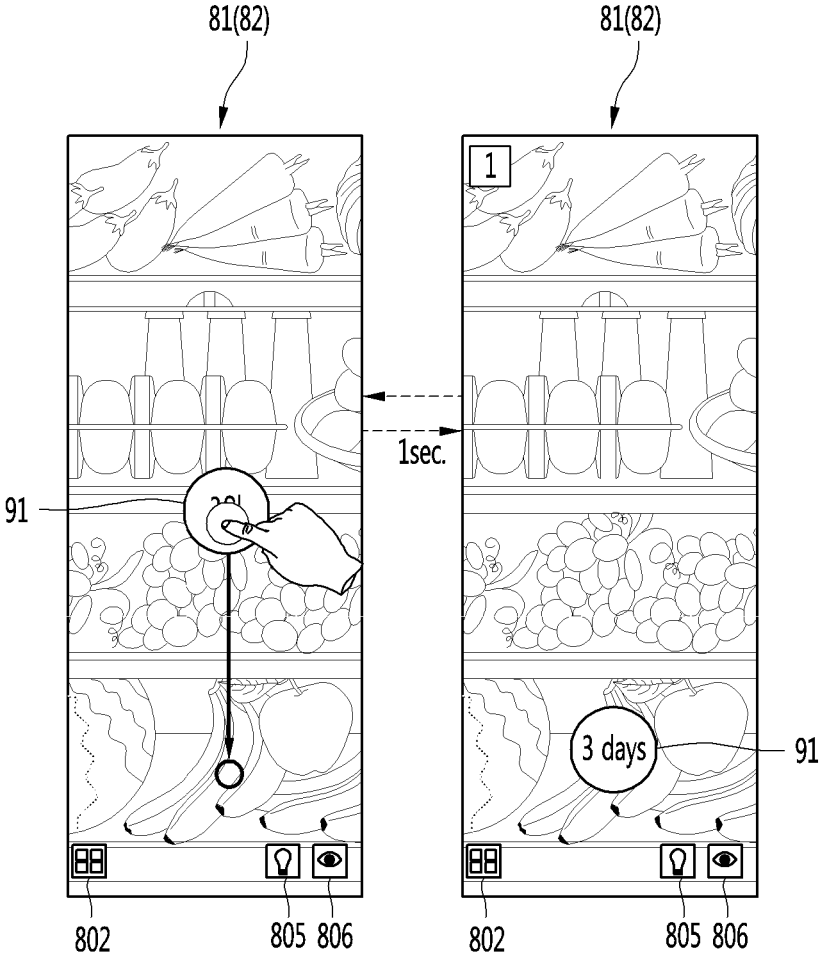
FIG. 47 is a view illustrating a movement manipulation state of a label displayed on the see-through part.
Figure 48:
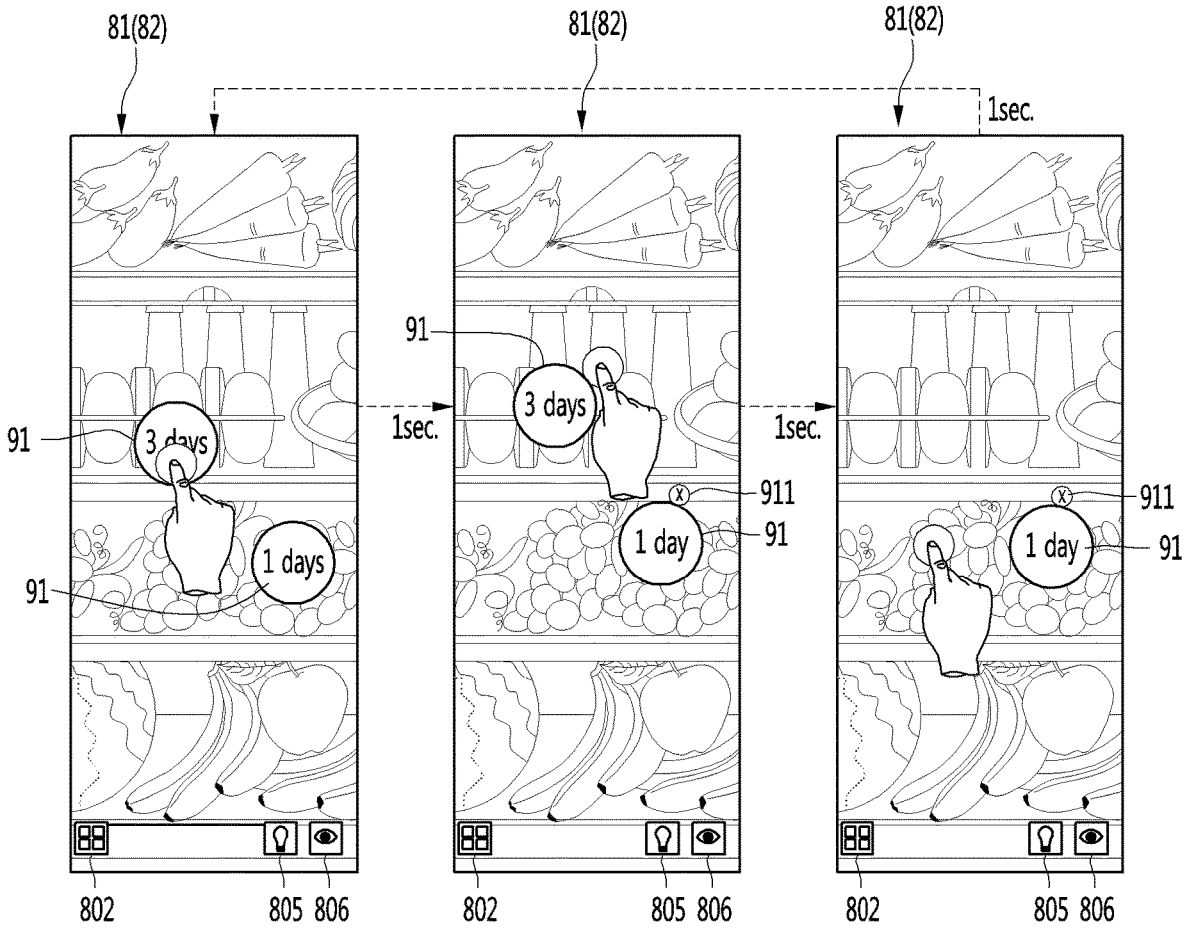
FIG. 48 is a view illustrating a deletion manipulation state of a label displayed on the see-through part.

FIG. 46 is a view sequentially illustrating a state in which the situation menu is manipulated through the see-through part. FIG. 47 is a view illustrating a movement manipulation state of a label displayed on the see-through part. FIG. 48 is a view illustrating a deletion manipulation state of a label displayed on the see-through part.

As illustrated in FIG. 46, when the see-through part 80 is in the first state 81 or the second state 82, if an any empty area of the see-through part 80 is pushed for the set time (for example, about 1 second), the situation menu pop-up window 803 may be popped up, and the user may select a desired menu through the situation menu pop-up window 803.

Also, the storage period may be clicked to set a storage period, and then, the storage period label 91 may be outputted on the see-through part 80. Also, when the outputted label 91 is pushed again for the set time (for example, about 1 second), the label 91 may be in an editable state.

In this state, when the other empty area except for the label 91 is pushed for the set time (for example, about 1 second), the label 91 may be released from the editable state.

Also, as illustrated in FIG. 47, when the label 91 displayed on the see-through part 80 is dragged in the state of being pushed for the set time (for example, about 1 second), the label 91 may move to the dragged point. Thus, the user generates the label 91, and then, the label 91 may move to a desired position.

Also, as illustrated in FIG. 48, when the label 91 displayed on the see-through part 80 is pushed for the set time (for example, about 1 second), the label 91 may be edited, and thus, an auxiliary label 91 may be generated on one side of the label 91. Here, when a plurality of labels are outputted on the see-through part 80, the auxiliary labels 91 may be formed on all the labels 91. Also, when the user pushes the auxiliary label 91 for the set time (for example, about 1 second), the label 91 may be deleted. Also, when the other empty area on the see-through part 80 is pushed for the set time (for example, about 1 second), the label 91 may be released from the editable state.

Figure 49:
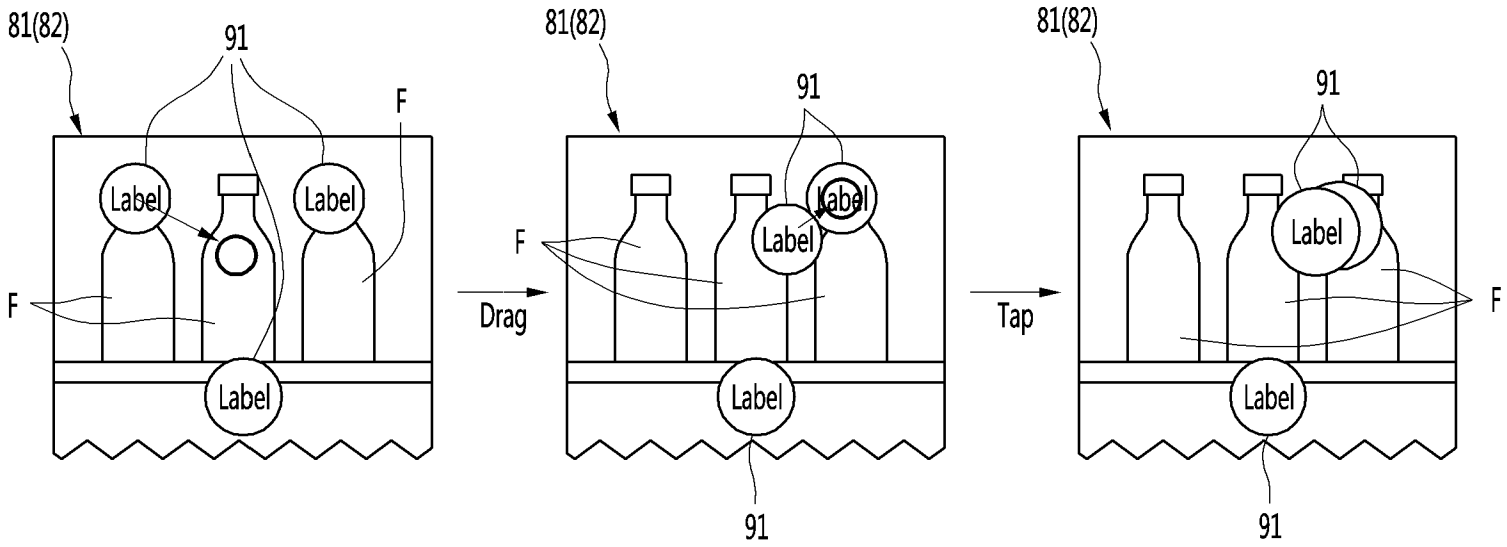
FIG. 49 is a view illustrating a manipulation state in which labels displayed on the see-through part overlap each other.
Figure 50:
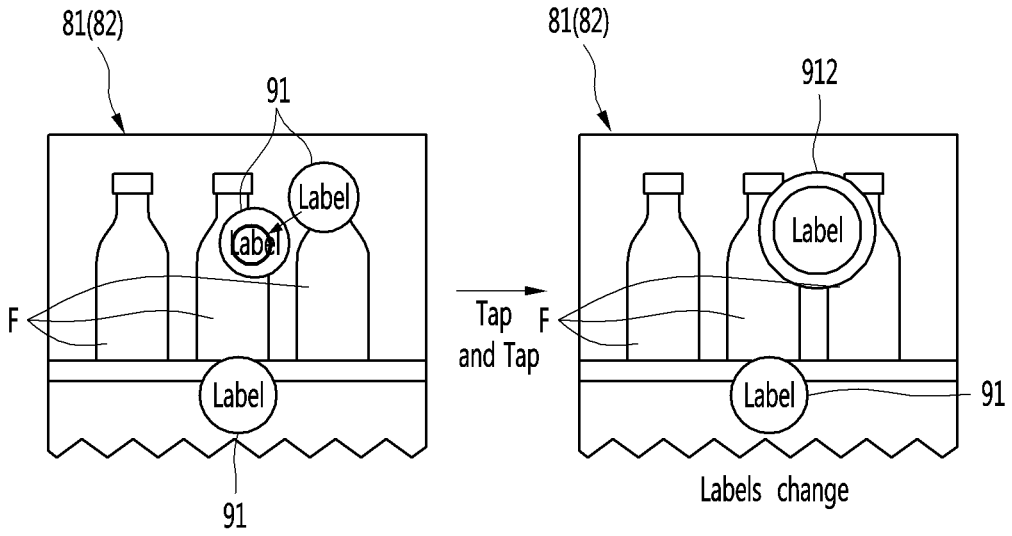
FIG. 50 is a view illustrating a manipulation state in which labels displayed on the see-through part are merged with each other.

FIG. 49 is a view illustrating a manipulation state in which labels displayed on the see-through part overlap each other. FIG. 50 is a view illustrating a manipulation state in which labels displayed on the see-through part are merged with each other.

As illustrated in FIG. 49, the label 91 displayed on the see-through part 80 may be dragged by the user and then disposed at a desired position. Here, when the plurality of labels 91 are disposed at the same position, the labels 91 may be disposed to overlap each other.

In the labels 91 overlapping each other, the label 91 dragged later may be seen at an upper side, the previous label 91 may be seen at a lower side in the overlapping state.

Also, as illustrated in FIG. 50, when one label 91 is dragged to completely overlap the other label 91 in the state in which the plurality of labels 91 are outputted, the plurality of labels 91 overlapping each other may be merged with each other to form one label 912. Here, the merged label 912 may be displayed in a shape different from that of the other label 91 so that the user easily identifies the labels 91. Although the labels 912 are merged with each other, when the label 912 is selected to show inner information, all details of the labels 91 before merged may be confirmed.

Figure 51:
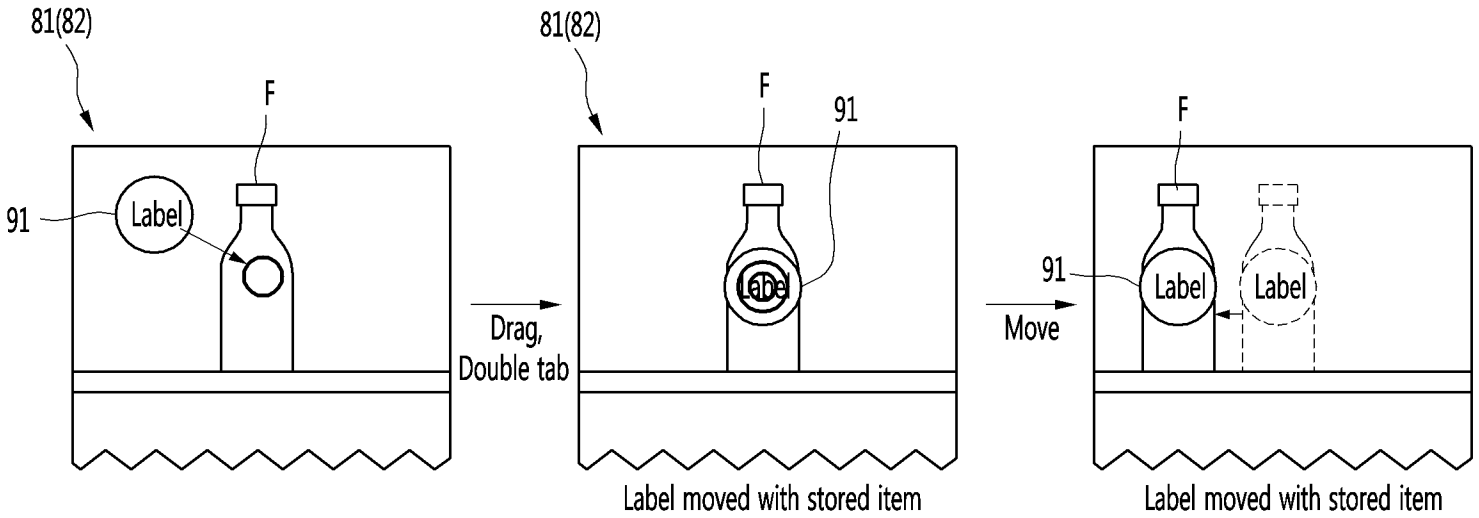
FIG. 51 is a view illustrating a state in which the labels displayed on the see-through part match each other and move.
Figure 52:
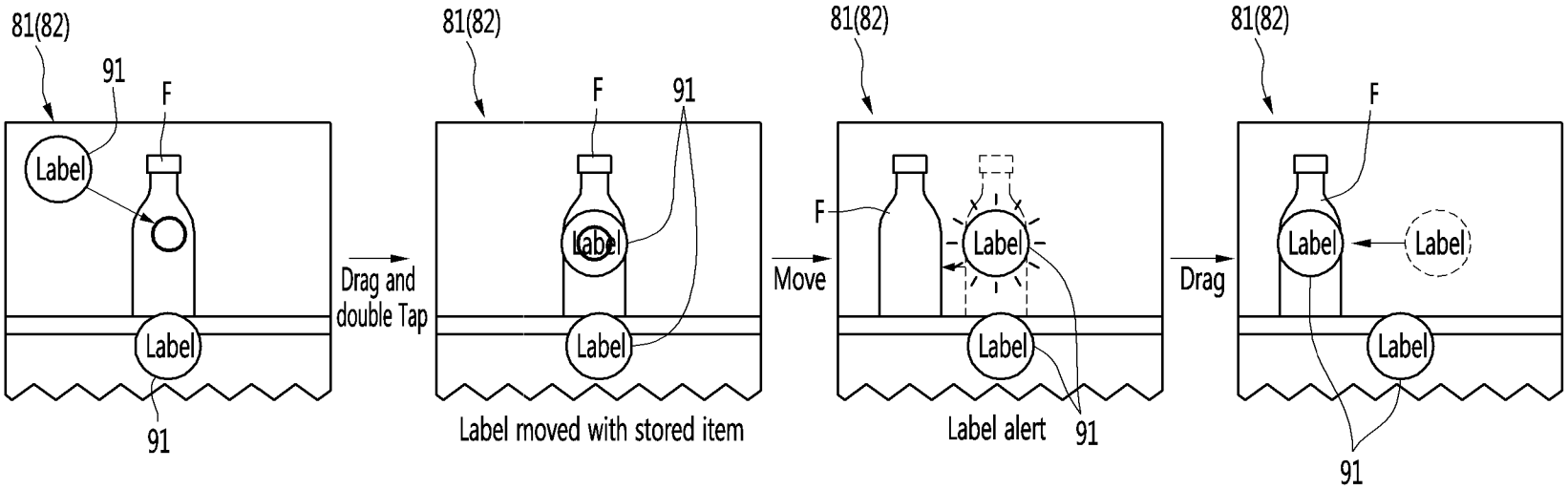
FIG. 52 is a view illustrating the labels displayed on the see-through part match and are alerted.

FIG. 51 is a view illustrating a state in which the labels displayed on the see-through part match each other and move. FIG. 52 is a view illustrating the labels displayed on the see-through part match and are alerted.

As illustrated in the drawing, the user may drag the label 91 outputted on the see-through part 80 to set a position of the label 91. Particularly, when the see-through part 80 is in the first state 81 and the second state 82, in which the door storage space 41 is seen, food F within the door storage space 41 may be seen. Thus, the label 91 may move to a position corresponding to the position of the food F within the door storage space 41, which is seen through the see-through part 80, and necessary information may be stored.

Also, the position of the food F within the door storage space 41 may be always or periodically photographed by a camera 115 within the refrigerator 1. In this case, when the position of the label 91 matches the food, if the stored position of the food F is changed, the position change of the food may be detected, and then, the label 91 may automatically move to the changed position of the food F, or the position change of the food F may be informed to the user so that the user reset the position of the label 91.

In detail, as illustrated in FIG. 51, when the label 91 is continuously pushed after the label 91 is dragged to be located at a position corresponding to that of the food F, the position of the food F and the position of the label 91 may match each other.

In this state, when the position of the food F moves, the moving position of the food F may be detected by the camera 115, and thus, the label 91 may automatically move to the moving position of the food F. Also, when the position of the food F is not recognized because the food F is taken out, the label 91 may be automatically hidden.

Also, as illustrated in FIG. 52, when the label 91 is continuously pushed after the label 91 is dragged to be located at a position corresponding to that of the food F position of the food F and the position of the label 91 may match each other.

In this state, when the position of the food F moves, the moving position of the food F may be detected by the camera 115, and thus, a state in which the position of the label 91 is different from the moving position of the food F may be informed. Here, the label 91 may be flickered or changed in color to be informed to the user. When the user recognizes that the position of the label 91 is different, the user may drag the label 91 again to move to the position corresponding to the food F and thereby to match the position of the food F.

Figure 53:
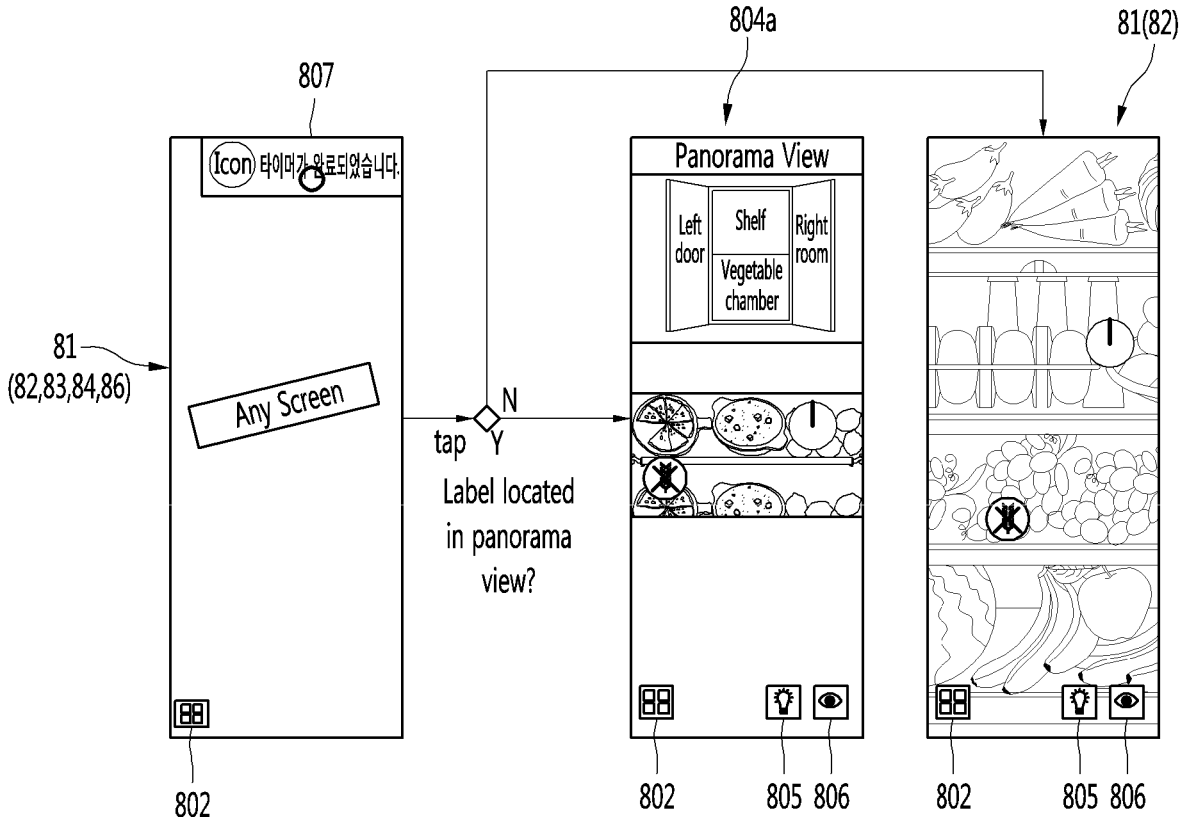
FIG. 53 is a view illustrating a manipulation state the alert is popped up on the see-through part.
Figure 54:
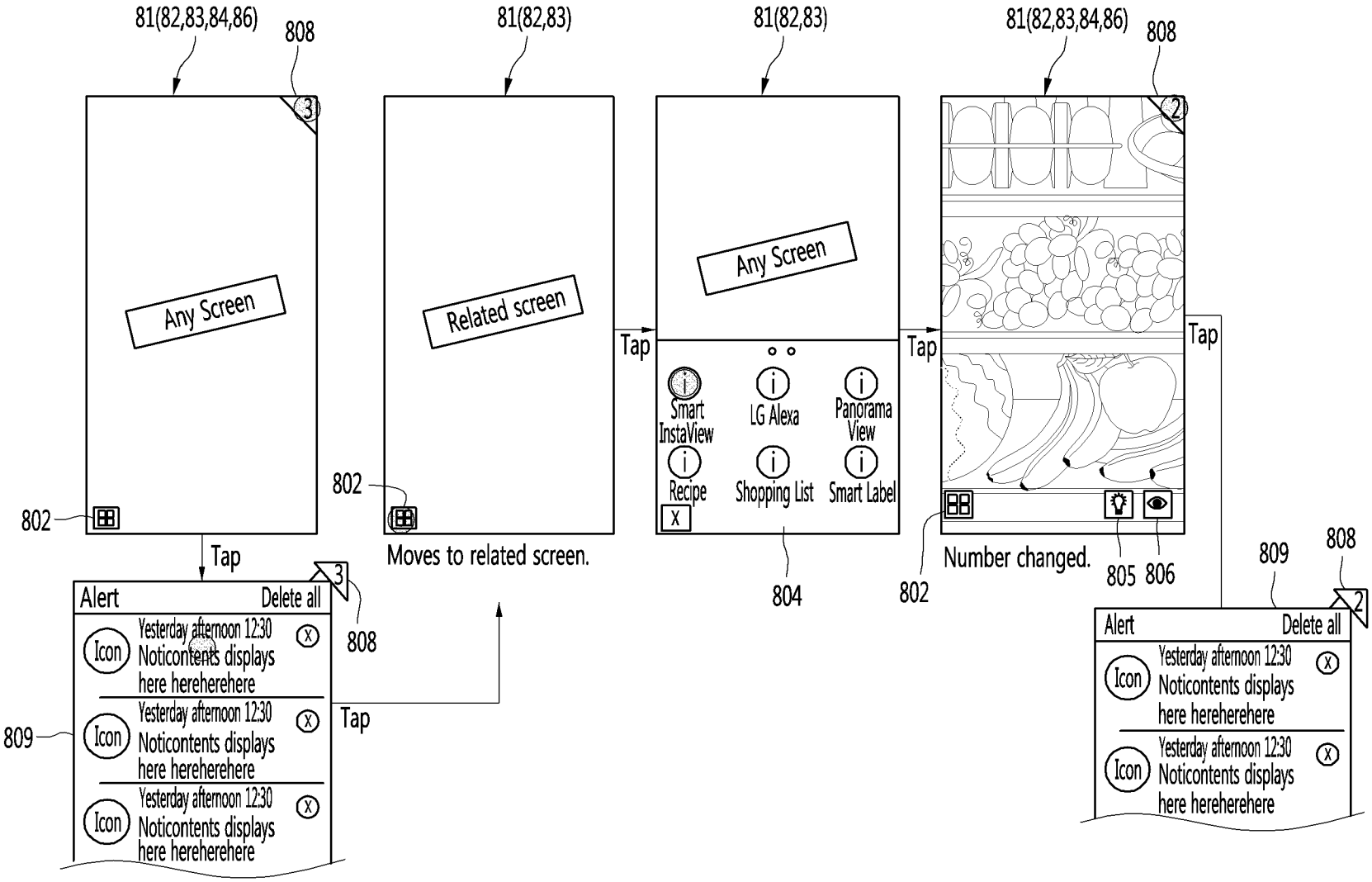
FIG. 54 is a view illustrating a manipulation state in which a plurality of alerts exist on the see-through part.

FIG. 53 is a view illustrating a manipulation state the alert is popped up on the see-through part. FIG. 2 is a perspective view of the refrigerator door according to an embodiment. FIG. 54 is a view illustrating a manipulation state in which a plurality of alerts exist on the see-through part.

As illustrated in FIG. 43, in an embodiment, when the see-through part 80 is turned on, if alert information may occur, a pop-up window may be popped up. The pop-up window 807 may be popped up in any state of the first state 81, the second state 82, the third state 83, the fourth state 84, and the sixth state 86, in which the see-through part 80 is turned on.

When the alert pop-up window 807 is popped up, the user may push and select the pop-up window 807. When the pop-up window is selected, the pop-up window may move to the associated screen.

For example, if the pop-up window 807 is the timer label 91 that is capable of confirmed on the panorama view screen 804*a*, when the pop-up window 807 is pushed, the see-through which 80 may be converted into the panorama view screen 804*a*, and thus, the timer label 91 may be highlighted and seen by the user.

If the pop-up window 807 is not associated with a specific screen but is associated with a plurality of screens, when the pop-up window 807 is pushed, the see-through part 80 may be converted into the first state 81 or the second state 82.

As illustrated in FIG. 54, when a plurality of alerts exists in the state in which the see-through part 80 is turned on, an alert tab 808 may be disposed on an upper edge of the see-through part 80. Also, the number of current alerts may be displayed as figures on the alert tab 808.

When the user pushes the alert tab 808, a list-shaped alert pop-up window 809 on which a plurality of alerts are displayed may be popped up on the see-through part 80. Also, when the user selects any one of the plurality of alerts, the screen may be converted into the associated screen as illustrated in FIG. 49.

When the operation is finished on the associated screen, and the main menu icon 802 and the main menu pop-up window 804 are sequentially selected to be converted into a different screen, figures except for the completed alert may be displayed on the alert tab 808, and when the alert tab 808 is selected to confirm the list of the alert pop-up window 809, it is confirmed that the corresponding alert is deleted.

The following effects may be expected in the refrigerator according to the proposed embodiments.

In the refrigerator according to the embodiment of the present disclosure, the see-through part may be selectively switched to be transparent or opaque to visualize the interior of the refrigerator, and the user may check the interior of the refrigerator without opening the door to improve the convenience in use and reduce the power consumption.

Also, the screen may be outputted in the state in which the interior of the refrigerator is seen through the see-through part even though the door is closed. Thus, the interior of the refrigerator may be seen, and also, the information of the interior of the refrigerator may be displayed to improve the user's convenience.

Also, the viewing of the food and the output of the information may be realized within the screen of the see-through part at the same time, and the information associated with the seen food may be outputted one screen to more improve the convenience in use.

Also, the operations of the display light, the door light, and the interior light may be combined with each other to selectively adjust the transparency of the screen outputted through the see-through part so that the transparency is adjusted to be suitable for the user's preference and the use environment of the refrigerator.

Also, the various pieces of information may be stored, processed, and displayed on the large see-through part that occupies the most area of the door, and the various screen configurations and the see-through screen having the various states may be provided to more improve the use convenience for the user.

Also, the output icons that are displayed on the see-through part may display the information associated with the foods stored in the refrigerator and seen through the see-through part may be displayed, and the positions of the output icons may be disposed to be arbitrarily adjusted by the user to improve the use convenience and the visibility of the see-through part.

Also, the output icon may match the food stored in the refrigerator. Thus, when the food moves to be accommodated, the output icon may be outputted at the moving position to improve the use convenience. Also, when the stored food moves to be accommodated, the output icon may inform the movement of the stored food to display the information of the food at the more accurate position, thereby improving the use convenience.

Also, when the door is opened in the state in which the see-through part is turned on, although the glare may occur by the door light, the door light may be turned off when the door is opened to prevent the user from glaring.

Also, when the door is closed after being opened, the see-through part may be maintained in the state in the same state as the previous screen state to allow the see-through part to be continuously manipulated and operated.

Also, in the transparent panel assembly forming the see-through part, the insulation space and the accommodation space in which the display is accommodated may be independently provided to independently provide the accommodation space in which the display together with the securing of the insulation performance.

That is, the insulation space may be completely closed and sealed to secure the insulation performance while the structure in which the light guide plate is constructible and expandable is provided in the accommodation space, and the structure through which the display and the display light are accessible is provided.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space;

a door opening and closing the storage space;

a transparent panel assembly which is disposed on at least one area of the door and on which a see-through part through which an interior of the refrigerator is seen is disposed; and a first light disposed closer to the interior of the refrigerator than the transparent panel assembly to brighten an area that is viewed by the see-through part, wherein the transparent panel assembly comprises:

a plurality of transparent panels spaced apart from each other to define an accommodation space;

a transparent display disposed in the accommodation space to output a screen; and a second light brightening the display within the accommodation space, wherein the display, the first light, and the second light are selectively turned off according to manipulation of a user so as to be converted into an opaque state in which the interior of the refrigerator is not seen and a transparent state in which the interior of the refrigerator is seen, and in the transparent state, a screen is outputted while an inner space of the refrigerator is seen.

2. The refrigerator according to claim 1, wherein the opaque state comprises at least one of:

a fifth state in which all the display, the first light, the second light are turned off; and a third state in which the display and the second light are turned on, and the first light is turned off.

3. The refrigerator according to claim 1, wherein the transparent state comprises at least one of:

a first state in which the first light is turned on, and the second light is turned off; and a second state in which all the first light, the display, and the second light are turned on.

4. The refrigerator according to claim 3, wherein, in the first state, the display is turned on.

5. The refrigerator according to claim 1, wherein the first light comprises:

a door light provided in the door; and an interior light disposed closer to the interior of the refrigerator than the door light to brighten the interior of the refrigerator.

6. The refrigerator according to claim 5, wherein, in the transparent state, only the door light of the first light is turned on.

7. The refrigerator according to claim 5, wherein, in the transparent state, when the door is opened, the door light is turned off, and the interior light is turned on.

8. The refrigerator according to claim 7, wherein, when the door is opened, the second light is also turned off so that the display is maintained in a turn-on state to output a screen in the see-through part.

9. The refrigerator according to claim 8, wherein, when the door is closed after being opened, the display is maintained in the turn-on state to maintain the output of the screen, and the second light is turned on again.

10. The refrigerator according to claim 1, further comprising a manipulation input unit manipulated to convert the state of the see-through part, wherein the refrigerator comprises one or more of:

a proximity detection sensor detecting an approach of the user;

a motion detection sensor detecting a motion of the user;

a microphone into which a voice of the user is inputted;

a knock detection device detecting knock manipulation of the user;

a vision sensor photographing an image of the user; and a manipulation part recognizing direct push manipulation of the user.

11. The refrigerator according to claim 10, wherein the transparent panel assembly further comprises a touch sensor recognizing touch manipulation of the user, and the state of the see-through part is adjusted by the touch manipulation of the transparent panel assembly.

12. The refrigerator according to claim 1, wherein, in the see-through part, all the display, the first light, and the second light are turned off to maintain the opaque state before a manipulation input of the user.

13. The refrigerator according to claim 10, wherein, when the manipulation of the manipulation input unit is detected in the opaque state, the state of the see-through part is converted into one corresponding to the manipulation of the manipulation input unit of:

a first state in which the first light is turned on, and the second light is turned off so that the inside of the see-through part is seen; and a second state in which all the first light, the second light, and the display are turned on so that a screen is outputted while the inside of the see-through part is seen; and a third state in which the first light is turned off, and the second light and the display are turned on so that only the screen is outputted while the inside of the see-through part is not seen.

14. The refrigerator according to claim 13, wherein, when the manipulation of the manipulation input unit is detected in the opaque state, the first light is turned off, and the second light and the display are turned on so that the see-through part becomes the third state, and when additional manipulation of the user is inputted, the state is selectively converted into one of the first state and the second state.

15. The refrigerator according to claim 1, wherein, in the opaque state, when the user closes the door after being opened, the see-through part becomes a glance state, and in the glance state, the first light is turned off, and the second light and the display are tuned on so that information is outputted while the interior of the refrigerator is not seen.

16. The refrigerator according to claim 15, wherein, in the glance state, the see-through part temporarily outputs a preset screen, and when an additional input of the user is not performed, the glance state is converted again into the opaque state.

17. The refrigerator according to claim 1, wherein, in a state in which the door is opened, and the see-through part is opaque, when the manipulation of the user is inputted, the display and the second light are turned on to output the screen.

18. The refrigerator according to claim 1, wherein, when an alert for transmitting information or message to the user through the screen output of the see-through part is provided, if an approach of the user is detected by a proximity sensor, the display and the second light are turned on to output an alert screen through the see-through part in the state in which the see-through part is opaque.

19. The refrigerator according to claim 1, wherein, when the see-through part is in the transparent state, the display and the second light are turned on to output an output icon for displaying information on the see-through part, and the output icon moves to and is disposed at a position corresponding to an accommodation position of food in the refrigerator, which is seen in the state in which the first light is turned on, by touch manipulation of the user.

20. The refrigerator according to claim 19, wherein a camera for photographing the food is provided in the refrigerator, and when the accommodated position of the food is changed, the camera detects the position change, and the output icon moves to a changed accommodated position of the food, or an alert is outputted.

* * * * *